US005657710A

United States Patent [19]

Foster et al.

[11] Patent Number: 5,657,710

[45] Date of Patent: Aug. 19, 1997

[54] AUTOMATIC GARMENT MANUFACTURE

[75] Inventors: Wayne G. Foster; John R. Everhart, both of Winston-Salem; Mike D. Hines, Lewisville; Erik D. Moore, Lexington; Joel C. Rosenquist, Kernersville; Ken J. Thompson, Lexington; David S. Trotter, Winston-Salem, all of N.C.

[73] Assignee: Sara Lee Corporation, Winston-Salem, N.C.

[21] Appl. No.: 505,669

[22] Filed: Jul. 21, 1995

[51] Int. Cl.[6] ..... D05B 21/00

[52] U.S. Cl. ..... 112/470.06; 112/470.33; 112/470.36; 112/475.05; 112/475.07; 112/475.09

[58] Field of Search ..... 112/470.06, 470.01, 112/470.36, 470.14, 470.09, 470.05, 475.04, 475.05, 475.06, 475.07, 475.09, 147, 63

[56] References Cited

U.S. PATENT DOCUMENTS

| | | | |
|---|---|---|---|
| 3,710,742 | 1/1973 | Chercass | 112/470.33 |
| 4,644,883 | 2/1987 | Guin et al. | 112/470.36 |
| 4,750,442 | 6/1988 | Keeton | 112/475.07 X |

*Primary Examiner*—Peter Nerbun

*Attorney, Agent, or Firm*—Rhodes Coats & Bennett, L.L.P.

[57] ABSTRACT

An apparatus for automatically forming a finished sleeve or pant leg for a sweat suit or the like is disclosed. The invention consists of six sub-assemblies: 1) a garment piece positioner and seamer; 2) a cuff making apparatus; 3) a cuff inserting apparatus; 4) an automatic cuff setter; 5) a sleeve invertor; and 6) a garment stacker.

19 Claims, 50 Drawing Sheets

AUTOMATIC GARMENT MANUFACTURE

BACKGROUND OF THE INVENTION (1) Field of the Invention

The present invention relates generally to automated manufacturing systems and, more particularly, to an apparatus for automatically forming a finished sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, sleeves and pant legs must be sewn "inside out" in order to make a garment having clean seams. This has always been a manual operation because of the dexterity required to locate the cut fabric piece, inspect it for defects and feed it into the sewing machine. Unfortunately, repetitive actions such as sewing a garment may cause health problems. However, it has been extremely difficult to design a device which can reliably locate, inspect and sew a fabric piece to form a garment piece such as a sleeve or pant leg time after time.

Thus, there remains a need for an apparatus for automatically forming a finished sleeve or pant leg for a sweat suit or the like which will operate reliably time after time while, at the same time, it can be carried out completely automatically without the need for a skilled operator.

SUMMARY OF THE INVENTION

The present invention is directed to an apparatus for automatically forming a finished sleeve or pant leg for a sweat suit or the like. The invention consists of six subassemblies: 1) a garment piece positioner and seamer; 2) a cuff making apparatus; 3) a cuff inserting apparatus; 4) an automatic cuff setter; 5) a sleeve invertor; and 6) a garment stacker.

The garment piece positioner and seamer receives a garment piece at a first workstation and moves the garment piece to a second workstation. The garment piece positioner and seamer includes: (i) a garment piece transfer system located adjacent to the first workstation for engaging the garment piece at the first workstation and for moving the garment piece to the second workstation; and (ii) a vision and control system located adjacent to the first workstation for determining the position of the garment piece at the first workstation and sending a control signal to the garment piece transfer system to engage the garment piece at the first workstation and move the garment piece to the second workstation.

The cuff making apparatus makes a cuff from a continuous supply of tubular material. The cuff making apparatus includes: (i) a material feed for advancing the tubular material; (ii) a cutter disposed adjacent the material feed for severing the tubular material to form a circular band; and (c) a holding fixture for holding the circular band severed from the tubular cuff material.

The cuff inserting apparatus inserts the cuff into the sleeve of the garment piece. The cuff inserting apparatus includes: (i) a holding fixture for holding the cuff in a generally open configuration; (ii) a sleeve opener for opening the sleeve of the garment sufficient to allow insertion of the cuff into the sleeve, the sleeve opener including a support surface for supporting the sleeve and a pick-up head for engaging an upper layer of the sleeve, wherein the pick-up head is mounted for vertical movement relative to the support surface to lift the upper layer of the sleeve; and (iii) means for effecting relative movement between the holding fixture and the sleeve opener to insert the cuff into the sleeve.

The automatic cuff setter automatically sets the cuff to the garment piece by a sewing machine. The cuff setter includes: (i) a transfer system for moving the cuff and garment piece to the sewing machine; and (ii) a cuff setter including an elongated tube having a front end and a rear end for receiving the garment piece over the front end of the tube and a spreader assembly for moving the cuff and garment piece together in the direction of sewing to attach the cuff to the garment.

The sleeve invertor automatically inverts the garment piece. The sleeve invertor includes: (i) a frame; (ii) an elongated tube attached to the frame having a front end and a rear end for receiving the garment piece over the front end of the tube; (iii) an elongated arm located adjacent to the rear end of the tube and axially aligned with the tube and movable from a first position extending from the rear to the front portion of the tube to a second position rearward of the tube; and (iv) gripper means attached to one end of the arm, whereby the gripper means and arm are operable to grasp and withdraw the garment piece through the front end of the tube to the rear end of the tube to automatically invert the garment piece.

The garment stacker stacks the finished garments in a garment stack. The garment stacker includes: (i) a stacking tray having a support tray for supporting garments placed thereon in a garment stack and a tray actuator for adjusting the position of the support tray; (ii) a rotary stacker positioned adjacent the stacking tray, wherein the rotary stacker repeatedly moves between a loading and an unloading position to successively stack garments on the stacking tray in a garment stack; and (iii) a controller for directing the tray actuator to position the support tray upwards when the rotary stacker is in the unloading position so as to press the garment stack between the stacking tray and rotary stacker.

These and other aspects of the present invention will become apparent to those skilled in the art after a reading of the following description of the preferred embodiment when considered with the drawings.

DESCRIPTION OF THE PREFERRED EMBODIMENTS

Figure 1:
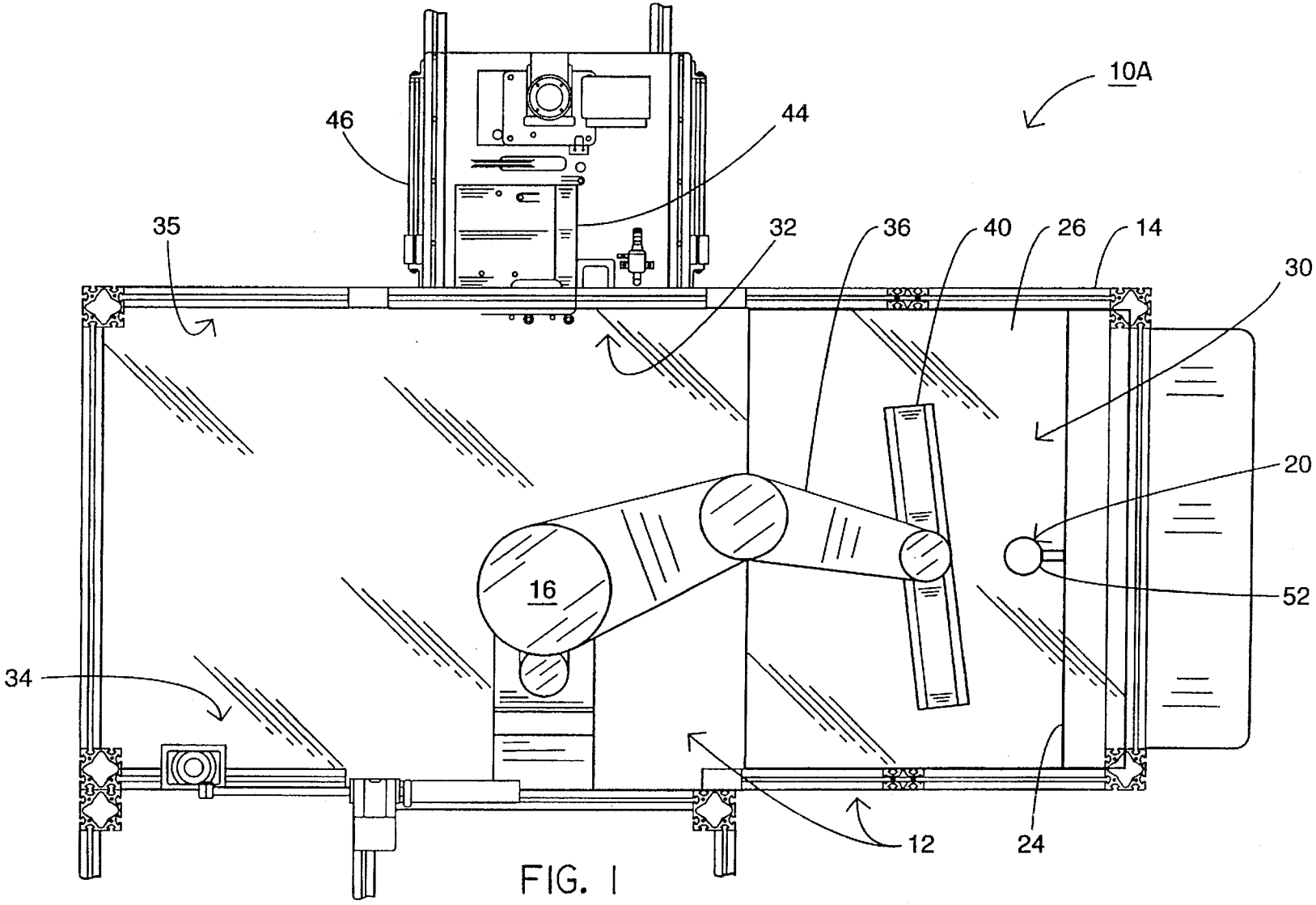
FIG. 1 is a plan view of a garment piece positioner and seamer constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general, it will be understood that the illustrations are for the purpose of describing a preferred embodiment of the invention and are not intended to limit the invention thereto. The present invention consists of six sub-assemblies: 1) a garment piece positioner and seamer; 2) a cuff making apparatus; 3) a cuff inserting apparatus; 4) an automatic cuff setter; 5) a sleeve invertor; and 6) a garment stacker. Each sub-assembly is described in detail below.

GARMENT PIECE POSITIONER AND SEAMER

As best seen in FIG. 1, a garment piece positioner and seamer, generally designated 10A, is shown constructed according to the present invention.

Garment piece positioner and seamer 10A is designed to assemble clothing articles. In the assembling process of a clothing article, a garment piece must be moved to one or more assembling stations. The garment piece is sewn, attached to other garment pieces, and/or transferred to other apparatuses at the various assembling stations to create a clothing article.

Garment piece positioner and seamer 10A can be used to assemble a wide variety of clothing articles. The preferred embodiment of garment piece positioner and seamer 10A is used to assemble a garment piece into a sleeve for attachment to a shirt. In the preferred embodiment, garment pieces are successively loaded at a loading station 30 where they are moved first to a sewing station 32 for seaming and then to a transfer station 34 for subsequently assembling the garment piece into a finished sleeve.

Garment piece positioner and seamer 10A includes a positioner 12 for moving garment pieces to assembling stations 32,34 and a vision system 20 for controlling positioner 12. Positioner 12 includes a table 14 and robot 16. Robot 16 slidably moves a garment piece over table 14 to position the garment piece from loading station 30 to stations 32, 34. Robot 16 moves a garment piece between stations 30–34 by slidably moving the garment piece over table 14. The movement of robot 16 is controlled by vision system 20 which includes a camera 52 and a controller (not shown). Vision system 20 locates a garment piece that has been randomly loaded onto table 14 at the loading station 30 and produces garment piece location data which corresponds to the garment piece's location. The garment piece location data is communicated to robot 16 which uses the data to selectively engage the garment piece and to control the movement of robot 16 in order to precisely position the garment piece at stations 32, 34.

Figure 2:
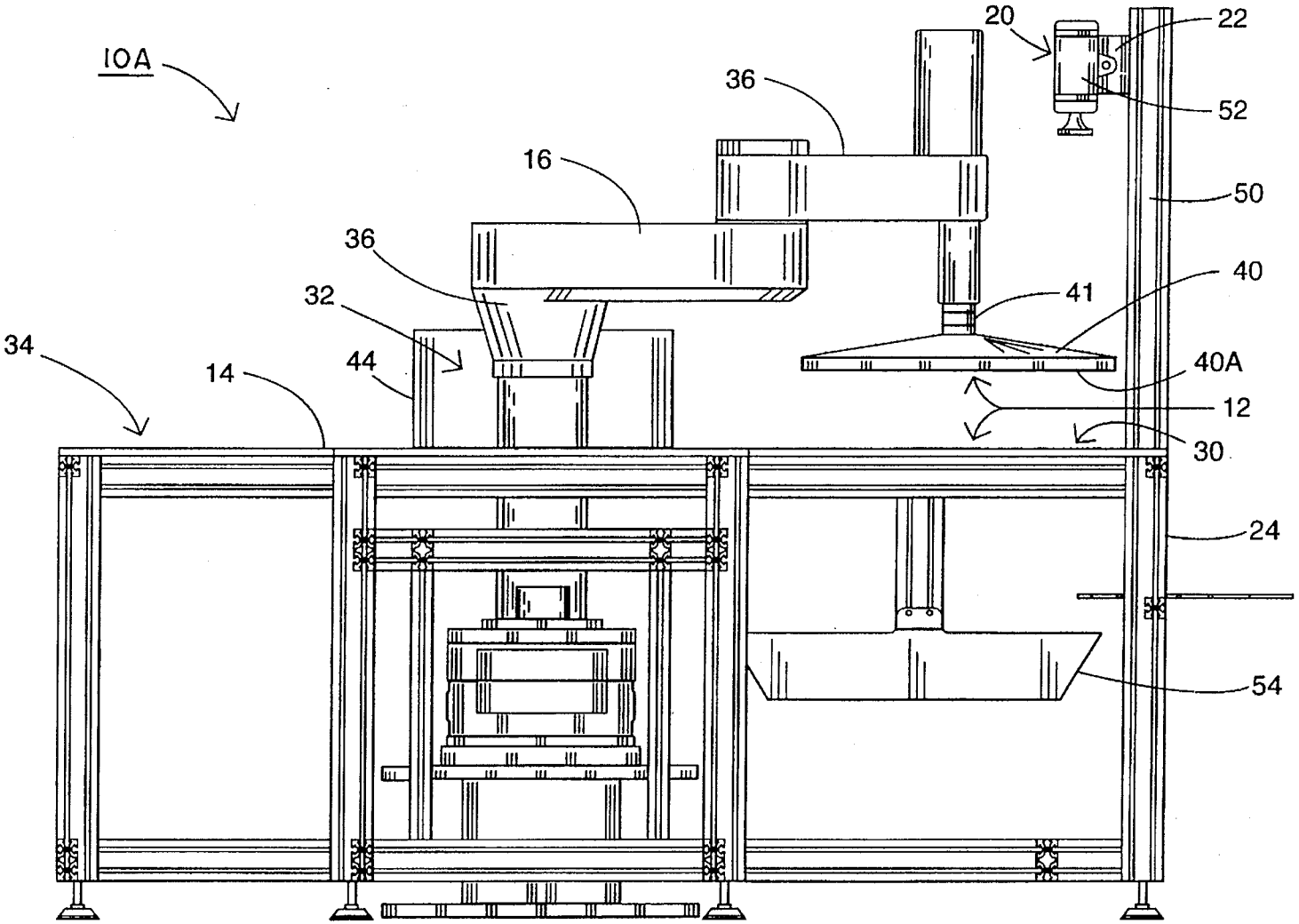
FIG. 2 is a side elevation view of the garment piece positioner and seamer shown in FIG. 1.

As shown in FIGS. 1 and 2, robot 16 is adjacently positioned to table 14. Table 14 includes a support frame 24 and a generally horizontal planar surface 26. The planar surface 26 of table 14 is designed to have a smooth surface so that a garment piece can be slidably moved over the planar surface 26 with minimum frictional resistance. In the preferred embodiment, the generally horizontal planar surface 26 is made from glass or transparent plastic.

Located around table 14 are loading station 30, sewing station 32, and transfer station 34. Loading station 30 provides an area where a garment piece can be initially positioned on the table 14. Sewing station 32 includes a sewing machine 44 that functions to sew along a selected line of a garment piece moved through the stationary sewing station 32. Sewing machine 44 is supported by a sewing machine table 46 that can be automatically retracted from table 14 for necessary repairs. Transfer station 34 is the last work station for the garment piece positioner and seamer 10A and the garment piece is transferred from station 34 for further assembling.

Robot 16 includes a robot arm 36 and an attached robot presser foot 40 positioned above table 14 for precisely positioning a garment piece from loading station 30 to stations 32 and 34. Presser foot 40 is attached to a tool changer 41 located at one end of robot arm 36. Tool changer 41 and attached robot presser foot 40 can be positioned in both vertical and horizontal directions with respect to table 14. In addition, robot presser foot 40 can be rotated in a plane parallel to the planar surface 26 of table 14. Rotating presser foot 40 varies the orientation at which the robot presser foot 40 is attached to robot arm 36. The ability to move robot presser foot 40 in this manner allows presser foot 40 to selectively engage a garment piece loaded at loading station 30 and to then slidably move the engaged garment piece to stations 32 and 34. Presser foot 40 has a planar bottom surface 40A for engaging a garment piece that has been laid flat on table 14 at loading station 30.

Presser foot 40 is placed in an engagement position with a garment piece on table 14 by positioning bottom surface 40A against the garment piece such that the garment piece is sandwiched between presser foot 40 and table 14. Placing the presser foot 40 in the engagement position results in the garment piece being frictionally engaged by presser foot 40. Presser foot 40 is positioned on a selected portion of the garment piece when in the engagement position. With the presser foot 40 in the engagement position, the garment piece can be slidably moved along table 14 by moving presser foot 40 in a planar path. Presser foot 40 is sized so that bottom surface 40A has a surface area capable of engaging a sufficient amount of the garment piece's surface area so that the garment piece is maintained in a flat position as the garment piece is moved.

In the preferred embodiment, a felt-type material is attached to the bottom planar surface of presser foot 40. The felt-type material has a higher coefficient of friction than that of the planar surface 26 of table 14. This allows the presser foot 40 to maintain contact with the garment piece as it is moved across the surface of the table to the next workstation.

Robot 16 includes a robot processor (not shown) for directing the movement of robot arm 36 and attached robot presser foot 40. The robot processor uses location data to position presser foot 40 in the engagement position and to selectively position the garment piece at stations 32 and 34. The location data used to position presser foot 40 includes data which represents the fixed locations of sewing machine 44, transfer station 34, and the position of robot presser foot 40 when it is in an operator-defined home position. In addition, the location data includes data generated by the vision and control system 20 that represents the location in the loading station 30 of a randomly loaded garment piece. By processing the fixed location data, the robot processor can selectively engage a loaded garment piece and control the path of travel of robot arm 36 and the orientation of robot presser foot 40.

In order for robot 16 to engage a garment piece which has been randomly loaded onto table 14 at loading station 30, the position of the garment piece on table 14 must be inputed to the robot processor. Vision system 20 is provided to locate a garment piece loaded at the loading station 30 and to produce garment piece location data which represents the position of the garment piece on table 14. The garment piece location data is communicated from vision system 20 to robot 16 for use in controlling the positioning of a garment piece by robot 16.

Vision system 20 includes camera 52 which is supported above the loading station 30 by camera support 50. Camera 52 is used to take pictures of the loading station 30 to locate the position of a garment piece located in the loading station 30. To enable vision system 20 to locate a garment piece, a vision back-lighting apparatus 54 is positioned beneath table 14 at loading station 30. Vision back-lighting apparatus 54 shines light upwardly through the transparent, planar surface 26 of table 14. A garment piece placed at the loading station 30 blocks light produced by vision back-lighting 54. Vision system 20 locates the garment piece by detecting where light is being blocked on the table 14.

Figure 3:
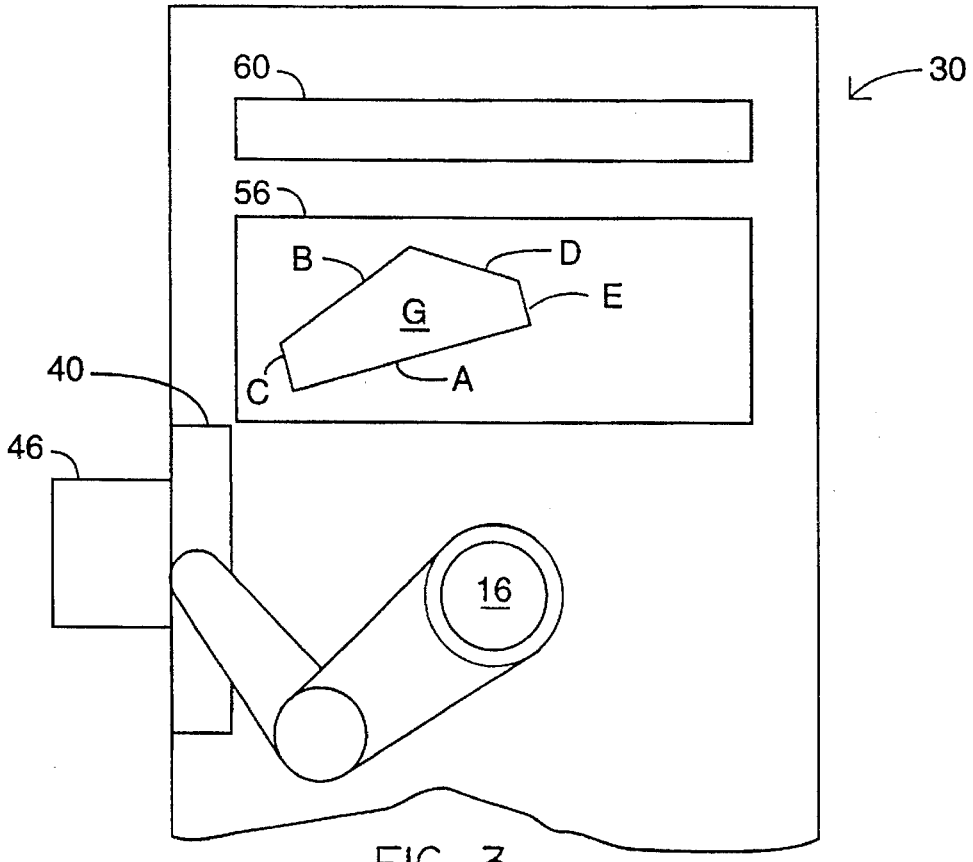
FIG. 3 is a partial, enlarged plan view of FIG. 1 illustrating a garment piece loaded on the table at the loading station.

As shown in FIG. 3, vision system 20 divides loading station 30 into an inspection area 56 and a protection area 60. Protection area 60 is located at a forward section of loading station 30 and inspection area 56 is located in an adjacent, rear section of loading station 30. As will be described in more detail below, the protection area 60 is a safety feature designed to prevent the operation of robot 16 when an operator's hands have not been moved free of the table 14, and inspection area 56 is the area where the loaded garment piece is inspected and first engaged by robot 16.

in the preferred embodiment, garment piece positioner and seamer 10A is used to assemble a garment piece into a sleeve. The garment piece loaded onto table 14 at loading station 30 is a single sheet of fabric that has been folded over. As shown in FIG. 3, a garment piece G has been loaded into the inspection area 56 and includes a fold edge A, a sewing edge B, a cuff edge C, and a shoulder opening D. Garment piece G is folded over at fold edge A so that the garment piece has a bottom fabric layer and an overlapping, top fabric layer. The bottom and top layers of the garment piece are not connected to one another at sewing edge B, cuff edge C, and shoulder opening D. Garment piece positioner and seamer 10A functions to sew closed the bottom and top layers of a garment piece along and adjacent sewing edge B and to selectively position cuff edge C at transfer station 34.

Figure 4:
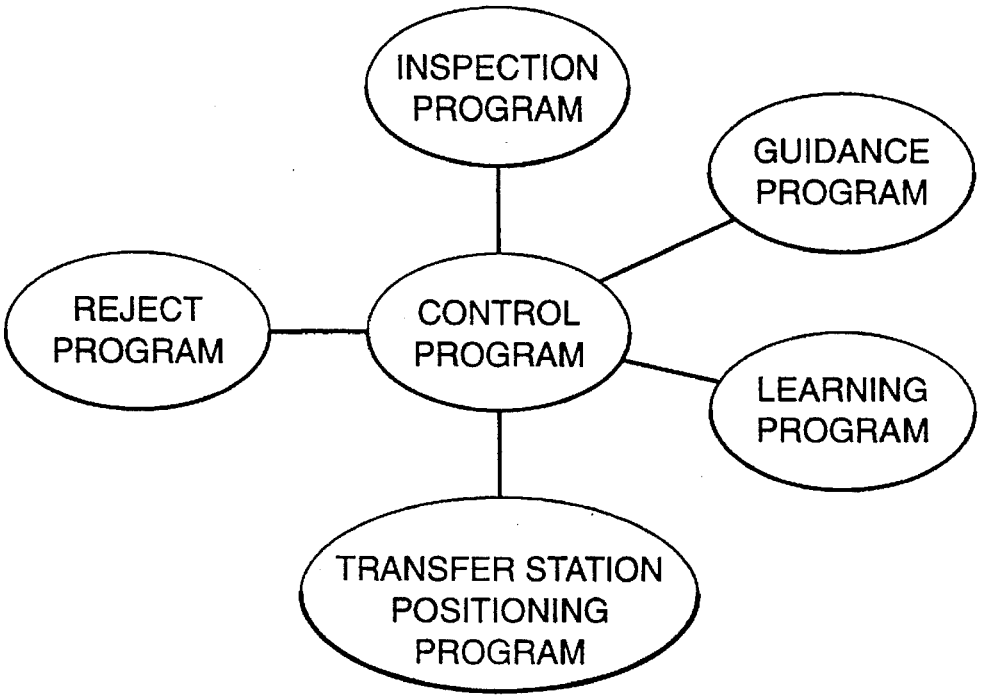
FIG. 4 is a schematic of the operations program used to control the positioner and seamer.

An operations program controls the operation of garment piece positioner and seamer 10A such that successively loaded garment pieces are assembled into sleeves. As shown by FIG. 4, the operations program includes an inspection program, a guidance program, a learning program, a transfer station positioning program, and a reject program. As depicted in FIG. 4, the operations program includes a control program for controlling the overall operation of garment piece positioner and seamer 10.

Each of these programs performs a different function in controlling the garment piece positioner and seamer 10. The inspection program tests a garment piece loaded on the loading station 30 and determines whether the loaded garment piece should be rejected as unsuitable. The guidance program and pattern learning program provide for two different methods to selectively position a loaded garment piece at the sewing station 32 to sew the sewing edge B of the garment piece. The transfer station positioning program detects the location of the cuff edge C of a garment piece and selectively positions the cuff edge C at the transfer station 34. The reject program disposes of a loaded garment piece that has been determined by the vision system 20 to be defective.

Figure 5:
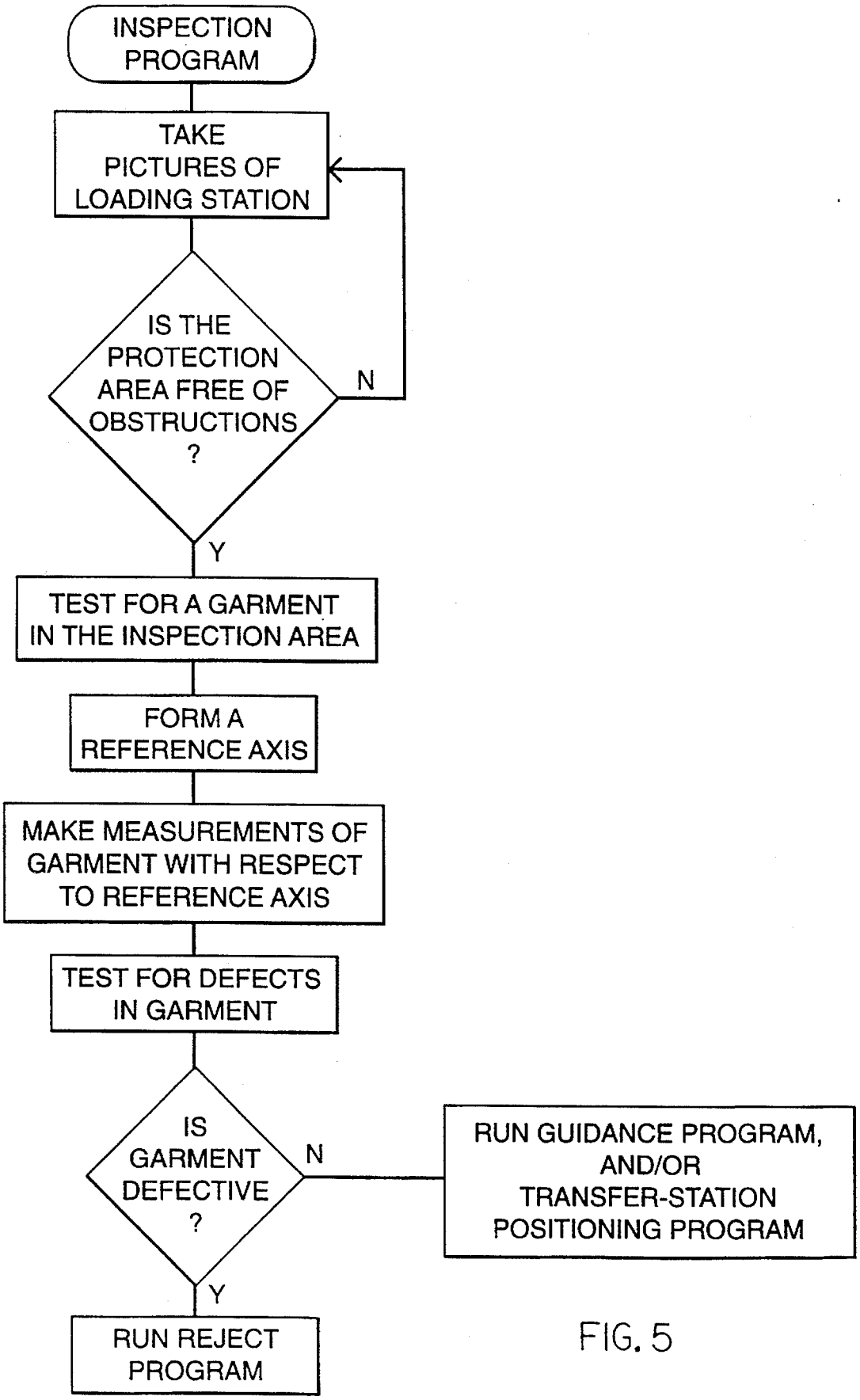
FIG. 5 is a flow chart of the inspection program.

With reference to the flow chart shown in FIG. 5, the inspection program operates as follows. Camera 52 is turned on to repeatedly take pictures of loading station 30. Vision system 20 first analyzes the pictures to determine if the designated protection area 60 is free of obstructions. A person's arm or a portion of the garment piece in the protection area 60 will result in vision system 20 detecting an obstruction. If an obstruction is detected, vision system 20 will not signal robot 16 to move from its home position to the loading station 30. Accordingly, robot 16 is prevented from moving to the loading station at any time during operation of the garment piece positioner and seamer 10A unless the loading station is free of obstructions. Continuously checking for an obstruction in protection area 60 is a safety feature that helps prevent a person loading garment pieces from being struck and injured by robot 16. In addition, the inspection program will not proceed until the garment piece being loaded is fully inserted into the inspection area 56 and no section of the garment piece is overlying protection area 60. The person loading the garment pieces is notified that the garment piece has not been properly loaded in the inspection area 56.

If the protection area 60 is free of obstructions, the inspection program proceeds and vision system 20 analyzes the pictures of the inspection area 56 to test if a garment piece of sufficient area has been loaded. The area of the loaded garment piece is calculated by determining what portion of the inspection area 56 is blocked by the loaded garment piece. The measure area of the garment piece is then compared to stored reference data to determine if a garment of sufficient area has been loaded.

Figure 6:
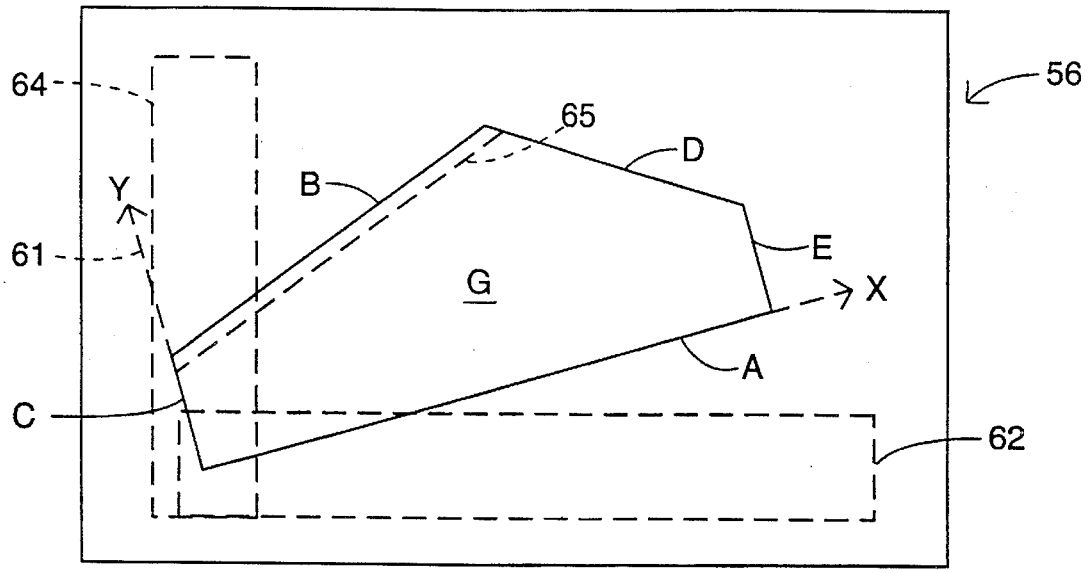
FIG. 6 is a top view showing a garment piece loaded at the loading station and a schematic depiction of the garment piece being located by the vision system.

The inspection program also analyzes the pictures and locates in inspection area 56 a reference axis 61 having an x-axis and a y-axis, as shown in FIG. 6. The reference axis 61 is formed on the loaded garment piece with the origin of the reference axis 61 located at the corner of the fold edge A and cuff edge C of the garment piece. The x-axis of the reference axis 61 fits approximately along fold edge A and the y-axis extends from the origin in perpendicular relation with the x-axis.

It is necessary to form a reference axis 61 on the loaded garment piece so that measurements can be made of the garment piece and the position of the garment piece can by determined. The garment piece loaded into inspection area 56 is loaded randomly and has no fixed or exact position in inspection area 56. The position of the garment piece is determined by locating the reference axis 61 on the garment piece.

Several steps are performed by vision system 20 to form the reference axis on the garment piece. As shown in FIG. 6, the inspection area 56 is segmented to include a first search region 62 and a second search region 64. The first search region 62 is located along a rearward section of the inspection area 56 and the second search region 64 is located along one side of the inspection area 56, as shown in FIG. 6.

The vision system 20 analyzes the first search region 62 to locate fold edge A of the garment piece and forms the x-axis of the reference axis along fold edge A. The vision system 20 also analyzes the second search region 64 to locate cuff edge C. Accordingly, at least a section of the fold edge A of the garment piece must be located in the first search region 62 for the reference axis to be formed on the garment piece. The locations of cuff edge C and fold edge A are processed by the vision system 20 to determine the location of the intersection of fold edge A and cuff edge C. The origin of the reference axis is located at this intersection. The x-axis is extended from the origin to approximately along fold edge A and the y-axis is extended perpendicular from the x-axis.

Once the reference axis has been formed on the garment piece in this manner, the inspection program makes measurements of the garment piece. In particular, the distance between the fold edge A and sewing edge B at various points along the x-axis is calculated. These distance measurements are then compared with reference distances that correspond to an ideal or suitable garment piece to determine if the loaded garment piece is defective. Other tests such as whether there are holes in the garment piece are also made. If the garment piece is determined to be defective then the reject program can be run to discard the garment piece.

Figure 7:
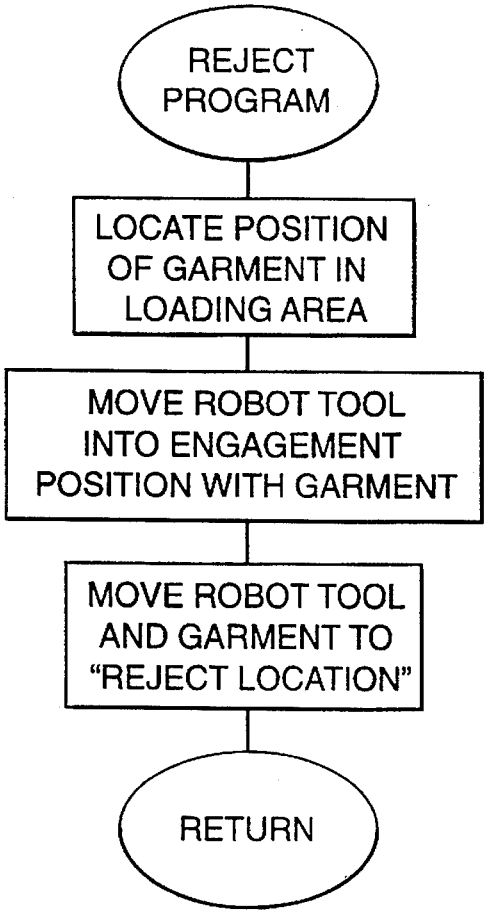
FIG. 7 is a flow chart of the reject program.

Referring to FIG. 7, the reject program operates to discard a garment piece determined to be a reject. The reject program operates by first locating the position of the garment piece to be rejected. Robot 16 is then moved to loading station 30 and into engagement with the garment piece. Robot 16 is then moved in a planar path to a reject location 35 where the garment piece is moved off of the surface of the table into a reject bin (not shown).

Figure 8:
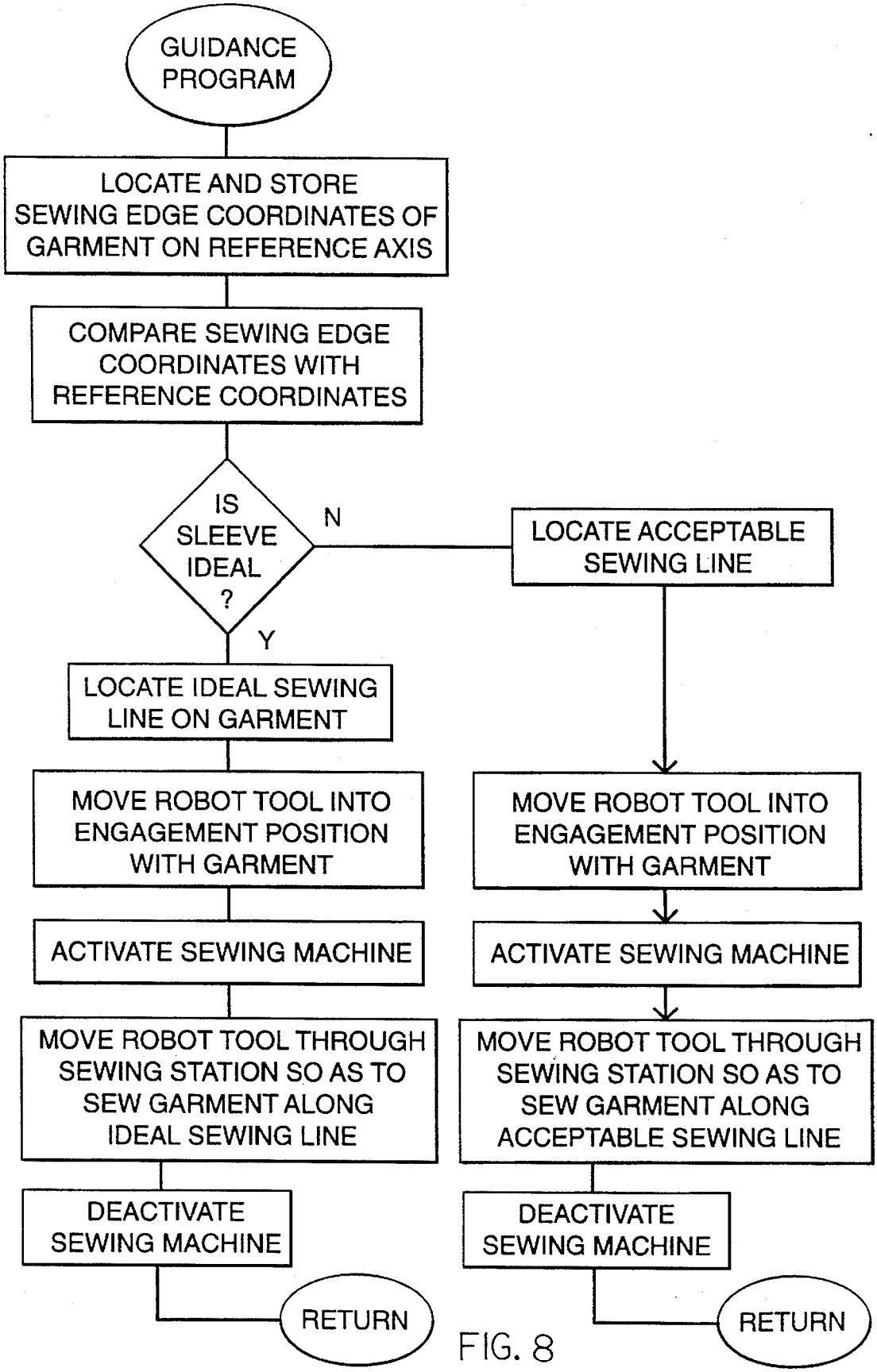
FIG. 8 is a flow chart of the guidance program.

If the garment piece is determined not to be a reject, the guidance program and/or the transfer station positioning program are run. Referring to FIG. 8, the guidance program is run when garment pieces having a sewing edge B with a known pattern are being loaded and reference coordinates corresponding to sewing edge B have been previously inputed. The guidance program determines where the sewing line 65, shown in FIG. 6, will be located on the garment piece and operates as follows. First, the coordinates of the sewing edge B on the reference axis are located and stored. The sewing edge coordinates are then compared with ideal sewing edge coordinates to determine if the garment piece falls within an ideal garment piece class.

If the garment piece falls within an ideal garment piece class, then an ideal sewing line is located on the garment piece. The ideal sewing line is spaced a selected distance from fold line A and extends generally adjacent to sewing edge B. Vision system 20 then directs robot presser foot 40 to move to loading station 30 and engage the garment piece at a selected distance from the ideal sewing line.

In order to engage the garment piece at a select distance from the ideal sewing line, robot arm 36 is rotated from its home position to the loading station 30 and the presser foot 40 is positioned over the garment piece. Once presser foot 40 is positioned over the garment piece, the presser foot 40 is rotated to align itself with the garment piece. The presser foot 40 is then lowered to engage the garment piece on the surface of the support table.

Robot presser foot 40 is then moved to the sewing station 32 such that the garment piece is slidably moved through sewing machine 44. The sewing machine is activated and the garment piece is selectively moved through sewing machine 44 such that the garment piece is sewn along the ideal sewing line. Any excess material extending outwardly from the ideal sewing line is cut and discarded by sewing machine 44 during the sewing process. The sewing machine 44 is deactivated after the garment piece passes therethrough and the guidance program is ended.

If the guidance program determines that a loaded garment piece is not ideal, then the garment piece is placed in an acceptable garment piece class and an acceptable sewing line is formed on the garment piece. The acceptable sewing line is formed a selected distance from the sewing edge B. Vision system 20 then directs robot presser foot 40 to move to loading station 30 and engage the garment piece a selected distance from the acceptable sewing line. The sewing machine 44 is then activated.

Robot presser foot 40 is moved to the sewing station 32 such that the garment piece is slidably moved through sewing machine 44. The garment piece is selectively moved through sewing machine 44 such that the garment piece is sewn along the acceptable sewing line. The sewing machine 44 is deactivated after the garment piece passes therethrough and the guidance program is ended.

Figure 9:
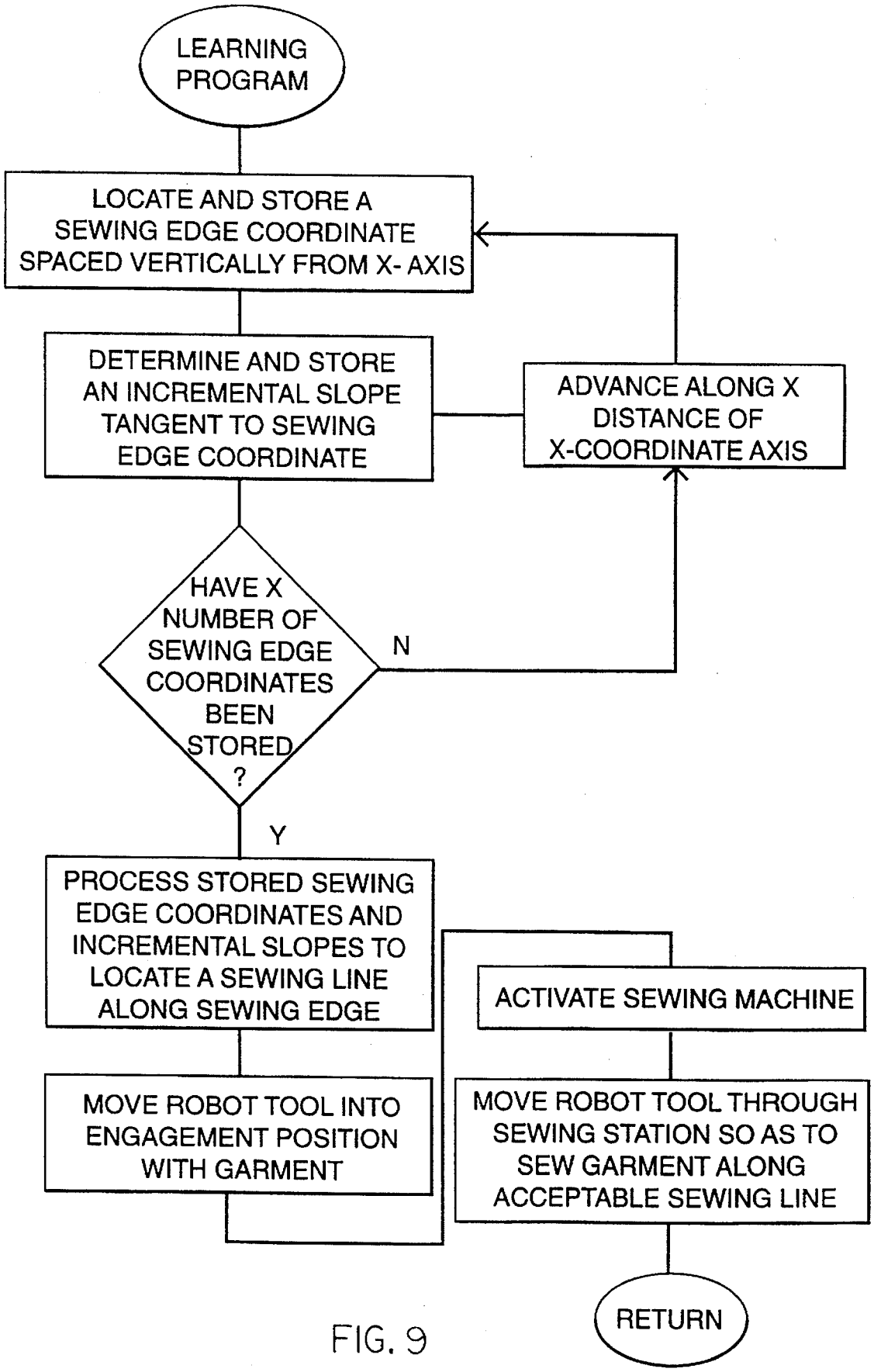
FIG. 9 is a flow chart of the learning program.

Referring to FIG. 9, the learning program is used where garment pieces having a sewing edge B with an unknown pattern are being loaded. To determine the pattern of sewing edge B, the learning program first locates and stores a sewing edge coordinate spaced vertically from the x-axis. The incremental slope tangent to the sewing edge coordinate is also calculated and stored. A selected number of sewing edge coordinates and their tangential slopes are determined and stored. The sewing edge coordinates and their tangential slopes are processed to form a sewing line adjacent to sewing edge B.

The learning program then moves the robot presser foot to the loading station 30 and engages the garment piece a selected distance from the sewing line. The sewing machine 44 is activated and the robot presser foot 40 moved in a planar path to the sewing station 32. The robot is controlled to move the garment piece through the sewing machine 44 such that the garment piece is sewn along the ideal sewing line. Sewing the garment piece along the ideal sewing line connects the bottom and upper layers of the garment piece together generally along the sewing edge B and the learning program is completed.

Figure 10:
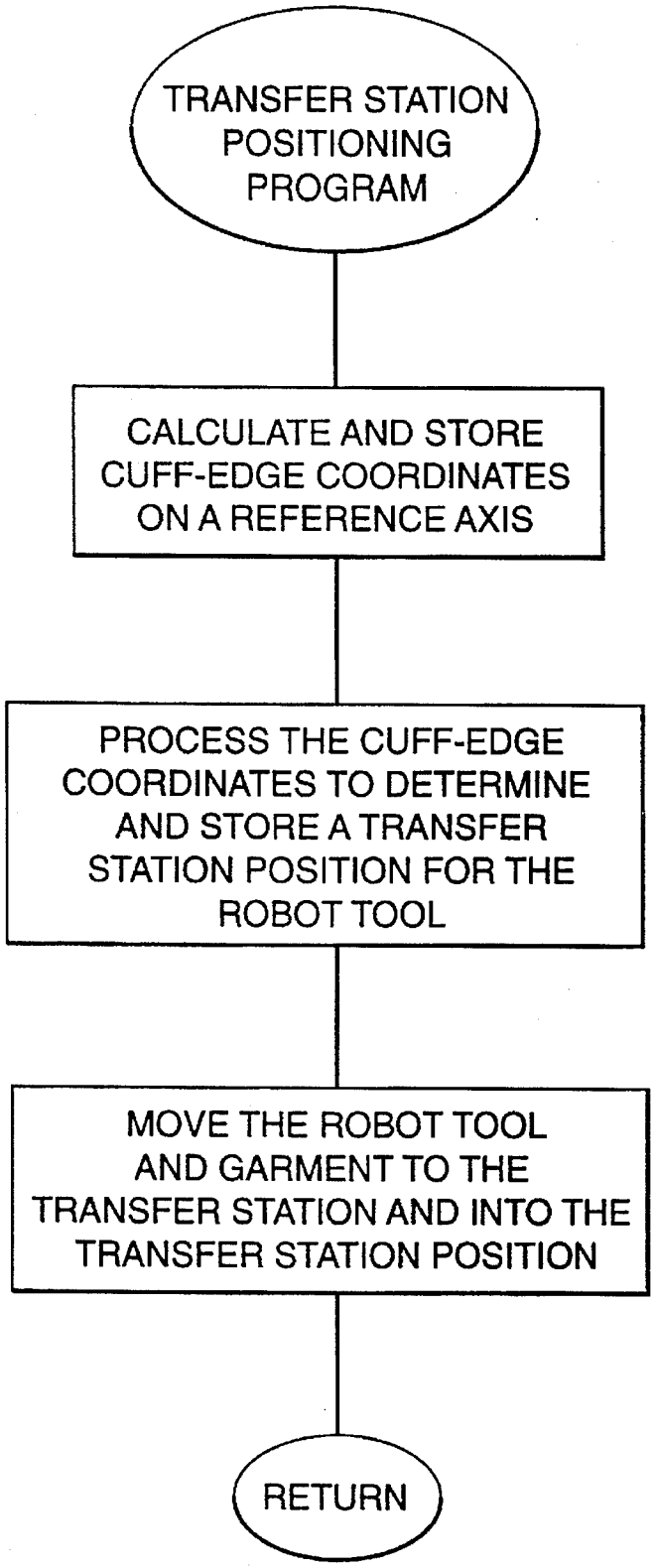
FIG. 10 is a flow chart of the transfer-station positioning program.

Referring to FIG. 10, the transfer station positioning program operates in conjunction with either the guidance program or the learning program. The transfer station positioning program operates to determine the position of the cuff edge C in the inspection station 30 so that the cuff edge C can be selectively positioned at transfer station 34.

While the garment piece is at the loading station 30, the transfer station positioning program calculates and stores cuff-edge coordinates on the reference axis. The cuff-edge coordinates are processed to determine how the robot presser foot 40 will be positioned at transfer station 34. The transfer station positioning program controls the movement of the robot presser foot 40 from the sewing station 32 to the transfer station 34 and how the garment piece is positioned at the transfer station.

The control program for the garment piece positioner and seamer 10A controls the sequence of operations required for the garment pieces to be sewn and transferred. The control program is designed such that operations on two different garment pieces are performed simultaneously. For example, a first garment piece can be transferred from sewing station 32 to transfer station 34 while, at the same time, a second garment piece is being inspected at loading station 30.

In order to provide such control of the operations performed the garment piece positioner and seamer 10, various status signals are generated and used. The generated status signals include a loaded signal generated when a garment piece is loaded at inspection station 30; a sewn signal generated when a garment piece is sewn at sewing station 32; and a transferred signal generated when a garment piece has been transferred from transfer station 34.

In operation, garment piece positioner and seamer 10A operates to automatically position and assemble garment pieces into a sleeve or pant leg. The sequence of positioning and assembling a garment piece into an assembled sleeve is shown in FIGS. 11A–11E. As shown in FIGS. 1–3 and FIG. 11A, a garment piece is initially loaded in the inspection area 56 of loading station 30 and camera 52 is activated. The garment piece G1 is inspected by vision system 20 and a loaded status signal is generated. If the garment piece G1 fails inspection, the robot presser foot 40 engages the garment piece and slidably moves the garment piece to a rejection area 35, shown in FIG. 11E, where the garment piece is discarded into a reject bin (not shown).

Figure 11A:
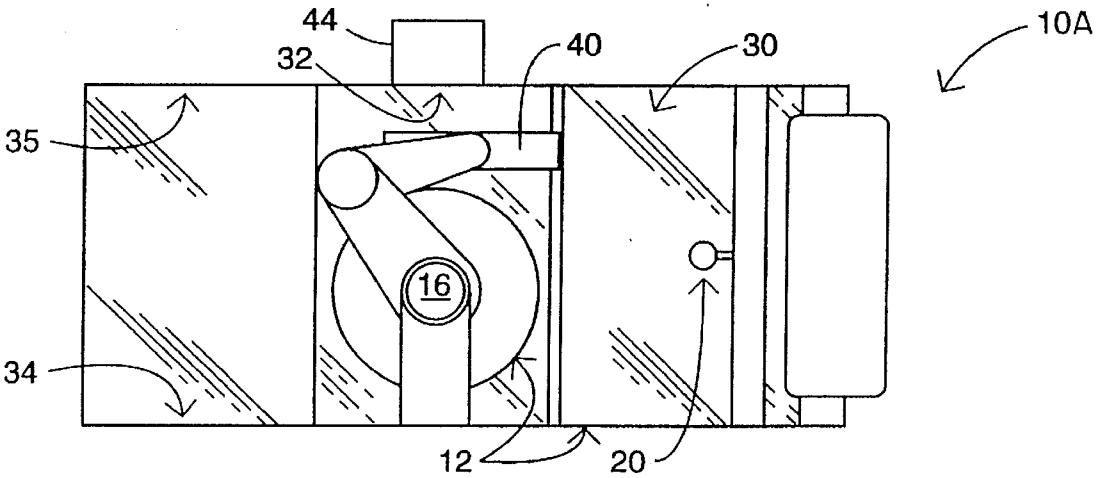
FIGS. 11A–11E are a sequence of schematic views showing a garment assembling cycle.
Figure 11B:
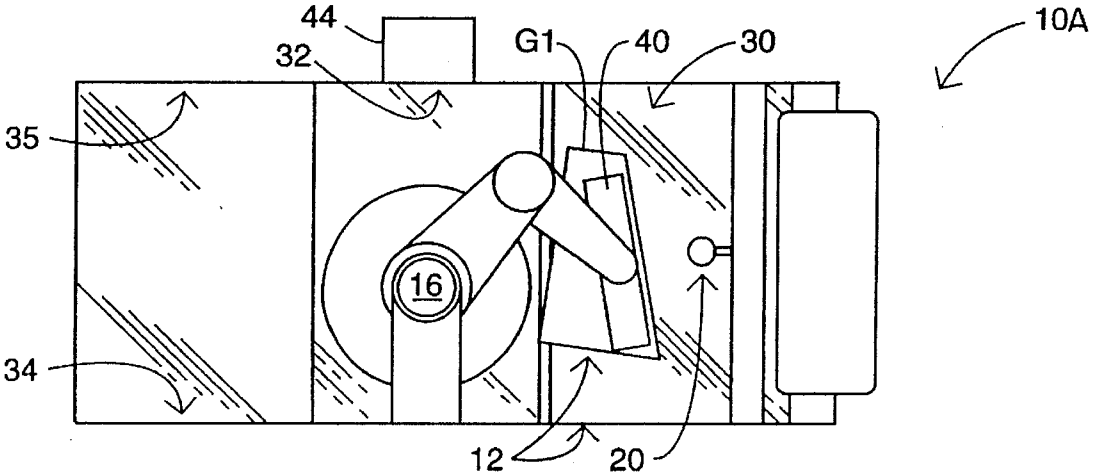
Figure 11C:
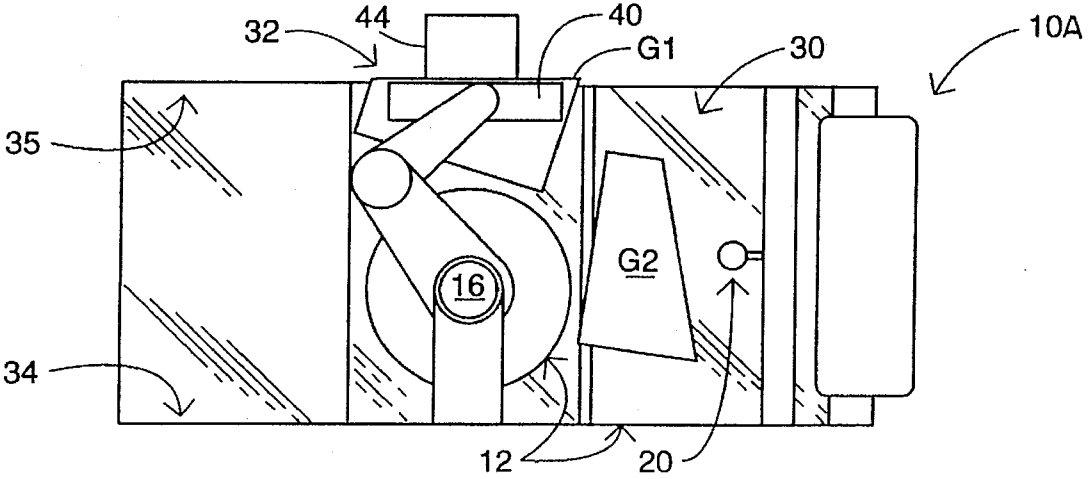
Figure 11E:
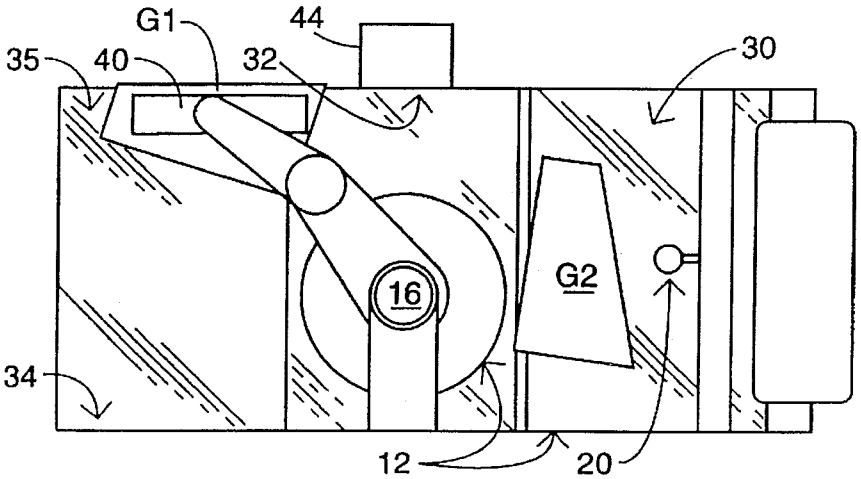

If the garment piece passes inspection, vision system 20 makes further calculations of the garment piece as previously discussed. Upon completion the inspection, camera 52 is turned off. The robot 16 then moves from a home position to the loading station 30 and engages the garment piece G1, as shown in FIG. 11B. The garment piece is then slidably moved from the loading station 30 to the sewing station 32, as shown in FIG. 11C, where the garment piece is sewn generally along the sewing edge of the garment piece. After the garment piece is sewn, a sewn signal is generated and camera 52 is turned on again.

As shown in FIG. 11C, another garment piece G2 is loaded at the loading station 30 as soon as robot 16 has moved garment piece G1 to the sewing station 32. Vision system 20 inspects the second loaded garment piece and generates a loaded signal for garment piece G2. As will be discussed below, the loaded signal for garment piece G2 controls the positioning of the robot 16 after garment piece G1 has been transferred from the transfer station 34.

Figure 11D:
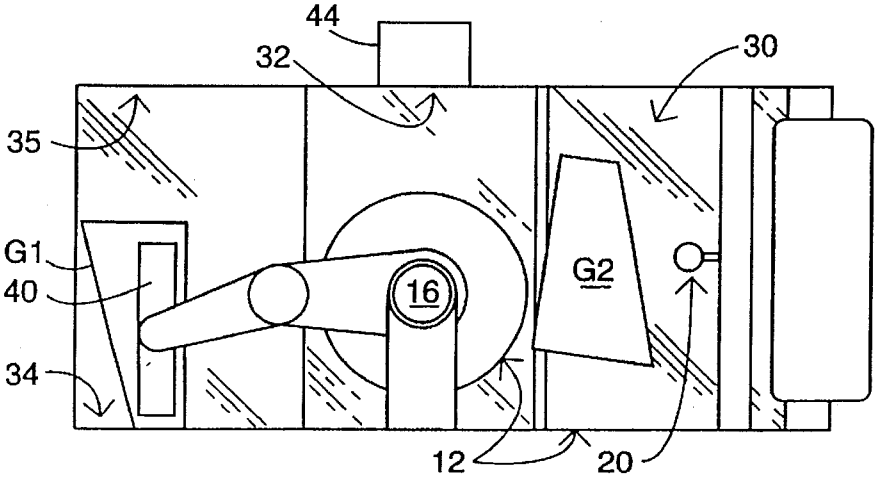

After sewing garment piece G1 at the sewing station 32, the robot presser foot 40 and garment piece G1 remain at the sewing station until a garment piece transfer signal is received. The garment piece transfer signal indicates that there is not another garment piece at transfer station 34. Once the garment piece transfer signal is received, the robot presser foot 40 moves garment piece G1 to the transfer station 34, as shown in FIG. 11D, where the cuff edge is properly positioned for a cuff to be attached to garment piece G1.

After the garment piece G1 has been transferred from transfer station 34, robot 16 determines if a loaded signal has been generated for garment G2. If a loaded signal has been generated, the robot 16 moves directly from the transfer station 34 to the loading station 30 and engages the loaded garment piece. The positioning and assembling of the engaged garment piece is then performed as previously discussed. If the a garment piece loaded signal is not detected, the robot 16 moves to the home position and awaits for the loading of another garment piece. Directly positioning the robot from the transfer station 34 to the loading station 30 when a garment piece loaded signal is generated improves the efficiency of the positioning and assembling process.

Garment piece positioner and seamer 10A provides an efficient device and method for positioning and assembling garment pieces. Garment piece positioner and seamer provides for precise positioning at various work stations of randomly loaded garment pieces.

CUFF MAKING APPARATUS

Figure 12:
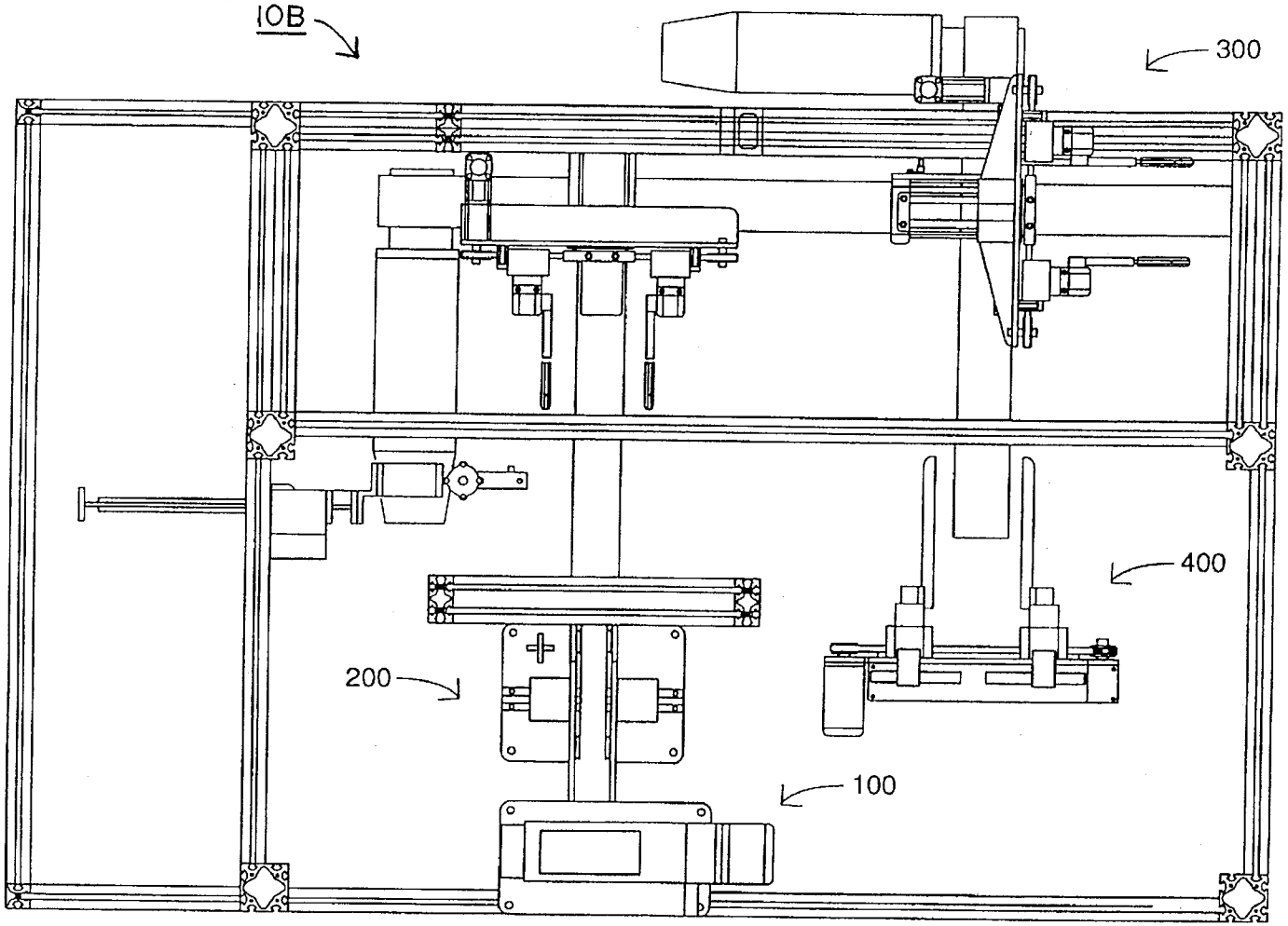
FIG. 12 is a top plan view of a cuff making apparatus constructed according to the present invention.

As best seen in FIG. 12, a cuff making apparatus, generally designated 10B, is shown constructed according to the present invention.

The cuff making apparatus 10B is designed to manufacture cuffs from a continuous supply of tubular material. The tubular material is first fed through a cutting apparatus which severs the tubular material to form a circular band. The circular band is then folded upon itself to form a double layer cuff which can be sewn to the sleeve of a garment. The apparatus of the present invention could also be used to manufacture waist bands, collars and other components of garments in which a circular band is folded upon itself.

As shown in FIG. 12, apparatus 10B includes a feed assembly 100 for feeding the cuff material into the apparatus, a cutter assembly 200 for severing the tubular cuff material to form circular bands, a holding fixture 300 for holding the circular bands after they have been severed from the tubular cuff material, and a cuff folder assembly 400 for folding the circular bands to form the double-layered cuff. Once the cuff has been manufactured in accordance with the present invention, the cuff can be inserted and sewn into the sleeve of a garment, such as a sweat shirt.

FEED ASSEMBLY

Figure 16:
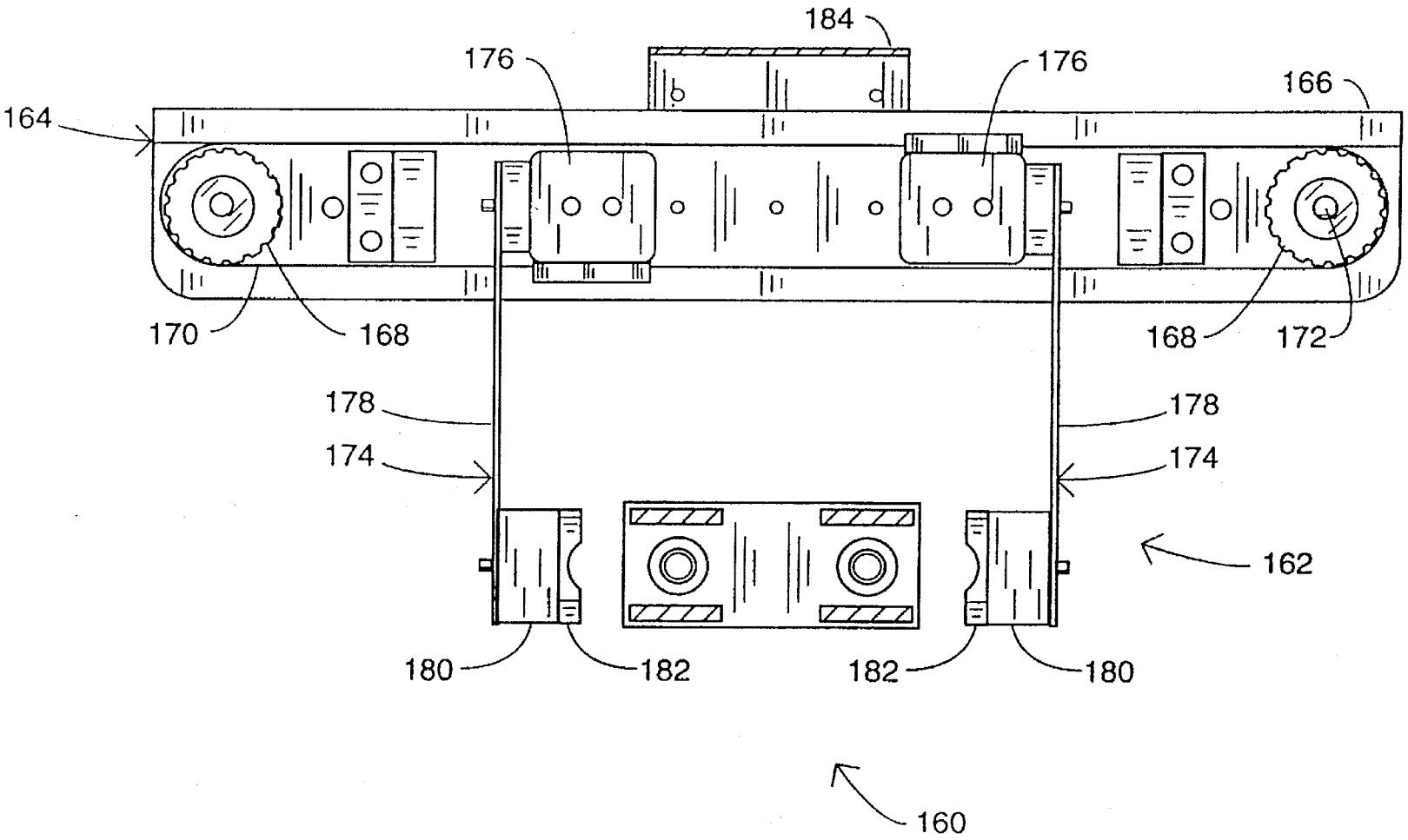
FIG. 16 is a front elevation view of the cuff puller assembly.
Figure 17:
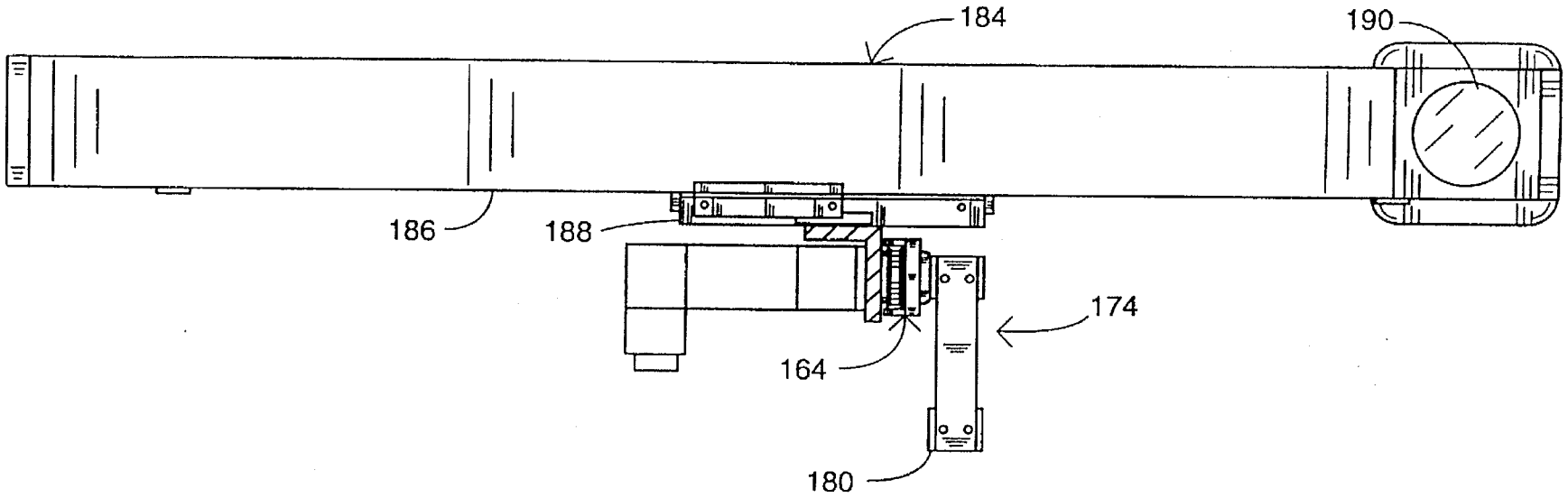
FIG. 17 is a side elevation view of the cuff puller assembly.

The feed assembly 100 feeds a continuous supply of tubular cuff material into cuff making apparatus 10. The cuff material feed assembly 100 includes three sub-assemblies—a feed roller assembly 102 (FIGS. 13 and 14), a tube opener assembly 130 (FIGS. 14 and 15), and a cuff puller assembly 160 (FIGS. 16 and 17). The feed roller assembly 102 feeds the cuff material while the cuff puller assembly 160 pulls the cuff material through the tube opener assembly. The tube opener assembly 130 opens the tube as it is being advanced. Each of the sub-assemblies is described in turn below.

Figure 13:
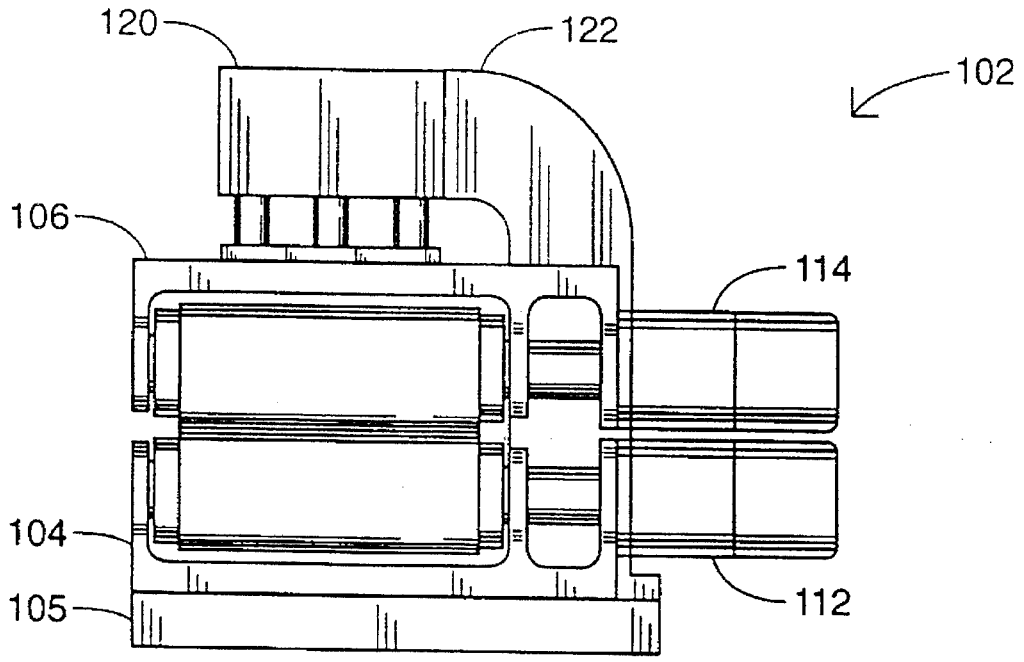
FIG. 13 is a front elevation view of the feed roller assembly.
Figure 14:
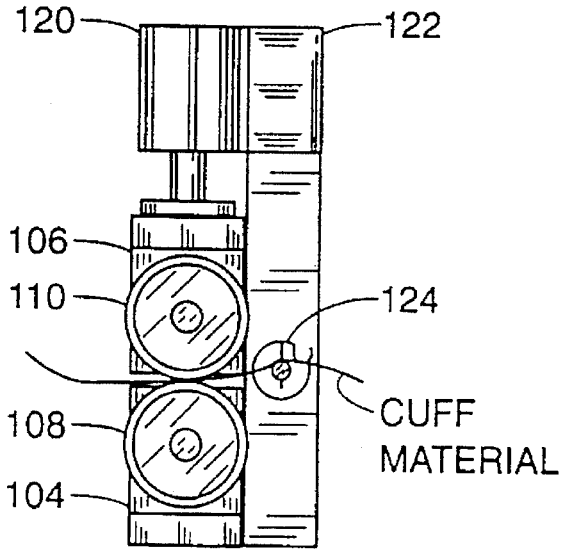
FIGS. 14A–14B are partial side elevation views of the feed roller assembly and tube opener assembly.

The feed roller assembly 102, shown in FIGS. 13 and 14, includes a pair of counter-rotating feed rollers 108 and 110. The lower feed roller 108 is mounted in a roller bracket 104 which is fixedly secured to a support surface 105. The upper feed roller 110 is mounted for rotation in a roller bracket 106 which is movable in a vertical direction. Roller bracket 106 is connected to a cylinder 120 which is supported by a frame member 122. Cylinder 120 functions to raise and lower the upper roller 110 into and out of engagement with the lower roller 108.

Each of the rollers 108, 110 includes a separate drive motor 112, 114 respectively. The drive motors 112 and 114 are preferably stepper motors which rotate a predetermined amount each time the motor is actuated to feed a predetermined amount of tubular cuff material.

An edge guide 124 is disposed adjacent to the nip between the rollers 108 and 110. The purpose of the edge guide 124 is to keep the cuff material aligned as it is fed into the cuff making apparatus 10.

The cuff material is fed by the feed roller assembly through a tube opener assembly 130. Normally, the cuff material is fed in a flattened condition. The function of the tube opener assembly 130 is to spread open the tubular cuff material.

Figure 14B:
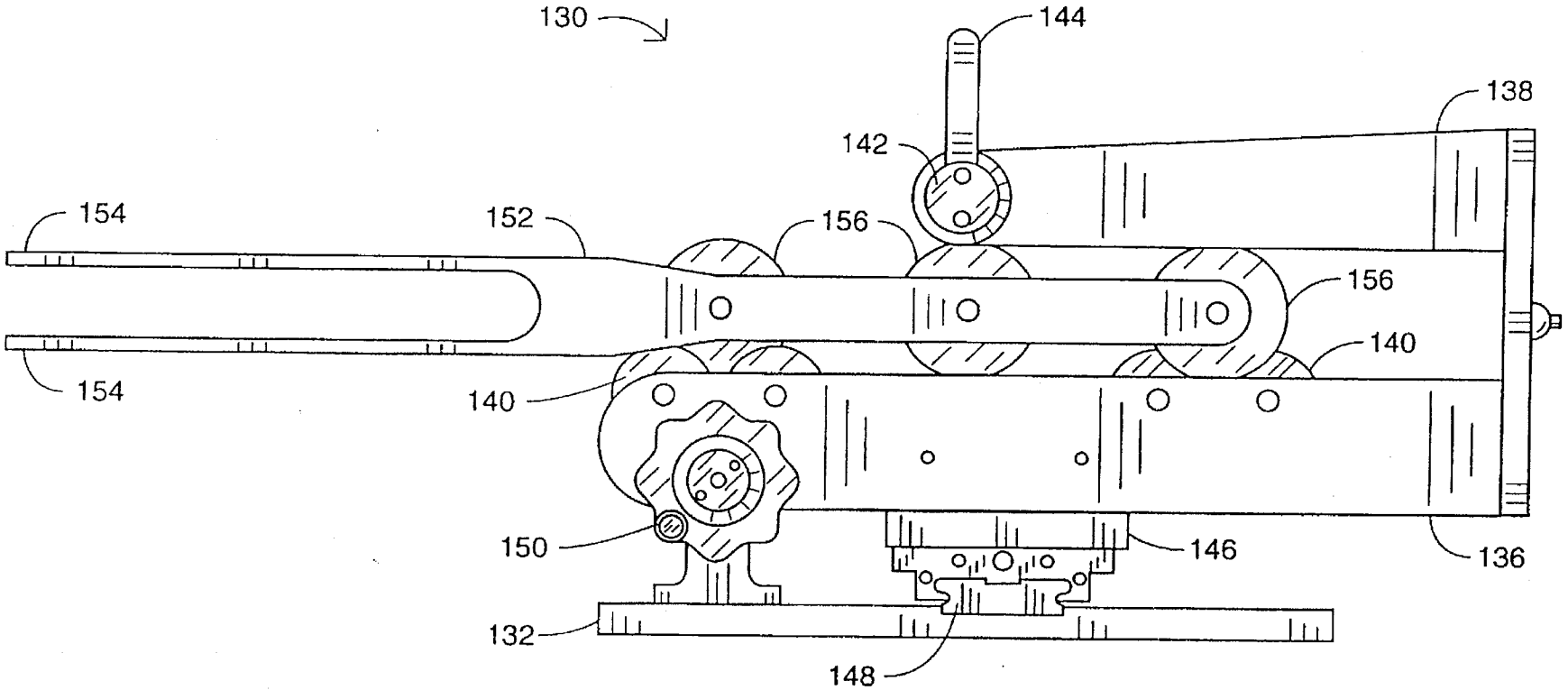
Figure 15:
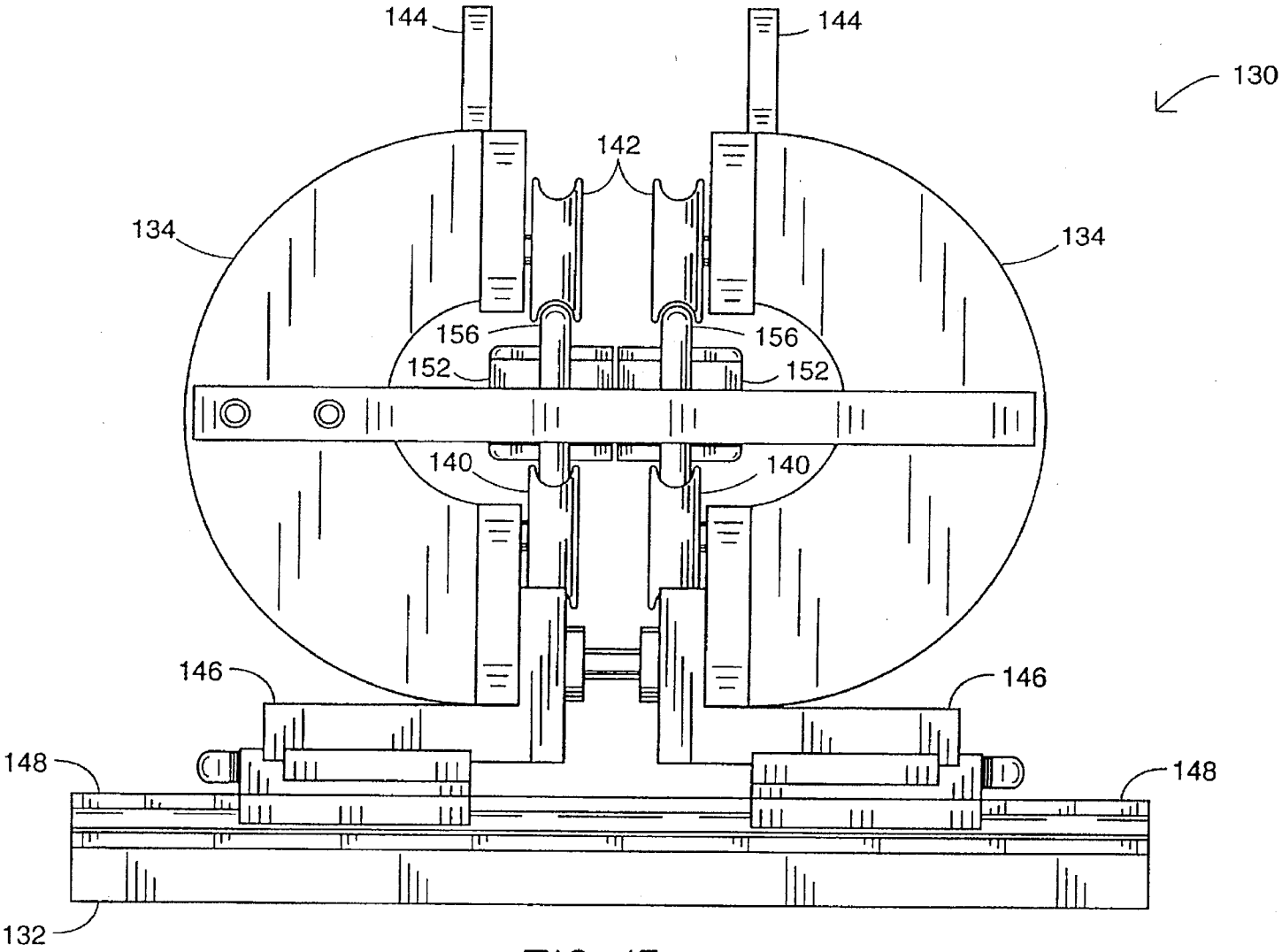
FIG. 15 is a front elevation view of the tube opener assembly.

The tube opener assembly 130, shown in FIGS. 14B and 15, comprises a support frame indicated generally at 132, and a pair of tube opening forks 152. The support frame 132 includes a pair of C-shaped brackets 134 which are mounted on carriages 146. Each carriage 146 is mounted for sliding movement on a track 148. A crank 150 is turned to move the carriages 146 on the track 148. The carriages 146 move in opposite directions from one another. Thus, when the crank 150 is turned in a first direction, the carriages 146 will move closer to one another. When the crank 150 is turned in a second direction, the carriages 146 move away from one another. The movable carriages 146 allow for adjustment depending upon the size of the cuff material being fed.

Referring back to the support frame 132, a pair of support arms 136,138 are fixedly secured to the C-shaped brackets 134 and extend forwardly therefrom in the direction of feed of the tubular cuff material. The lower support arm 136 includes two pairs of idler pulleys 140. The upper support arm 138 includes a retaining pulley 142 which is eccentrically mounted. A locking lever 144 is attached to the retaining pulley 142.

The tube opening forks 152 are mounted in parallel, spaced relationship in the support frame 132. Each tube opening fork 152 includes a pair of vertically spaced tines 154. Each fork 152 includes three support rollers 156 which are rotatably mounted to the back end of the fork 152. The back end of each fork 152 is inserted into the support frame 132 so that the outer support rollers 156 rest on respective pairs of idler pulleys 140. The center pulley 156 is engaged by the retaining pulley 142 to secure the fork 152 within the support frame 132. The retaining pulley 142 is engaged with the center roller 156 by moving the locking lever 142 from a release position to a clamping position.

The tube opener assembly 130 is positioned in front of the feed roller assembly 102. The flattened tubular cuff material is fed between the C-shaped brackets 134 and over the opening forks 152. Normally, the forks 152 are inserted into the end of the tubular cuff material before the forks 152 are clamped in the support frame 132. As the cuff material is fed over the tube opening forks 152, the tines 154 of the forks 152 spread the tubular material and hold the tubular cuff material in a open configuration. In this configuration, the holding fixture 300 can be inserted into the cuff material as will be described in greater detail below.

The puller assembly 160, shown in FIGS. 16 and 17, includes a gripper assembly 162 which is movably mounted on a linear slide 184. The gripper assembly 162 grips the tubular cuff material on the tube opening forks 152 and then moves in the direction of feed to pull the cuff material.

The gripper assembly 162 includes a pair of grippers 174 and a gripper drive assembly 164. The gripper drive assembly 164 includes a support frame 166. A pair of belt pulleys 168 are rotatably mounted to the support frame 166. A drive belt 170 is entrained around the belt pulleys 168. One of the belt pulleys 168 is driven by a belt motor 172. The belt motor 172 is preferably a servo-motor controlled by a programmable controller.

Each of the grippers 174 includes a clamping block 176 for clamping the gripper 174 onto the drive belt 170. One of the grippers 174 is clamped to the upper run of the drive belt 170, while the opposite gripper 174 is clamped to the lower run. Thus, it will be appreciated that the grippers 174 move in opposite directions to one another with rotation of drive pulley 168.

A resilient gripper arm 178 extends downwardly from the clamping block 176. A block member 180 is mounted at the lower end of each gripper arm 178. The block member 180 includes a recess for receiving rubber gripper pads 182. The gripper pads 182 include a semi-circular recess.

The gripper assembly 162 is mounted on a linear slide 184. The linear slide 184 includes a track 186 which extends in the direction of feed of the tubular cuff material. A slide member 188 is mounted on the track 186 and is actuated by a servo-motor 190. Servo-motor 190 is controlled by a programmable controller.

The puller assembly 160 cooperates with the holding fixture 300 to grip the tubular cuff material disposed on the tubular opener assembly 130 and to pull the cuff material forwardly a predetermined distance. The holding fixture 300 includes a pair of support fingers 312 which are inserted into the tubular cuff material. While the tubular cuff material is disposed on the tube opening forks 152, the holding fixture moves forwardly on its track and inserts the fingers 312 into the tubular cuff material. After the fingers are inserted into the tubular cuff material, the fingers spread apart from one another. The gripper assembly 162 is then actuated to move the grippers 174 inwardly to press the cuff material against the support fingers 312. Once the tubular cuff material is gripped between the fingers 312 of the holding fixture 300 and the grippers 174, both the puller assembly 160 and holding fixture move in the direction of feed of the cuff material to pull the cuff material. After the cuff material is pulled forwardly, the cutter assembly 200 severs the end of the cuff material to form a circular band which is held by the holding fixture.

CUTTER ASSEMBLY

Figure 18:
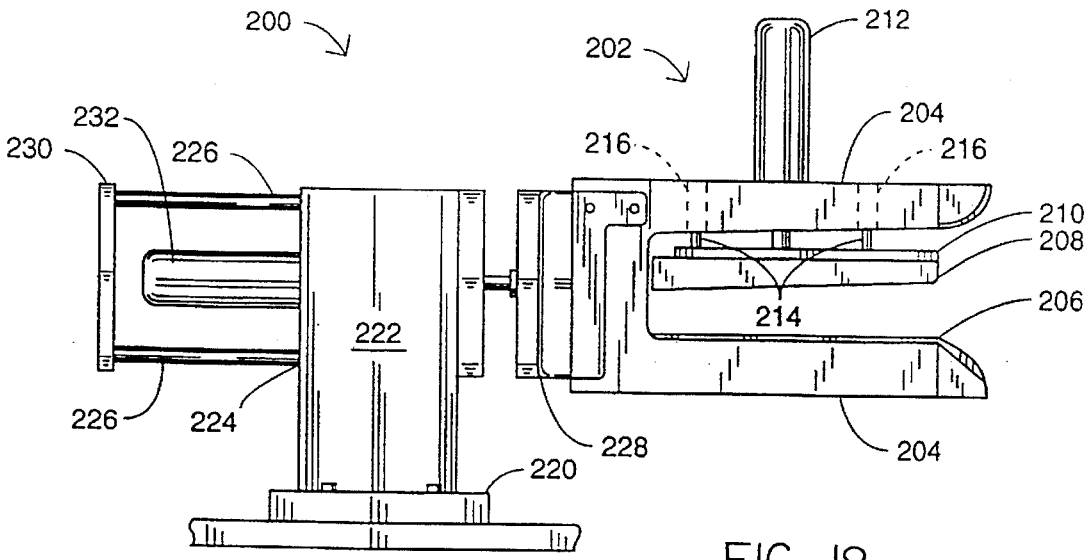
FIG. 18 is a front elevation view of the cutter assembly.

The cutter assembly 200, shown in FIG. 18, comprises a guillotine-type cutter 202 mounted on a support 220. The cutter 202 includes a C-shaped support 204. A stationary blade 206 is fixedly secured to the lower arm of the support 204. A movable blade 208 is mounted to the upper arm of the support 204. The stationary blade 206 and movable blade 208 function like a shear to sever the tubular cuff material.

The movable blade 208 is mounted to a blade carrier 210. The blade carrier 210 is connected to a cylinder 212 for moving the blade carrier 210 vertically. The cylinder 212 is mounted on the upper arm of the C-arm 204. A pair of guide posts 214 extend upwardly from the blade carrier 210 and pass through guide openings 216 in the upper arm of the support 204. The guide posts 214 function to keep the movable blade properly aligned with the stationary blade 206.

As discussed above, the cutter 202 is mounted to the support 220. The carrier 220 includes a support block 222 which is mounted to a support surface. Guide holes 224 are formed in the support block 222. A pair of guide rods 226 extend through the guide holes 224 in the support block 222. A support bracket 228 is mounted at one end of the guide rods 226. The support bracket 228 is connected to and supports the cutter 202. An end plate 230 is connected to the opposite end of the guide rods 226. The end plate 230 functions as a stop when the cutter 202 is moved forwardly.

The cutter 202 is moved forwardly and backwardly by a cylinder 232. Cylinder 232 is mounted to the support block 202 and is connected to the support bracket 228. When the cylinder 232 is extended, the cutter 202 is moved forwardly into position to sever the tubular cuff material. After severing the tubular cuff material, the cutter 202 is moved back to a retracted position by cylinder 232. When the cuff material is severed, a circular band is formed.

HOLDING FIXTURE

Figure 19:
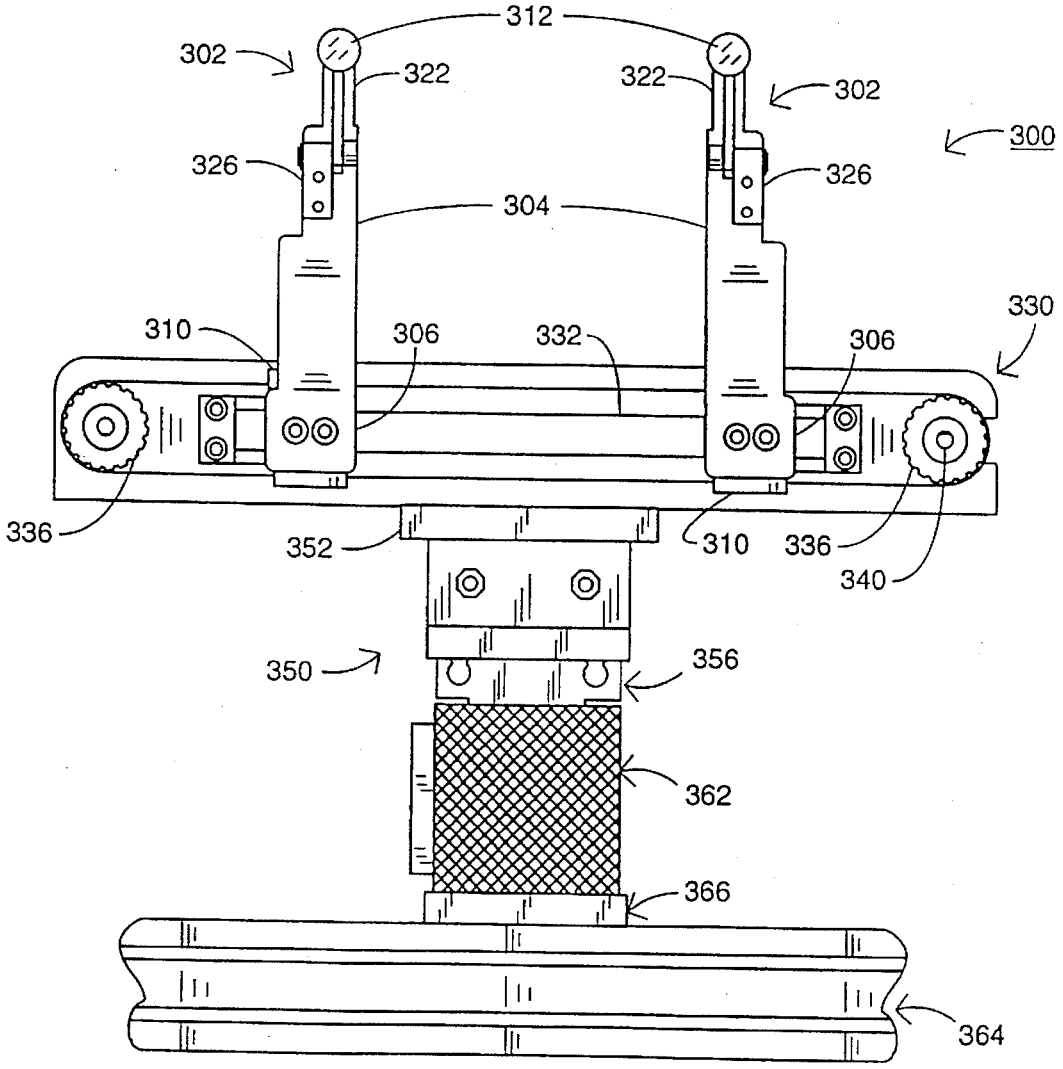
FIG. 19 is a front elevation view of the holding fixture.
Figure 20:
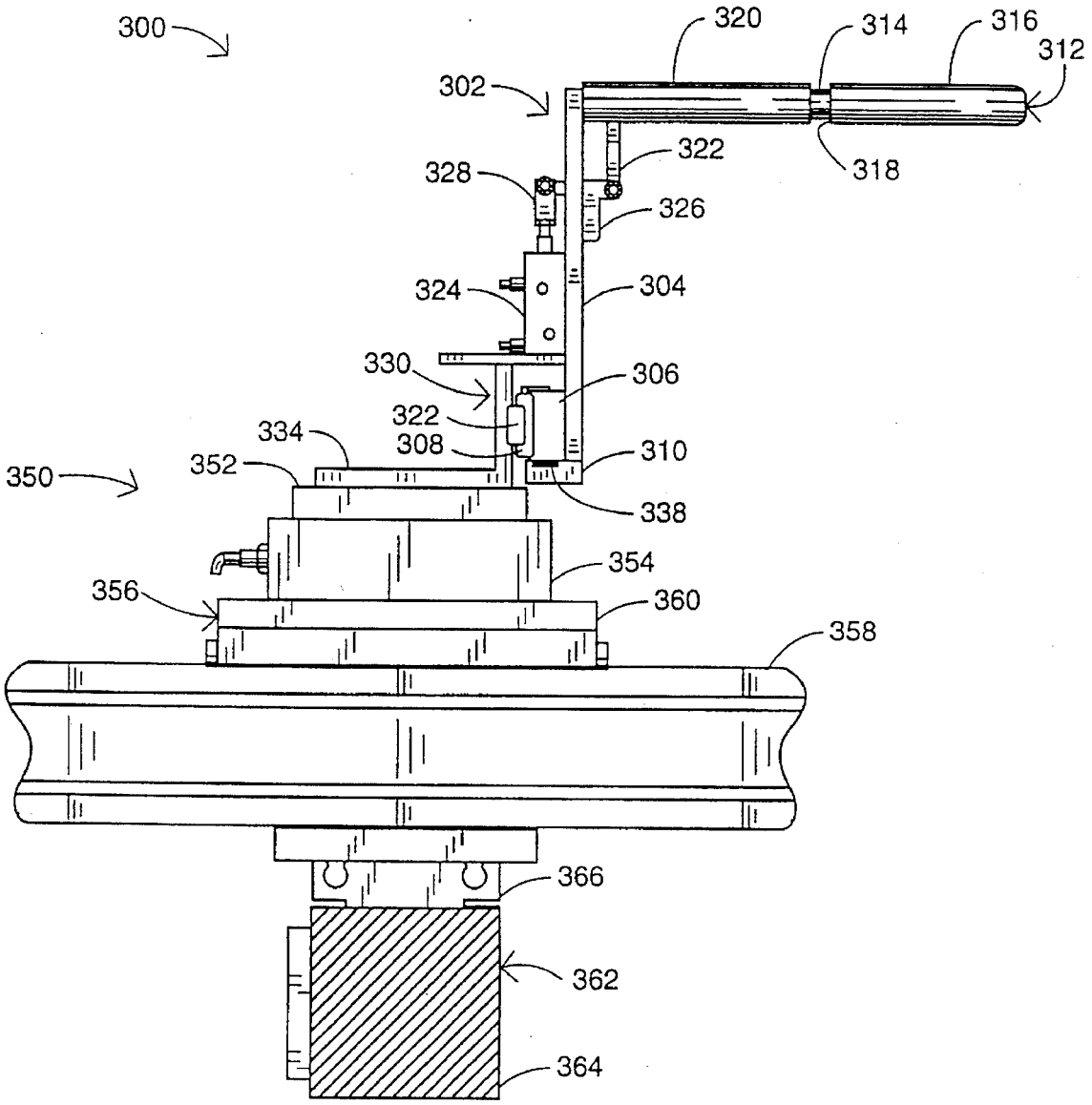
FIG. 20 is a side elevation view of the holding fixture.

The holding fixture 300, shown in FIGS. 19 and 20, receives and holds the circular bands severed from the tubular cuff material and transports the circular bands to the cuff folder assembly. The holding fixture 300 includes a pair of band holders 302 which are movable relative to one another by a band holder drive assembly 330. The band holder drive assembly 330 is, in turn, mounted on a positioner 350 which is used to position the holding fixture 300.

Each band holder 302 includes a support post 304. A clamping block 306 is secured to the lower end of the support post 304. A support finger 312 projects outwardly from the upper end of the support post 304. The support finger 312 includes first and second portions 314 and 316. The second portion 316 has a larger diameter than the first portion 314 so that a shoulder 318 is formed between the first and second portions 314 and 316.

A finger sleeve 320 is slidably mounted on the first portion 314 of the support finger 312. The finger sleeve 300 is movable between a closed position in which one end of the finger sleeve 320 pressed against the shoulder 318, and an open position in which the finger sleeve 320 is spaced from the shoulder 318.

The finger sleeve 320 is movable between the open position and the closed position by a cylinder 324. The cylinder 324 is mounted to the support post 304. Cylinder 324 is connected to a yoke 328. A linkage 322, which is pivotally mounted on a link support 326, connects the finger sleeve 320 to the yoke 328. Thus, the actuation of the cylinder 324 causes the finger sleeve 320 to move back and forth between the open position and the closed position.

The band holder drive assembly 330 moves the band holders 302 relative to one another in a transverse direction. The band holder drive assembly 330 is similar to the gripper drive assembly. A pair of spaced-apart belt pulleys 336 are rotatably mounted to a frame member 334. A drive belt 338 is entrained around the belt pulleys 336. One of the belt pulleys is driven by a belt motor 340. Belt motor 340 is preferably a servo-motor under the control of a programmable controller.

Each of the band holders 302 are clamped to the drive belt 338. The clamping block 306 of the band holder includes a clamping member 310 which compresses the drive belt 338 between the clamping member 310 and clamping block 306. Each of the band holders 302 is clamped to a respective run of the drive belt 338. One of the band holders 302 is clamped to a lower run of the drive belt 338, while the opposite band holder 302 is clamped to the upper run of the drive belt 338. Thus, the band holders 302 move in opposite directions relative to one another. The clamping block 306 includes a guide channel 308 which engages with a track 332 on the frame member 334 to guide the movement of the band holder 302.

The holding fixture 300 is mounted on a positioner 350 which moves the holding fixture 300 in two directions and rotates the holding fixture 300. The positioner 350 includes a turntable 352 which is connected to a rotary actuator 354. The turntable 352 and rotary actuator 354 allow the holding fixture 300 to be rotated.

The turntable 352 and rotary actuator 354 are mounted to a linear slide 356. Linear slide 356 moves the holding fixture 300 in the "y" direction (i.e., perpendicular to the direction of feed of the cuff material). Linear slide 356 includes a track 358 and a slide member 360. The rotary actuator 354 is mounted on the slide member 360.

Linear slide 356 is mounted on a second linear slide 362. Linear slide 362 allows the holding fixture 300 to be moved in the "x" direction (forwardly and backwardly along the direction of feed of the cuff material). Linear slide 362 includes a track 364 and a slide member 366. Slide member 366 supports the track 358 for the first linear slide 356.

The holding fixture 300 cooperates with the cuff puller assembly 160 to pull the cuff material forwardly so that it can be severed by the cutter assembly 200. When the tubular cuff material is pulled forwardly, it will be slightly stretched. While the cuff material is being pulled, the finger sleeve 320 is normally in an open position so that the cuff material forms a cup in the space between the end of the finger sleeve 320 and the shoulder 318. After the cuff material is pulled out, the finger sleeve 320 is moved to a closed position. When the finger sleeve 320 is moved to the closed position, a portion of the cuff material is pinched between the finger sleeve 320 and the shoulder 318. The cutter assembly 320 then severs the cuff material to form a circular band. The finger sleeve 320 remains in a closed position while the holding fixture 300 is moved to the cuff folder assembly 400. The circular band is pinched approximately mid-way between the ends of the band.

CUFF FOLDER ASSEMBLY

Figure 21:
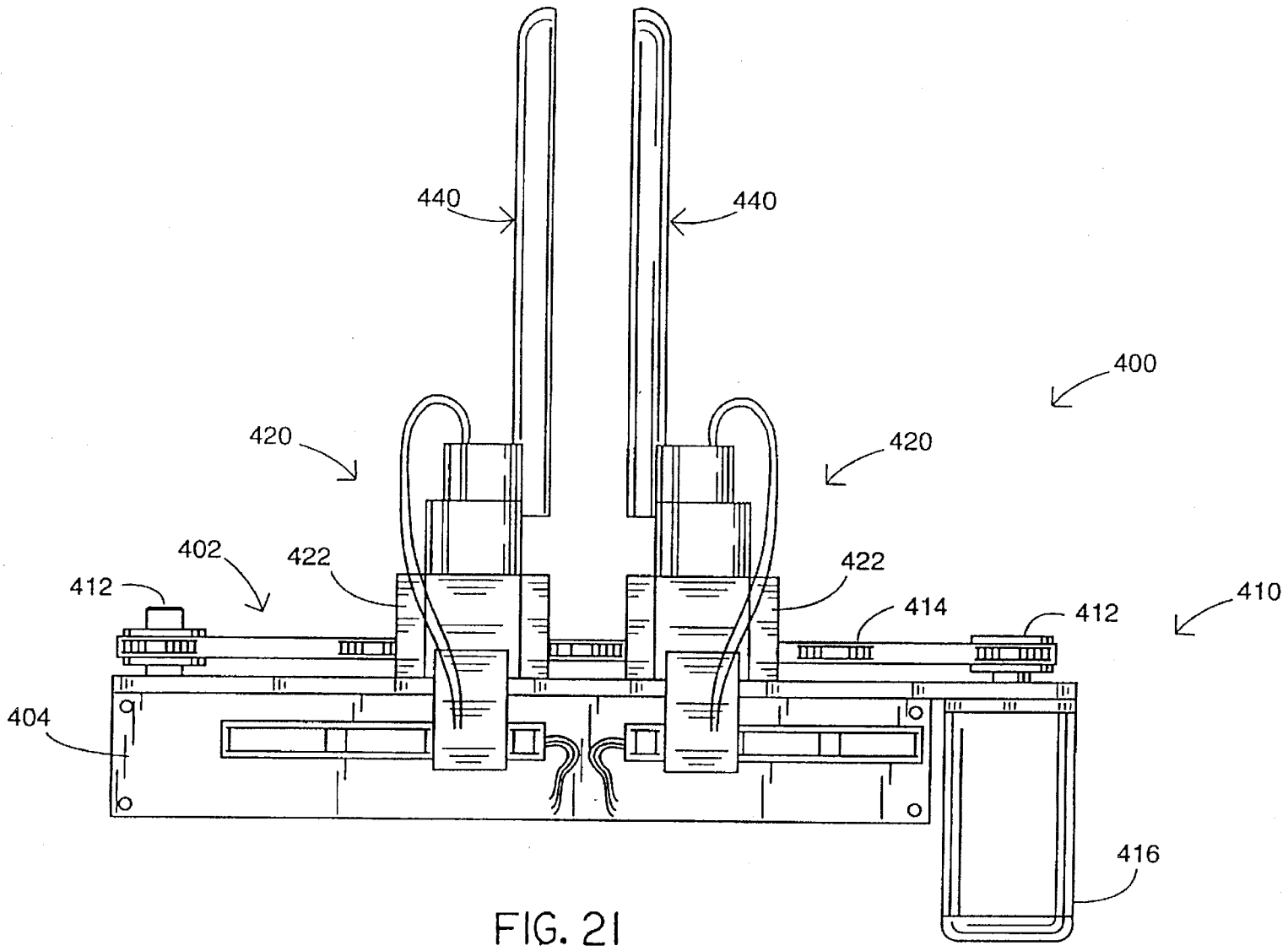
FIG. 21 is a top plan view of the cuff folder assembly.
Figure 22:
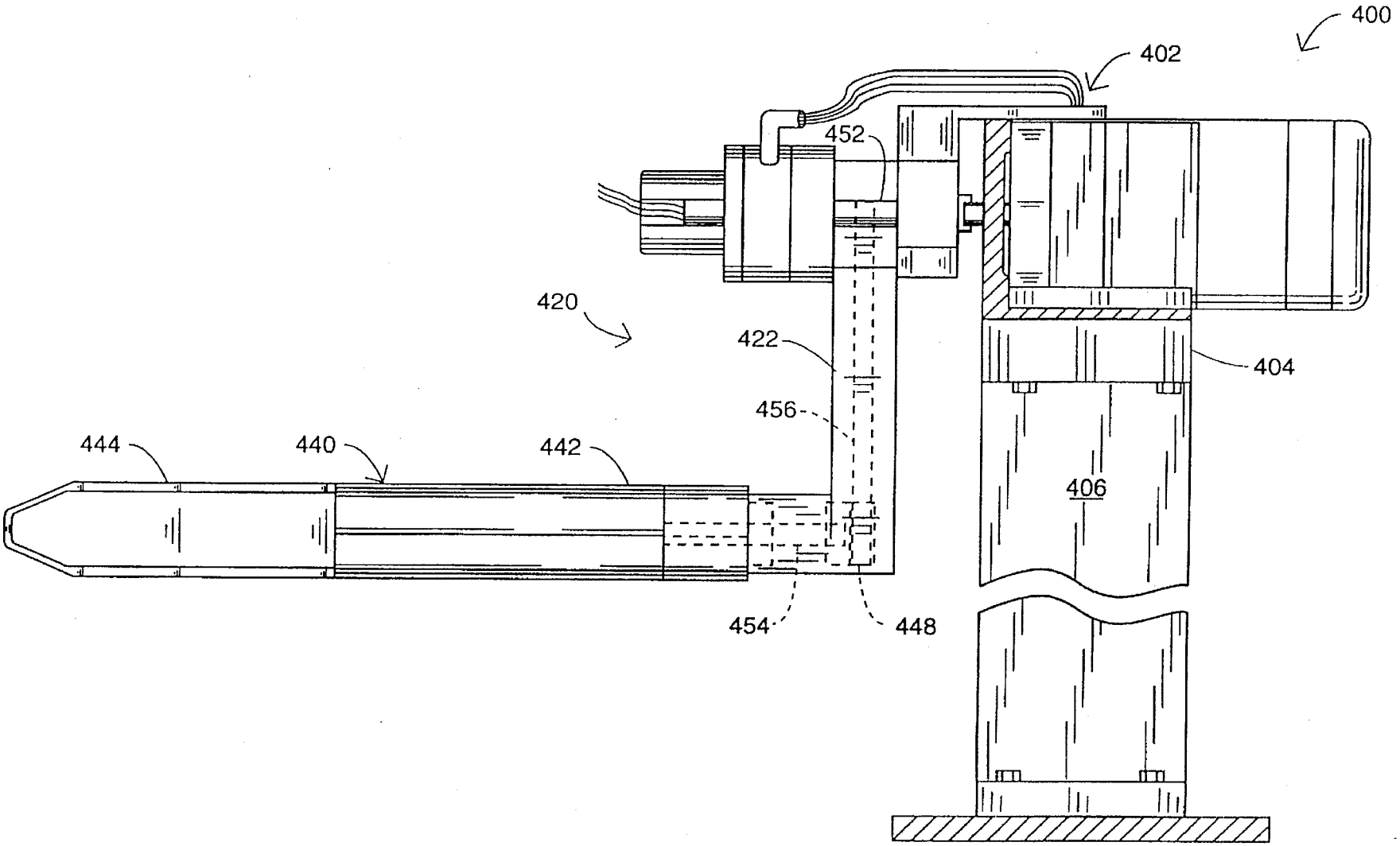
FIG. 22 is a side elevation view of the cuff folder assembly.

The cuff folder assembly 400, shown in FIGS. 21 and 22, includes a pair of cuff folders 420 and a cuff folder drive assembly 402 for adjusting the distance between the cuff folders 420 depending upon the size of the cuff being made.

The cuff folder drive assembly 402 includes a frame member 404 which is supported on support posts 406. A pair of belt pulleys 412 are rotatably mounted on opposite ends of the frame 404. A drive belt 414 is entrained around the belt pulleys 412. One of the belt pulleys 412 is driven by a belt motor 416. Belt motor 416 is preferably a stepper motor under the control of a programmable controller.

The cuff folders 420 are secured to respective runs of the drive belt 414. One of the cuff folders 420 is mounted to an upper run of the drive belt 414, while the other cuff folder 420 is secured to the lower run of the drive belt 414. Thus, the cuff folders 420 will move in opposite directions relative to one another.

Each of the cuff folders 420 includes a support arm 422. A clamping block 424 is secured to each support arm 422. Each clamping block 424 includes a clamping member 426 which compresses the drive belt 414 between the clamping block 424 and clamping member 426.

A guide block is secured to each clamping block 422. The guide block includes a channel which engages with a track on the frame member 404. The guide block and track prevent the support arm 422 from twisting.

The support arm 422 supports a rotating finger 440. The rotating finger 440 includes a tubular rear section 442 and a forward section 444. The forward section 444 is formed by removing half of the tube. A pair of diametrically opposed slots are formed in the rear section 442 so that the rear section 442 functions like a clamp. Screws are tightened to clamp the tubular rear section 442 onto a drive shaft 454. The drive shaft 454 is connected by a belt 456 to a rotary actuator 452. The motor 452 is preferably an air motor. When the motor 452 is actuated, the fingers 440 are rotated 180°. In use, the folder assembly 400 folds the circular band held by the holding fixture 300 to form a double layer cuff. To fold the circular band, the holding fixture 300 moves along track 358 until it is aligned with the cuff folder assembly 400. The spacing between the rotating fingers 440 is adjusted to be equal to the spacing between the support fingers 312. The rotating fingers 440 of the cuff folder assembly 400 are inserted into the cuff by moving the holding fixture 300 forwardly. The forward section 444 of the rotating fingers 440 extends approximately half the distance into the circular bands and encircles the inner side of the support fingers 312. After the rotating fingers 440 are inserted, the rotary actuator 452 is actuated to rotate the fingers 440 to the outside of the support fingers 312. In this position, the forward section 444 of the rotating fingers 440 is interposed between the circular band and the support fingers 312. The holding fixture 300 is then moved forwardly. As the holding fixture 300 moves forwardly, the forward section 444 of the rotating fingers 440 folds one end of the circular band back to double the circular band onto itself. After the circular band is folded upon itself, the holding fixture 300 moves back away from the cuff folder assembly 400.

OPERATION

Figure 23A:
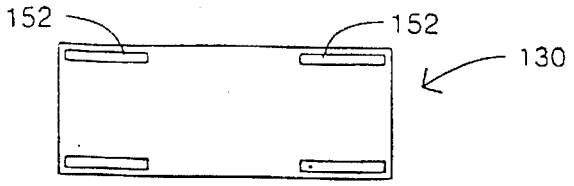
FIGS. 23A–23E are schematic diagrams showing the sequence of operations of the holding fixture and cuff puller assembly during the material feed.
Figure 23B:
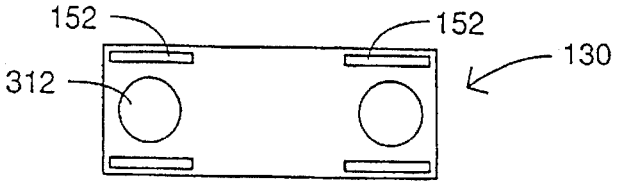
Figure 23C:
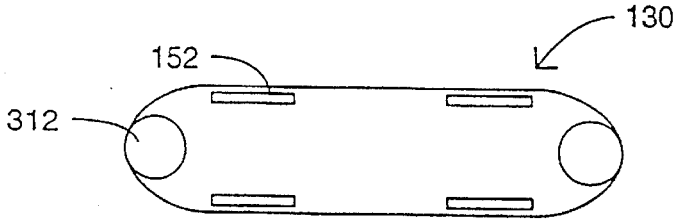
Figure 23D:
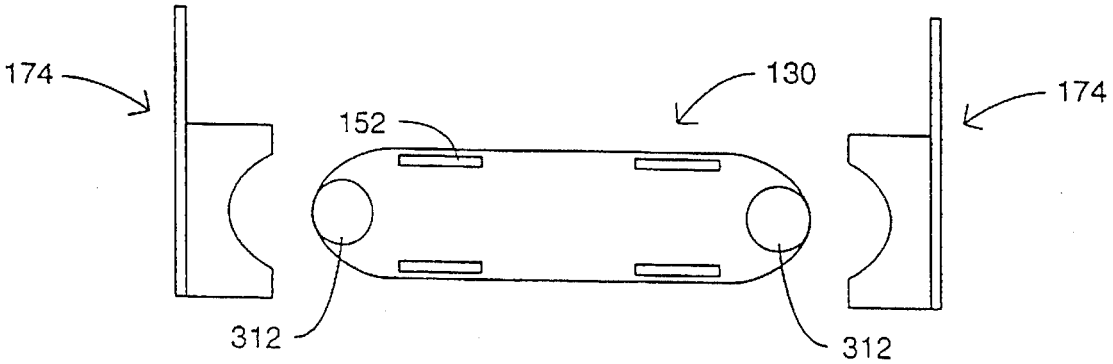
Figure 23E:
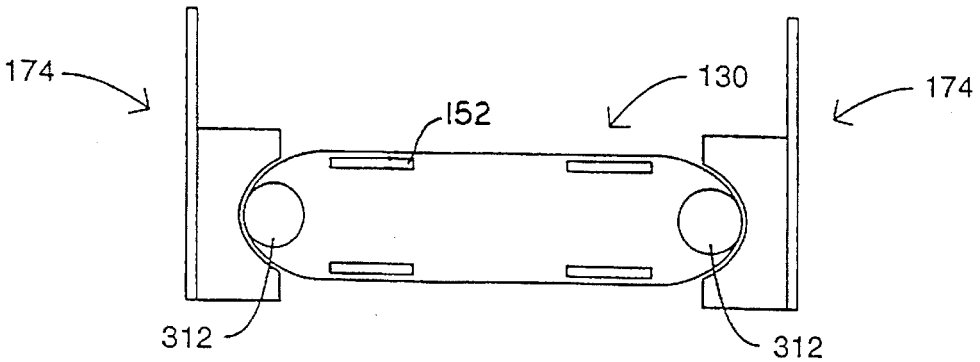

At the beginning of a cycle, the cuff material is disposed around the tube opener assembly 130 as shown in FIG. 23A. The holding fixture 300 is positioned in line with the cuff material feed with the support fingers 312 pointed toward the cuff material feed. The holding fixture 300 moves forwardly to insert the support fingers 312 into the tube opener assembly 130 as shown in FIG. 23B. The support fingers 312 are then spread apart as shown in FIG. 23C to stretch the cuff material laterally. The puller assembly moves forwardly to position the grippers 174 adjacent to the support fingers 312 as shown in FIG. 23D. The grippers 174 are closed to clamp the cuff material against the support fingers 312 as shown in FIG. 23E. The cuff puller assembly 160 and holding fixture 300 then move rearwardly along the direction of the feed to pull the tubular cuff material off the tube opener assembly 130.

Figure 24A:
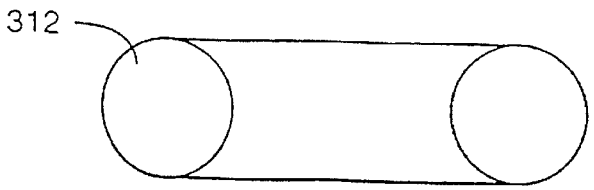
FIGS. 24A–24D are schematic diagrams showing the sequence of operations of the holding fixture and cuff folder assembly during the cuff folding operation.
Figure 24B:
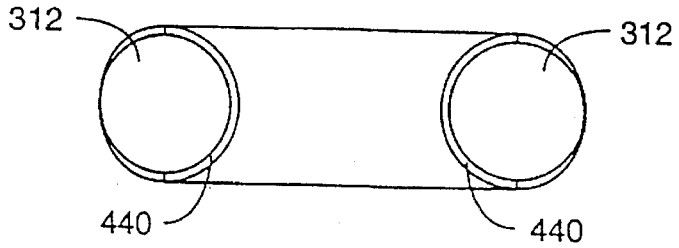
Figure 24C:
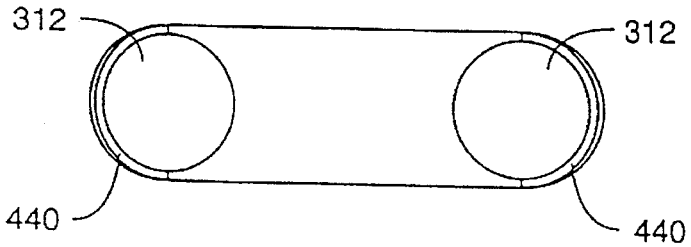
Figure 24D:
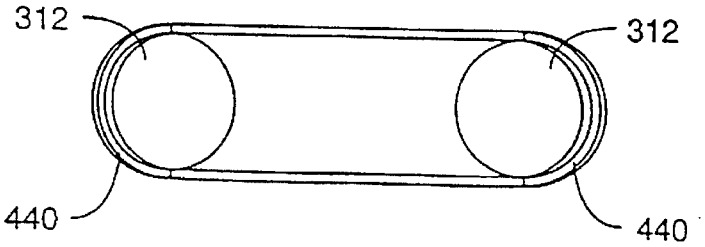

When the cuff material is pulled by the cuff puller assembly 160, a slight tension is placed on the cuff material. The tension on the cuff material causes the cuff material to form a cup and a space between the end of the finger sleeve 320 and the shoulder 318 of the support fingers 312. The finger sleeve 320 is moved to a closed position to pinch the cuff material. The cutter assembly 200 then is extended and the cutter cylinder is actuated to sever the cuff material to form a circular band. The circular band is held by the holding fixture which then moves to a position in line with the cuff folder assembly 400. The cuff material is supported by the support fingers 312 as shown in FIG. 24A. The holding fixture 300 is then moved forwardly by actuating linear slide 356. As the holding fixture 300 moves forwardly, the rotating fingers 440 are inserted into the cuff. The holding fixture 300 continues to be moved forwardly until the rotating fingers extend approximately half the distance into the circular band. The rotating fingers 440 are positioned so that the forward section 444 encircles the inner half of the support fingers 312 (see FIG. 24B). The rotating fingers 440 are then rotated 180° to the outside of the support fingers, as shown in FIG. 24C, to lift the front end of the cuff material off the support fingers 312. The holding fixture 300 is then again actuated to move forwardly towards the cuff folder assembly 400. As the holding fixture moves forwardly, the rotating fingers 440 fold the front end of the cuff material back over the back end of the cuff material to double the circular band onto itself. After the circular band is folded upon itself, the holding fixture 300 moves back away from the cuff folder assembly. Once the cuff has been made, it can be inserted and sewn into the sleeve of the garment either manually or as part of an automatic system.

CUFF INSERTING APPARATUS

Figure 25:
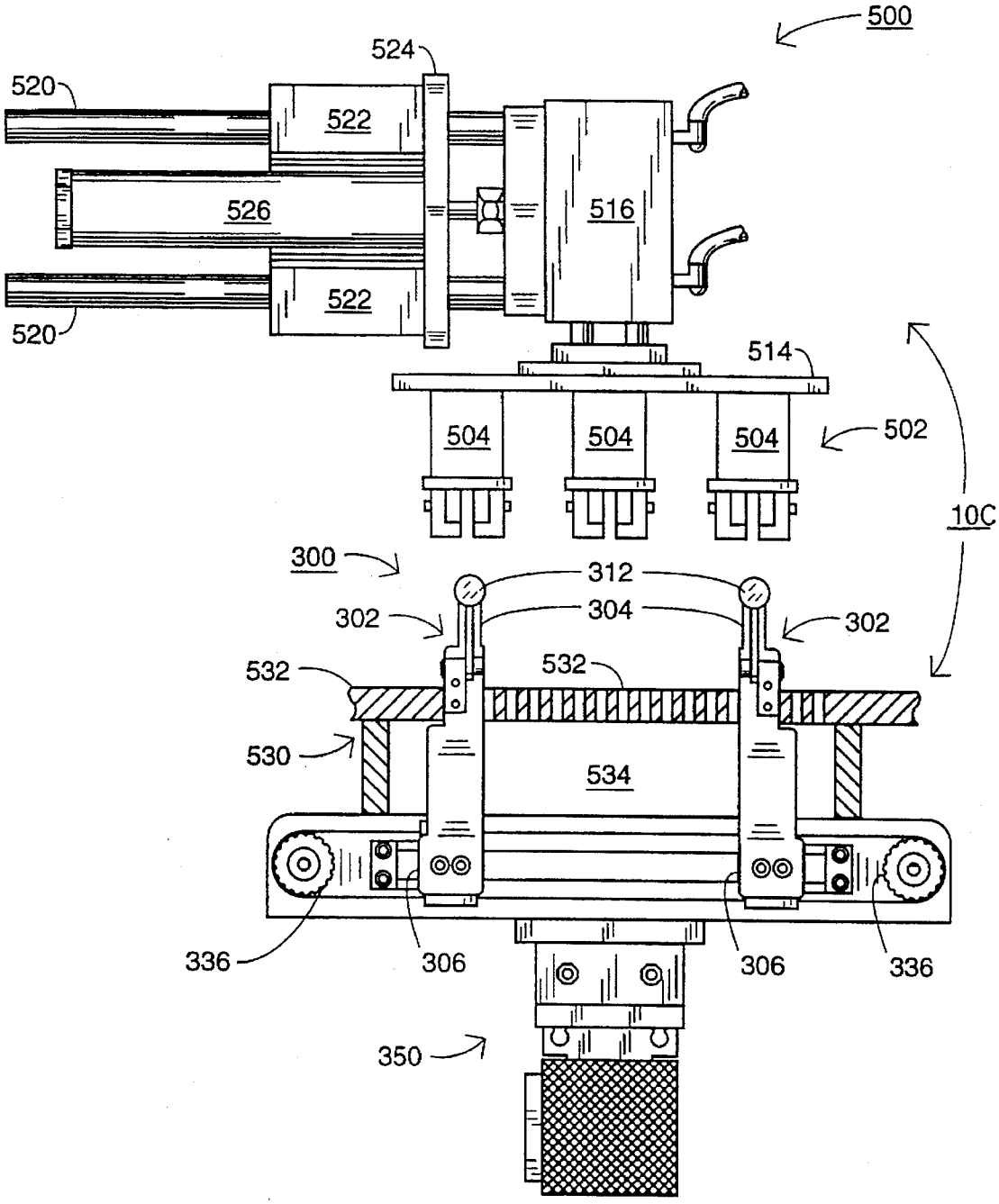
FIG. 25 is a front elevation view of a cuff inserter constructed according to the present invention.

As best seen in FIG. 25, a cuff inserting apparatus, generally designated 10C, is shown constructed according to the present invention.

The cuff inserting apparatus is designed to insert a cuff into the sleeve of a garment so that the cuff can be sewn to the sleeve. The apparatus of the present invention could also be used to insert waistbands and collars into the body of a garment.

The cuff inserting apparatus 10C includes a cuff holding fixture 300 for holding the cuff and a sleeve opener 500 for opening the sleeve of the garment to allow insertion of the cuff into the sleeve. The holding fixture 300 is movably mounted so that when the sleeve of the garment is opened, the holding fixture 300 moves forwardly relative to the sleeve opener 500 to insert the cuff into the sleeve. These sub-systems are described in more detail below.

HOLDING FIXTURE

Figure 26:
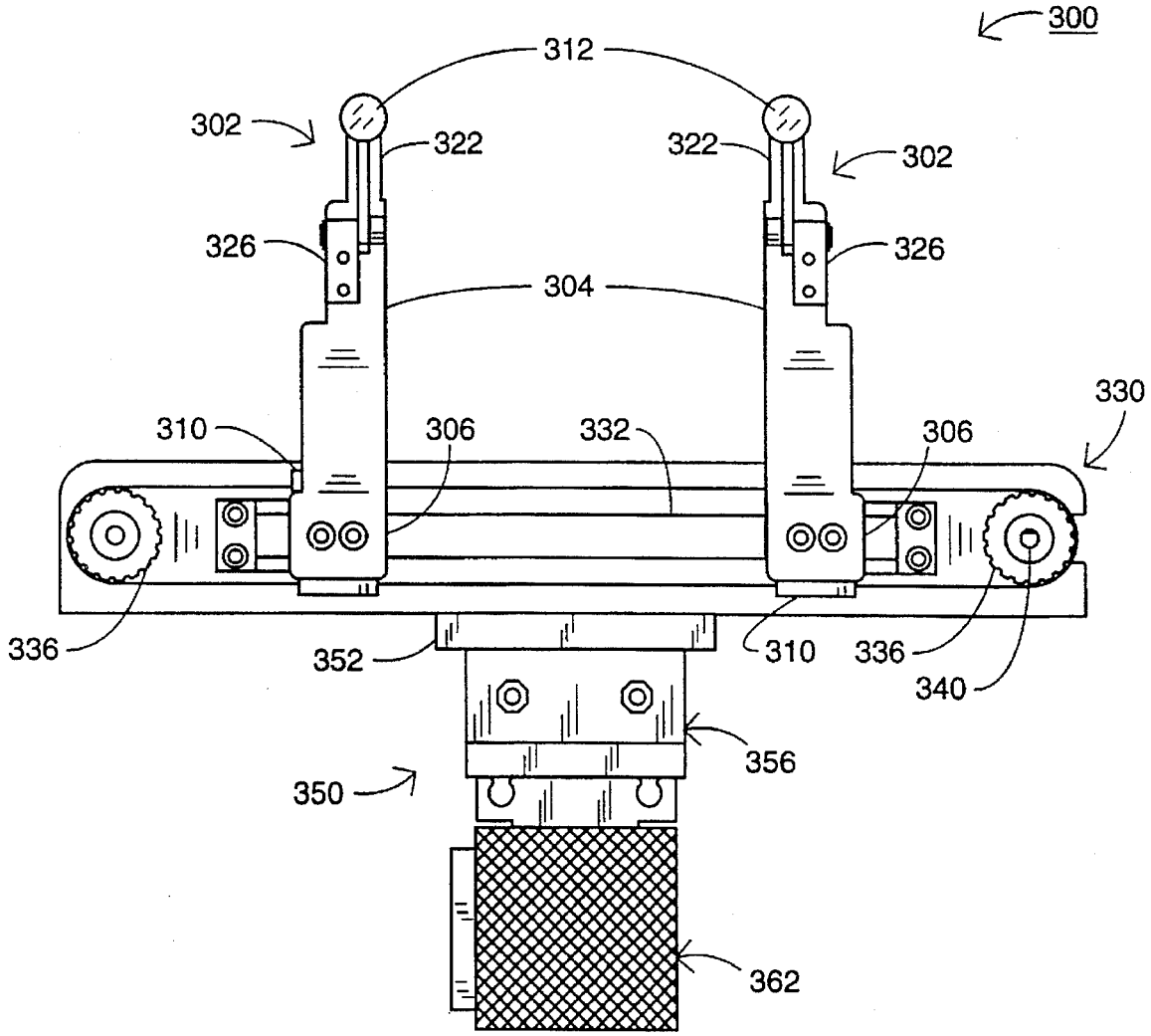
FIG. 26 is a front elevation view of the holding fixture for the cuff inserter.
Figure 27:
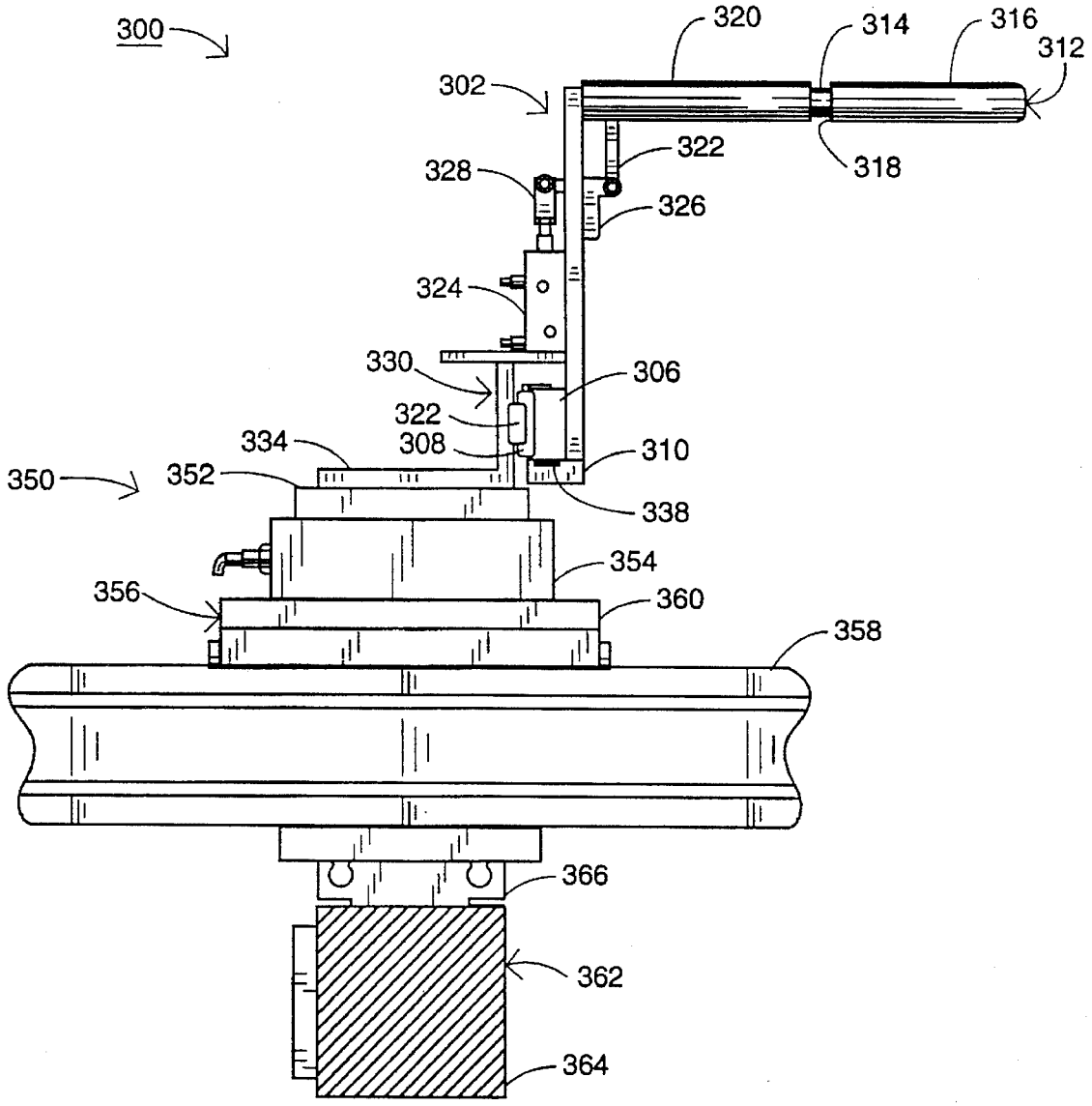
FIG. 27 is a side elevation view of the holding fixture.
Figure 28:
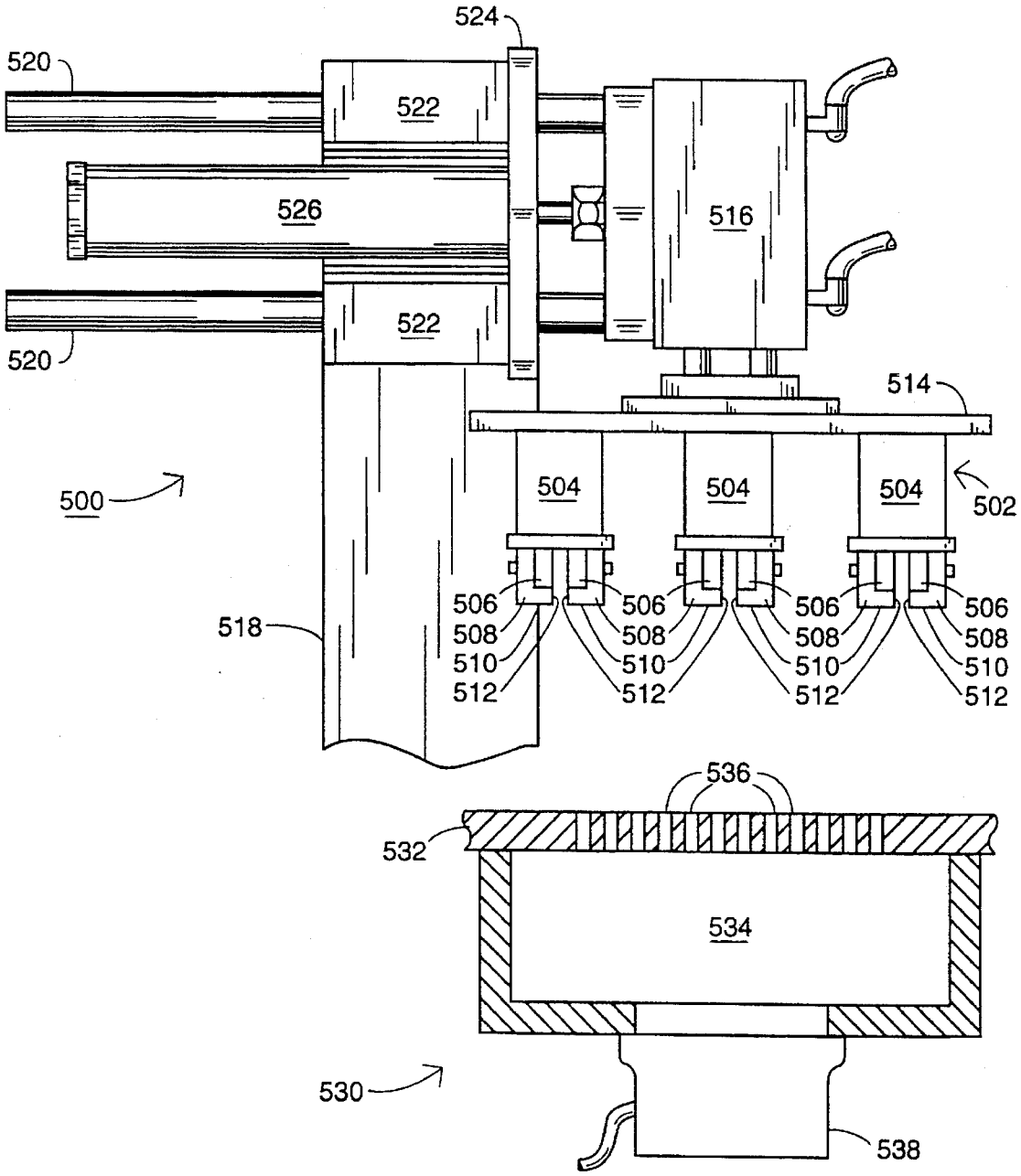
FIG. 28 is a side elevation view of the sleeve opener assembly.

The holding fixture 300, shown in FIGS. 26 and 27, includes a pair of band holders 302 which are movable relative to one another by a band holder drive assembly 330. The band holder drive assembly 330 is, in turn, mounted on a positioner 350 which is used to position the holding fixture 300.

Each band holder 302 includes a support post 304 having a clamping block 306 secured to the lower end thereof. A support finger 312 projects outwardly from the upper end of the support post 304. The support finger 312 includes first and second portions 314 and 316. The second portion 316 has a larger diameter than the first portion 314 so that a shoulder 318 is formed between the first and second portions 314 and 316.

A finger sleeve 320 is slidably mounted on the first portion 314 of the support finger 312. The finger sleeve 300 is movable between a closed position in which one end of the finger sleeve 320 is pressed against the shoulder 318, and an open position in which the finger sleeve 320 is spaced from the shoulder 318.

The finger sleeve 320 is movable between the open position and the closed position by a cylinder 324. The cylinder 324 is mounted to the support post 304. Cylinder 324 is connected to a yoke 328. A linkage 322, which is pivotally mounted on a link support 326, connects the finger sleeve 320 to the yoke 328. Thus, the actuation of the cylinder 324 causes the finger sleeve 320 to move back and forth between the open position and the closed position.

The band holder drive assembly 330 moves the band holders 302 relative to one another in a transverse direction. A pair of spaced-apart belt pulleys 336 are rotatably mounted to a frame member 334. A drive belt 338 is entrained around the belt pulleys 336. One of the belt pulleys 338 is driven by a belt motor 340. Belt motor 340 is preferably a servo-motor under the control of a programmable controller.

Each of the band holders 302 are clamped to the drive belt 338. The clamping block 306 of the band holder 302 includes a clamping member 310 which compresses the drive belt 338 between the clamping member 310 and clamping block 306. The clamping block 306 includes a guide channel 308 which engages with a track 332 on the frame member 334 to guide the movement of the band holder 302. Each of the band holders 302 is clamped to a respective run of the drive belt 338. One of the band holders 302 is clamped to a lower run of the drive belt 338, while the opposite band holder 302 is clamped to the upper run of the drive belt 338. Thus, the band holders 302 move in opposite directions relative to one another.

The holding fixture 300 is mounted on a positioner 350 which moves the holding fixture 300 in two directions and rotates the holding fixture 300. The positioner 350 includes a turntable 352 which is connected to a rotary actuator 354. The turntable 352 and rotary actuator 354 allow the holding fixture 300 to be rotated.

The turntable 352 and rotary actuator 354 are mounted to a linear slide 356. Linear slide 356 moves the holding fixture 300 along a first axis. Linear slide 356 includes a track 358 and a slide member 360. The rotary actuator 354 is mounted on the slide member 360.

Linear slide 356 is mounted on a second linear slide 362. Linear slide 362 allows the holding fixture 300 to be moved along a second axis which is perpendicular to the first axis. Linear slide 362 includes a track 364 and a slide member 366. Slide member 366 supports the track 358 of the first linear slide 356.

SLEEVE OPENER

The sleeve opener 500 includes a series of pick-up heads 502 for picking up the upper layer of a flattened sleeve and a vacuum table 530. In the preferred embodiment, three pick-up heads 502 are used. Each pick-up head 502 includes an actuator 504 having movable elements 506. L-shaped pinchers 508 are secured to the movable elements 508 of the actuator 504. Each pincher includes a contact surface 510 and a gripping surface 512. The contact surface 510 of the pinchers 508 are textured so as to provide non-penetrating engagement with the sleeve material when the pick-up head 502 is lowered into contact with the sleeve. Various methods for texturing the contact surface 510 can be used. The preferred method is to embed industrial diamonds into the contact surface 510. The embedded diamonds mechanically interlock with the knitted fabric without penetrating the fabric.

The pick-up heads 502 are mounted for both vertical and lateral movement. The pick-up heads 502 depend downwardly from a frame member 514. The frame member 514 is connected to a cylinder 516 which is operative to raise and lower the frame member 514. Cylinder 516 is mounted to a second frame member 518. A pair of guide rods 520 extend outwardly from frame member 518. The guide rods 520 are slidably received in a support block 522. Support block 522 is supported by frame member 524. A cylinder 526, which is also supported by frame member 524, is operative to move the pick-up heads 502 laterally.

The sleeve opener 500 also includes a vacuum table 530 for holding the lower layer of the sleeve in fixed position while the pick-up heads 502 engage and lift the upper layer of the sleeve. The vacuum table 530 includes a generally horizontal support surface 532. A vacuum chamber 534 is formed below the support surface 532. A series of vacuum ports 536 extend through the support surface 532. A vacuum pump is communicatively connected to the vacuum chamber 534 to apply a vacuum to the chamber 534. When the vacuum is applied, the lower layer of the sleeve is held by the vacuum against the support surface 532. While the lower layer is held by the vacuum, the pick-up heads 502 engage and lift the upper layer of the sleeve to open the sleeve. While the sleeve is held in the open position, the cuff can be inserted into the sleeve.

OPERATION

In operation, the cuff is inserted onto the holding fixture 300. The cuff can be manually inserted onto the holding fixture 300 or, alternately, can be inserted by automated means. The cuff material is pinched between the finger sleeve 320 and the shoulder 318 of the support finger 312 to prevent the cuff from slipping on the holding fixture. The sleeve is positioned over the vacuum table 350 and the vacuum pump 538 is actuated to apply vacuum to the vacuum chamber 534. When vacuum is applied to the vacuum chamber 534, the sleeve is held against the surface 532 of the vacuum table 530.

While the sleeve is held in place on the vacuum table 530, cylinder 526 is actuated to extend the pick-up heads 502. When the pick-up heads are positioned above the sleeve, cylinder 516 is then actuated to lower the pick-up heads 502 into engagement with the sleeve. The pick-up heads 502 are lowered until the contact surface 510 of the pinchers 508 engage the upper layer of the sleeve material and press the material against the vacuum table 530. Once the pick-up heads 502 are engaged with the upper layer of the sleeve, the actuators 504 are energized to close the pinchers 508. As the pinchers 508 move toward one another, a fold in the sleeve material is produced that extends between the gripping surfaces 512 of the opposed pinchers 508. Thus, the sleeve material is clamped between the opposed gripping surfaces 512 of the pinchers 508. Cylinder 516 is then actuated to raise the pick-up heads 502 while continuing to supply vacuum to the vacuum chamber 534. Thus, the sleeve is opened to allow insertion of the cuff.

When the sleeve is in an open position, the holding fixture 300 is moved forwardly relative to the sleeve opener 500 to insert the cuff into the sleeve. After the cuff is inserted into the sleeve, the sleeve and cuff can be transported to a sewing apparatus where they can be sewn together.

AUTOMATIC CUFF SETTER

Figure 29:
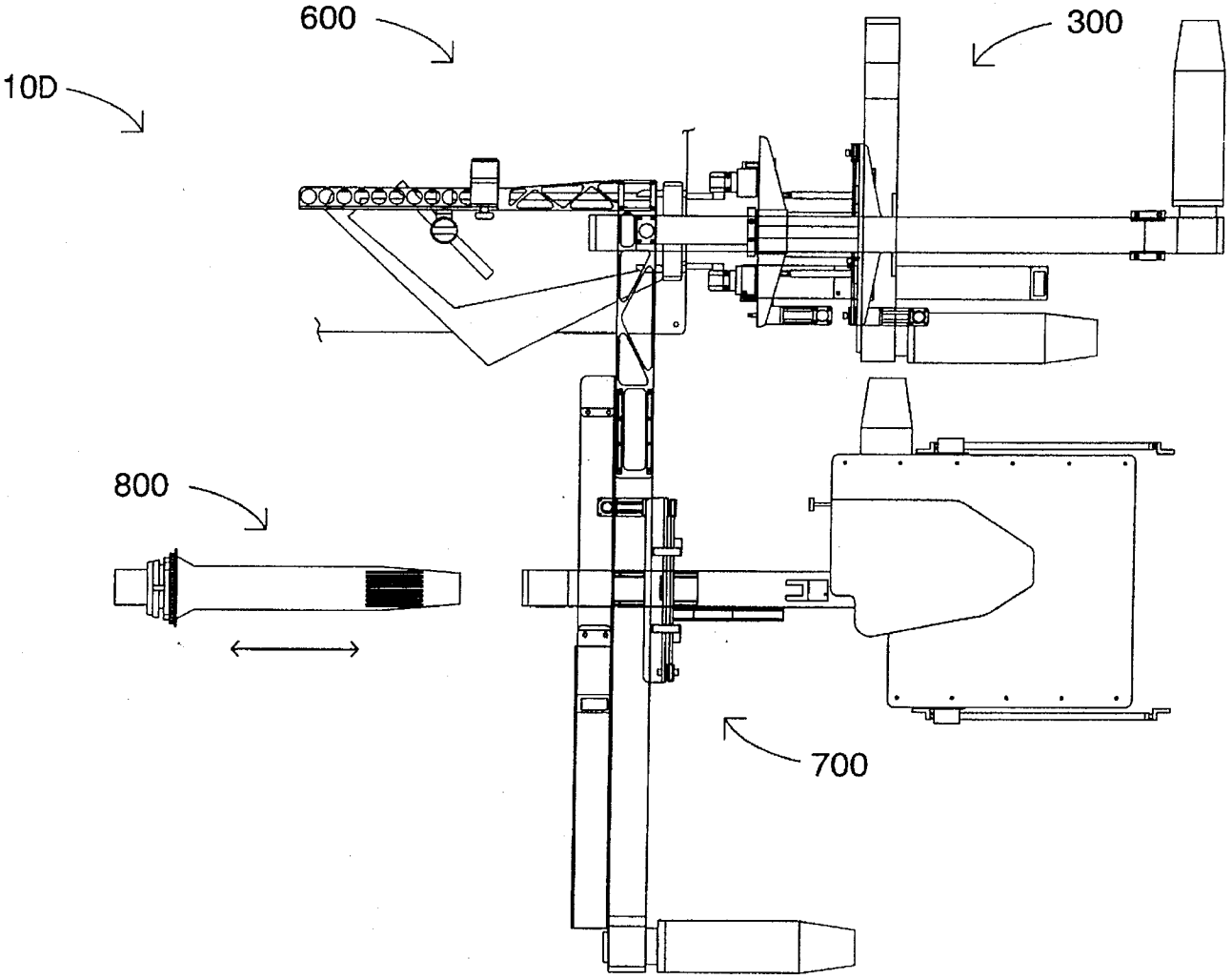
FIG. 29 is a top plan view of an automatic cuff setter constructed according to the present invention including a holding fixture for holding the circular cuffs and positioning a cuff in the garment piece prior to sewing; a transfer system for moving the garment piece and cuff together to a cuff setter for sewing; and a cuff setter including a sewing machine and an elongated tube and spreaders for sewing the cuff to the garment piece.

As best seen in FIG. 29, an apparatus for automatically setting a cuff, generally designated 10D, is shown constructed according to the present invention.

The automatic cuff setter 10D includes three major subassemblies: a holding fixture 300 for holding the circular cuffs and positioning the cuffs in the garment piece prior to sewing; a transfer system 600 for moving the garment piece to a cuff setter 700 for sewing. The cuff setter 700 including a sewing machine and an elongated tube and spreaders 800.

Figure 30:
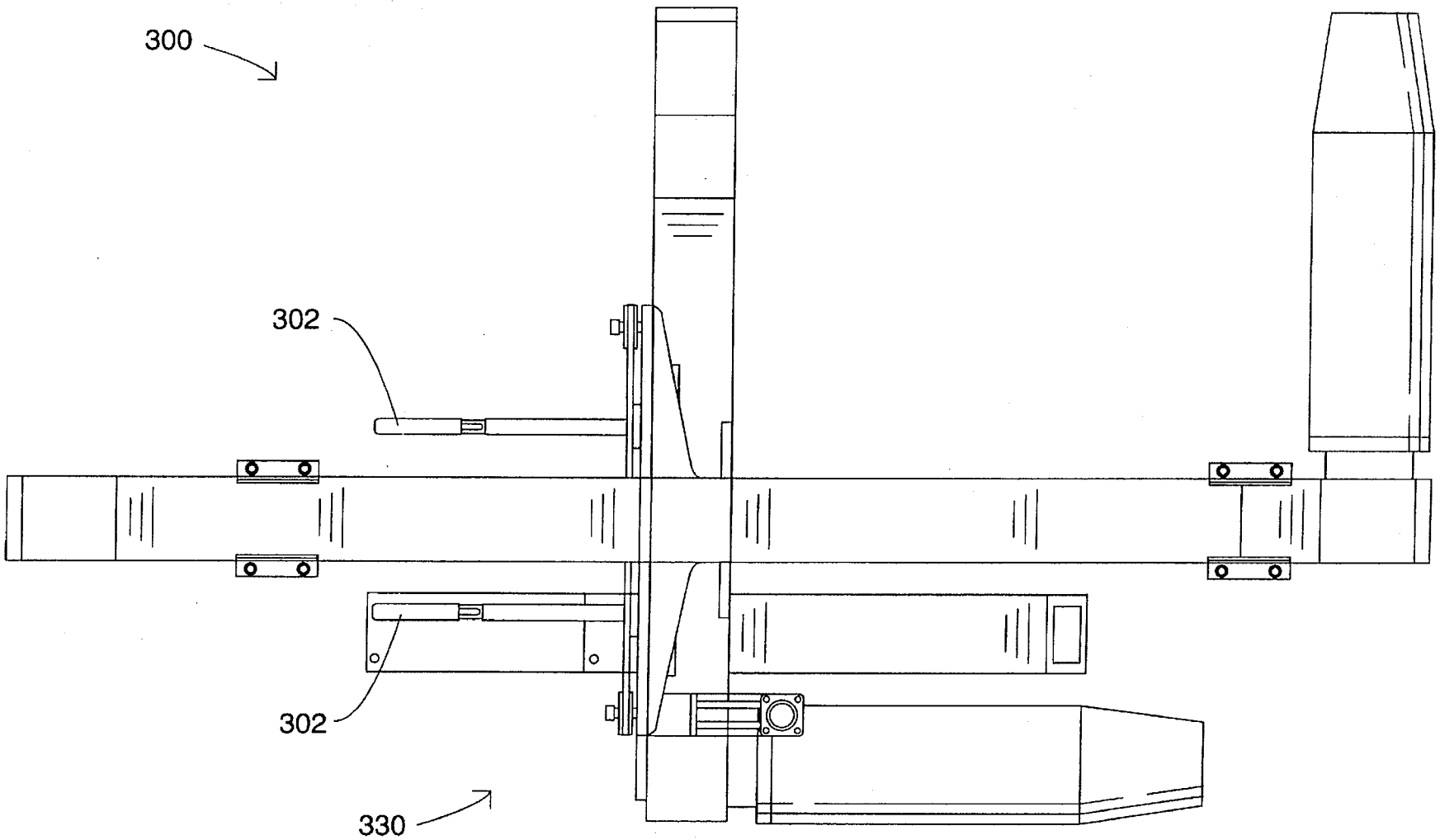
FIG. 30 is an enlarged top plan view of the holding fixture.
Figure 31:
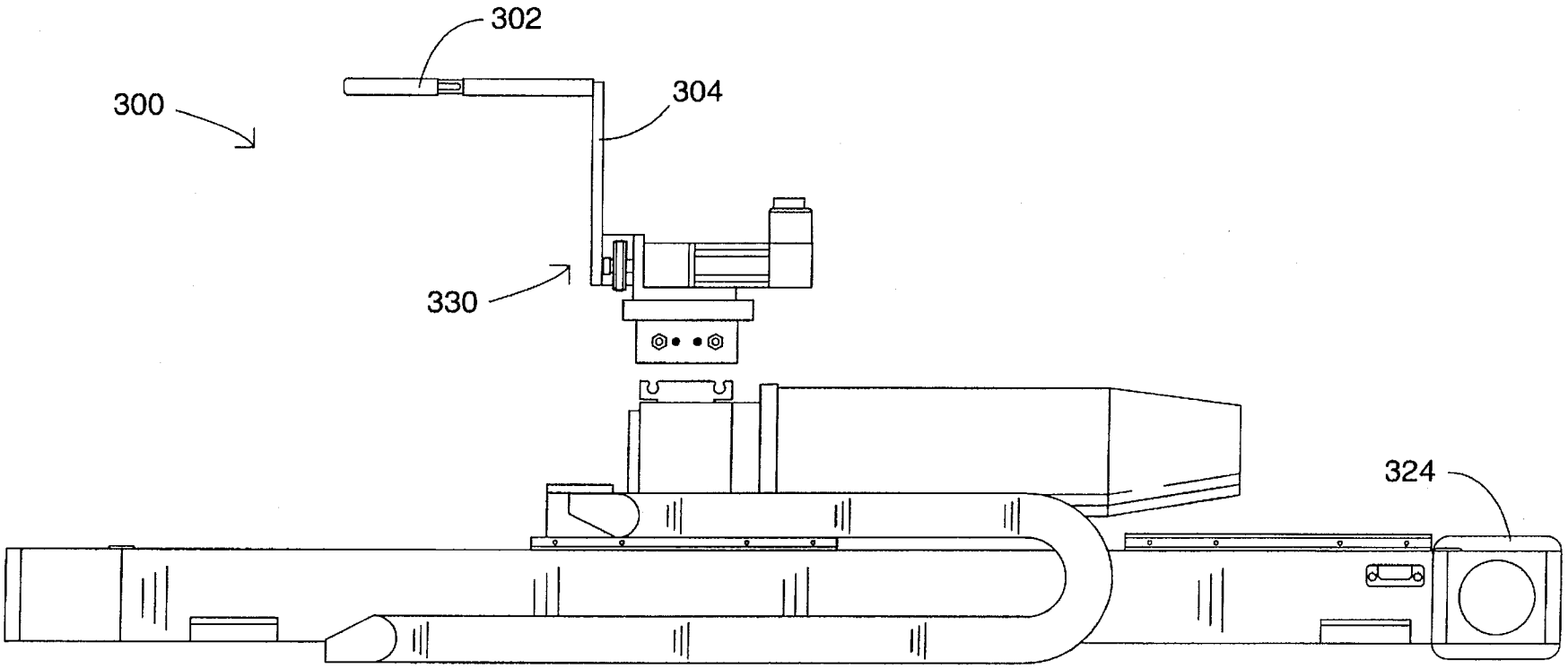
FIG. 31 is an enlarged side elevation view of the holding fixture.
Figure 32:
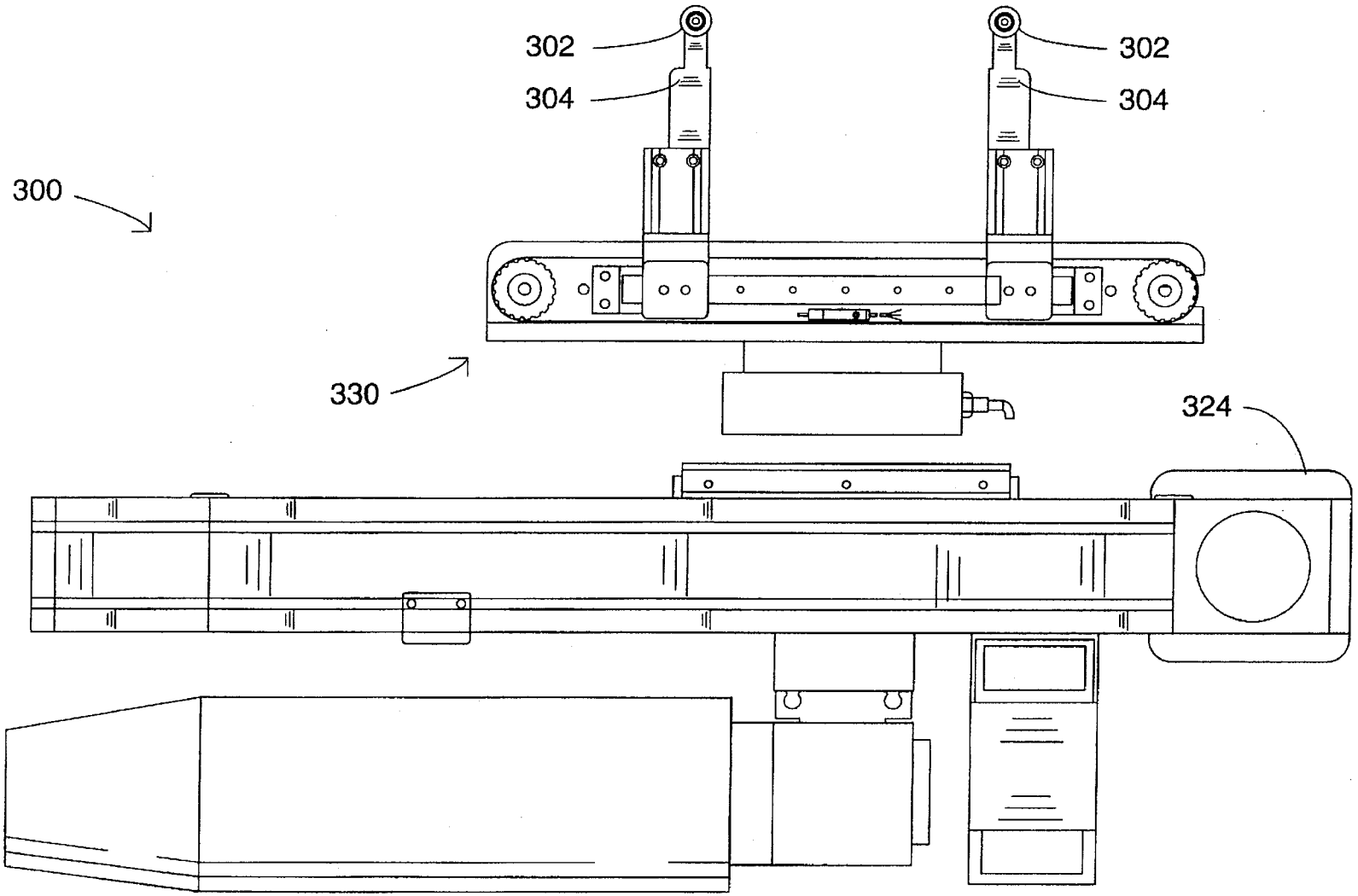
FIG. 32 is an enlarged front elevation view of the holding fixture.

The holding fixture 300, shown in FIGS. 30–32, receives and holds the circular cuffs for placement into the garment piece. The transfer system 600, shown in FIGS. 33–35, moves the garment piece and circular cuffs together to a sewing machine station for sewing into the garment piece. The cuff setter 700, shown in FIGS. 36–38, sews the garment piece and circular cuffs together. The cuff setter 700 includes a sewing machine and an elongated tube and spreaders 800 to remove the cuff and garment piece from the transfer system 600. At the same time, elongated tube assembly 820 moves into the opposite, open end of the garment sleeve. After the transfer is completed, the spreader and tube holding the garment sleeve are moved together to the sewing machine 702. The sewing machine is actuated and, at the same time, the tube holding the garment piece and sleeve is rotated in the direction of sewing. The cuff and sleeve are thus sewn together. The completed garment piece is then removed, bundled and taken to the next sewing station for assembly into a final garment. Details of the individual components are discussed below.

HOLDING FIXTURE

The holding fixture 300, shown in FIGS. 30–32, receives and holds the circular cuffs for placement into the garment piece. The holding fixture 300 includes a pair of cuff holders 302 which are movable relative to one another by a cuff holder drive assembly 330. The cuff holder drive assembly 330 is, in turn, mounted on a positioner 350 which is used to position the holding fixture 300.

Each cuff holder 302 includes a support post 304. A clamping block 306 is secured to the lower end of the support post 304. A support finger 312 projects outwardly from the upper end of the support post 304. The support finger 312 includes first and second portions 314 and 316. The second portion 316 has a larger diameter than the first portion 314 so that a shoulder 318 is formed between the first and second portions 314 and 316.

A finger sleeve 320 is slidably mounted on the first portion 314 of the support finger 312. The finger sleeve 300 is movable between a closed position in which one end of the finger sleeve 320 pressed against the shoulder 318, and an open position in which the finger sleeve 320 is spaced from the shoulder 318.

The finger sleeve 320 is movable between the open position and the closed position by a cylinder 324. The cylinder 324 is mounted to the support post 304. Cylinder 324 is connected to a yoke 328. A linkage 322, which is pivotally mounted on a link support 326, connects the finger sleeve 320 to the yoke 328. Thus, the actuation of the cylinder 324 causes the finger sleeve 320 to move back and forth between the open position and the closed position.

The cuff holder drive assembly 330 moves the cuff holders 302 relative to one another in a transverse direction. The cuff holder drive assembly 330 is similar to the gripper drive assembly. A pair of spaced-apart belt pulleys 336 are rotatably mounted to a frame member 334. A drive belt 338 is entrained around the belt pulleys 336. One of the belt pulleys is driven by a belt motor 340. Belt motor 340 is preferably a servo-motor under the control of a programmable controller.

Each of the cuff holders 302 are clamped to the drive belt 338. The clamping block 306 of the cuff holder includes a clamping member 310 which compresses the drive belt 338 between the clamping member 310 and clamping block 306. Each of the cuff holders 302 is clamped to a respective run of the drive belt 338. One of the cuff holders 302 is clamped to a lower run of the drive belt 338, while the opposite cuff holder 302 is clamped to the upper run of the drive belt 338. Thus, the cuff holders 302 move in opposite directions relative to one another. The clamping block 306 includes a guide channel 308 which engages with a track 332 on the frame member 334 to guide the movement of the cuff holder 302.

The holding fixture 300 is mounted on a positioner 350 which moves the holding fixture 300 in two directions and rotates the holding fixture 300. The positioner 350 includes a turntable 352 which is connected to a rotary actuator 354. The turntable 352 and rotary actuator 354 allow the holding fixture 300 to be rotated.

The turntable 352 and rotary actuator 354 are mounted to a linear slide 356. Linear slide 356 moves the holding fixture 300 in the "y" direction (i.e., perpendicular to the direction of feed of the cuff material). Linear slide 356 includes a track 358 and a slide member 360. The rotary actuator 354 is mounted on the slide member 360.

Linear slide 356 is mounted on a second linear slide 362. Linear slide 362 allows the holding fixture 300 to be moved in the "x" direction (forwardly and backwardly along the direction of feed of the cuff material). Linear slide 362 includes a track 364 and a slide member 366. Slide member 366 supports the track 358 for the first linear slide 356.

The holding fixture 300 cooperates with either a manual or automatic cuff loader (not shown). While the cuff material is being loaded, the finger sleeve 320 is normally in an open position so that the cuff material forms a cup in the space between the end of the finger sleeve 320 and the shoulder 318. After the cuff material is loaded, the finger sleeve 320 is moved to a closed position. When the finger sleeve 320 is moved to the closed position, a portion of the cuff material is pinched between the finger sleeve 320 and the shoulder 318. The finger sleeve 320 remains in a closed position while the holding fixture 300 is moved to the garment piece for positioning. The circular cuff is pinched approximately mid-way between the ends of the cuff.

TRANSFER SYSTEM

Figure 33:
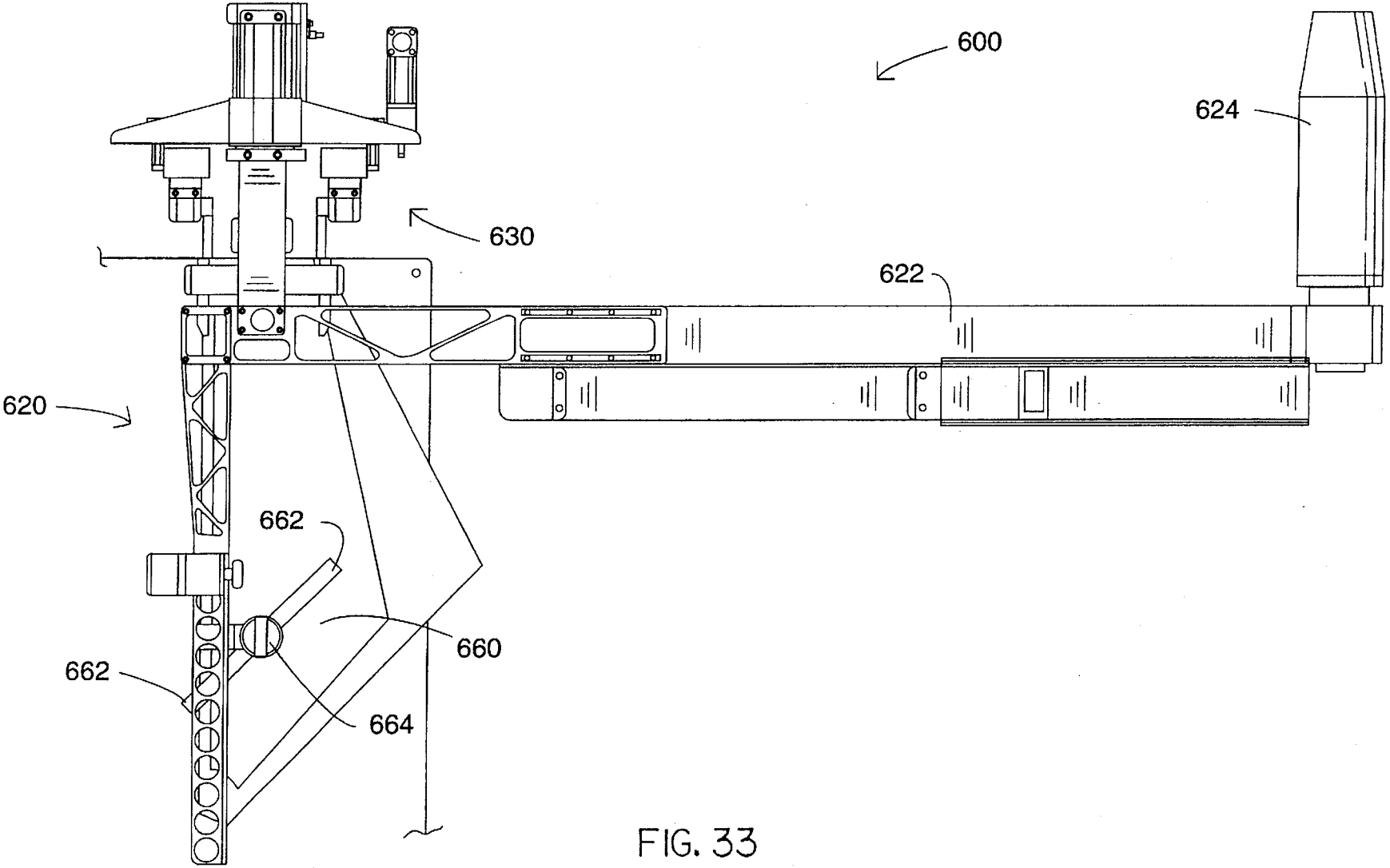
FIG. 33 is an enlarged top plan view of the transfer system.
Figure 34:
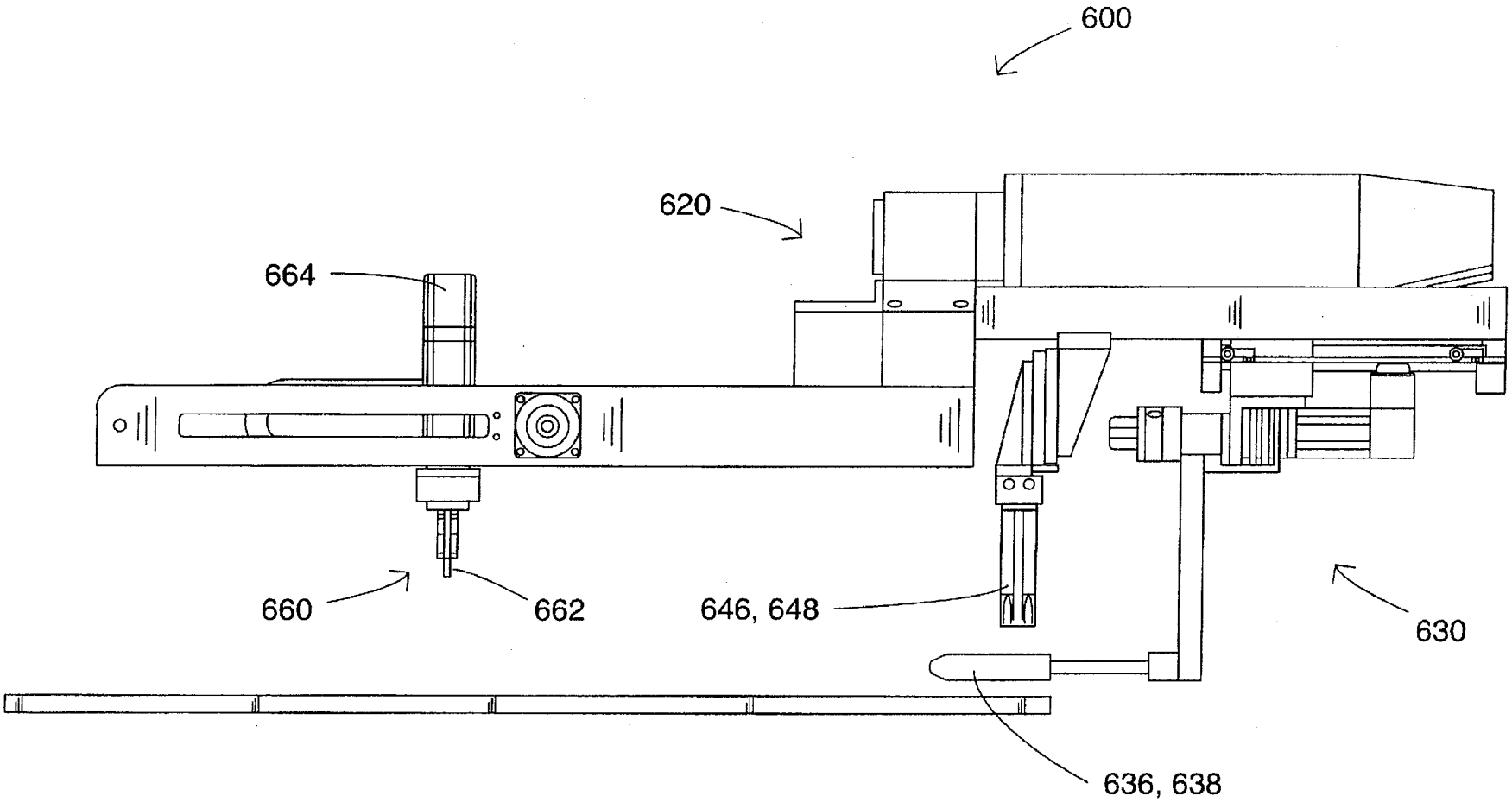
FIG. 34 is an enlarged side elevation view of the transfer system.
Figure 35:
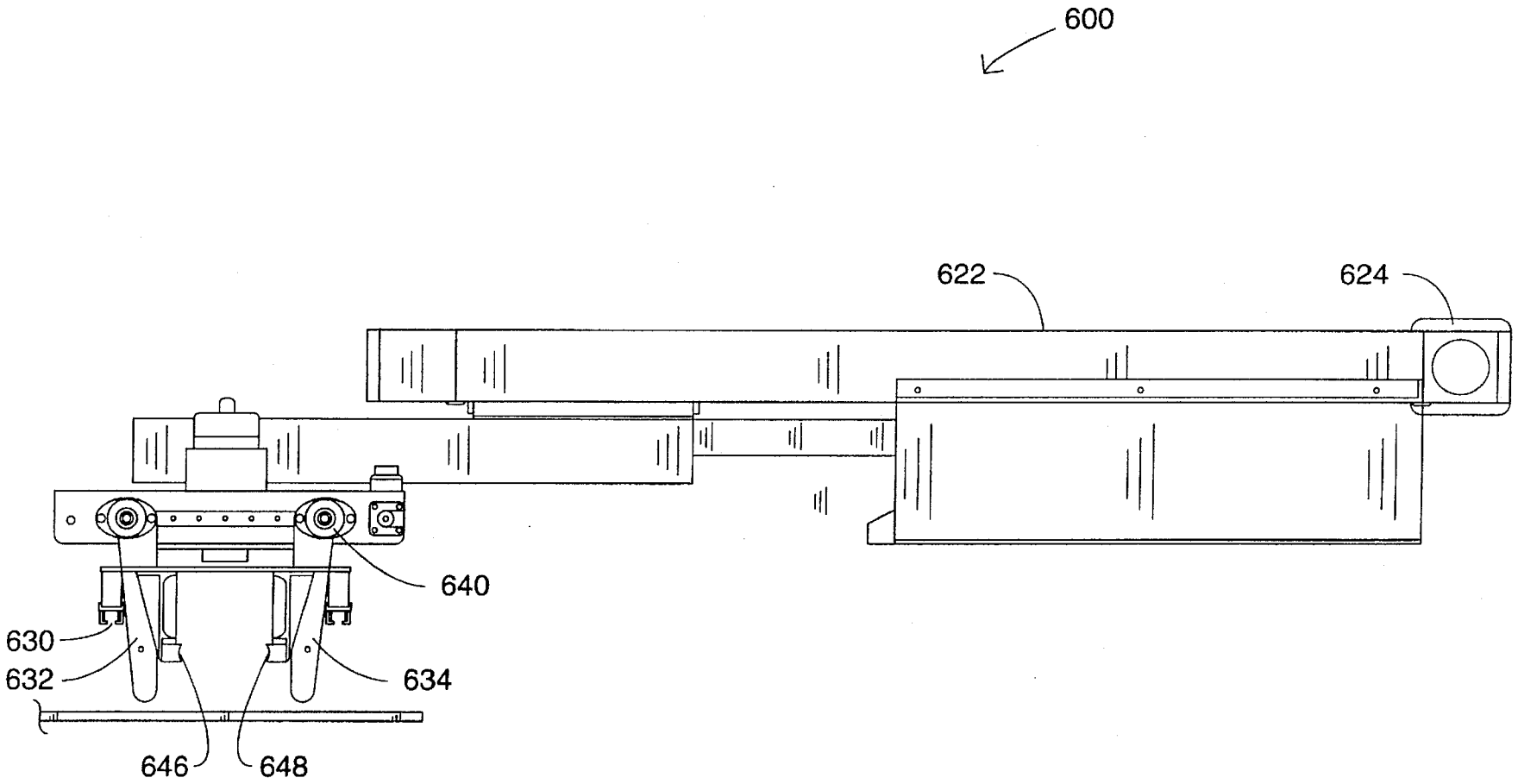
FIG. 35 is an enlarged front elevation view of the transfer system.

The transfer system 600, shown in FIGS. 33–35, moves the garment piece and circular cuffs to a sewing machine station for sewing into the garment piece. The transfer system 600 includes a frame 620 having a first pickup means 630 and second pickup means 660. As best seen in FIG. 33, frame 620 is movable between first and second positions by means of a linear slide 622 and actuator 624. This operation moves the pickup means from a first position where the garment piece and cuff are picked up to a second position where the garment piece and cuff are sewn together.

Turning to FIG. 35, first pickup means 630 includes a pair of opposed arms 632, 634. Opposed arms 632, 634 are moved into position with the cuff and garment piece by actuator means 640. Each arm 632, 634 includes semi-circular fingers 636, 638 for engaging the inner surface of the cuff and sleeve. The fingers 636, 638 are rotatable 180° between a first position away from the inside of the cuff to a second position in contact with the inside of the cuff to remove the cuff and garment piece from the holding fixture 300. In the preferred embodiment, the first pickup means also includes a pair of side grippers 646, 648 for preventing movement of the garment piece during transfer to the cuff setter.

As best seen in FIGS. 33 and 34, the second pickup means 660 includes at least one pickup head 662 connected to a vertical actuator 664 for moving the pickup head into contact with the body of the garment piece. In the preferred embodiment, a pair of pickup heads are used. Each pick-up head 662 includes an actuator having movable elements. L-shaped pinchers are secured to the movable elements of the actuator. Each pincher includes a contact surface and a gripping surface. The contact surface of the pinchers are textured so as to provide non-penetrating engagement with the sleeve material when the pick-up head 662 is lowered into contact with the sleeve. Various methods for texturing the contact surface 510 can be used. The preferred method is to embed industrial diamonds into the contact surface. The embedded diamonds mechanically interlock with the knitted fabric without penetrating the fabric.

CUFF SETTER

Figure 36:
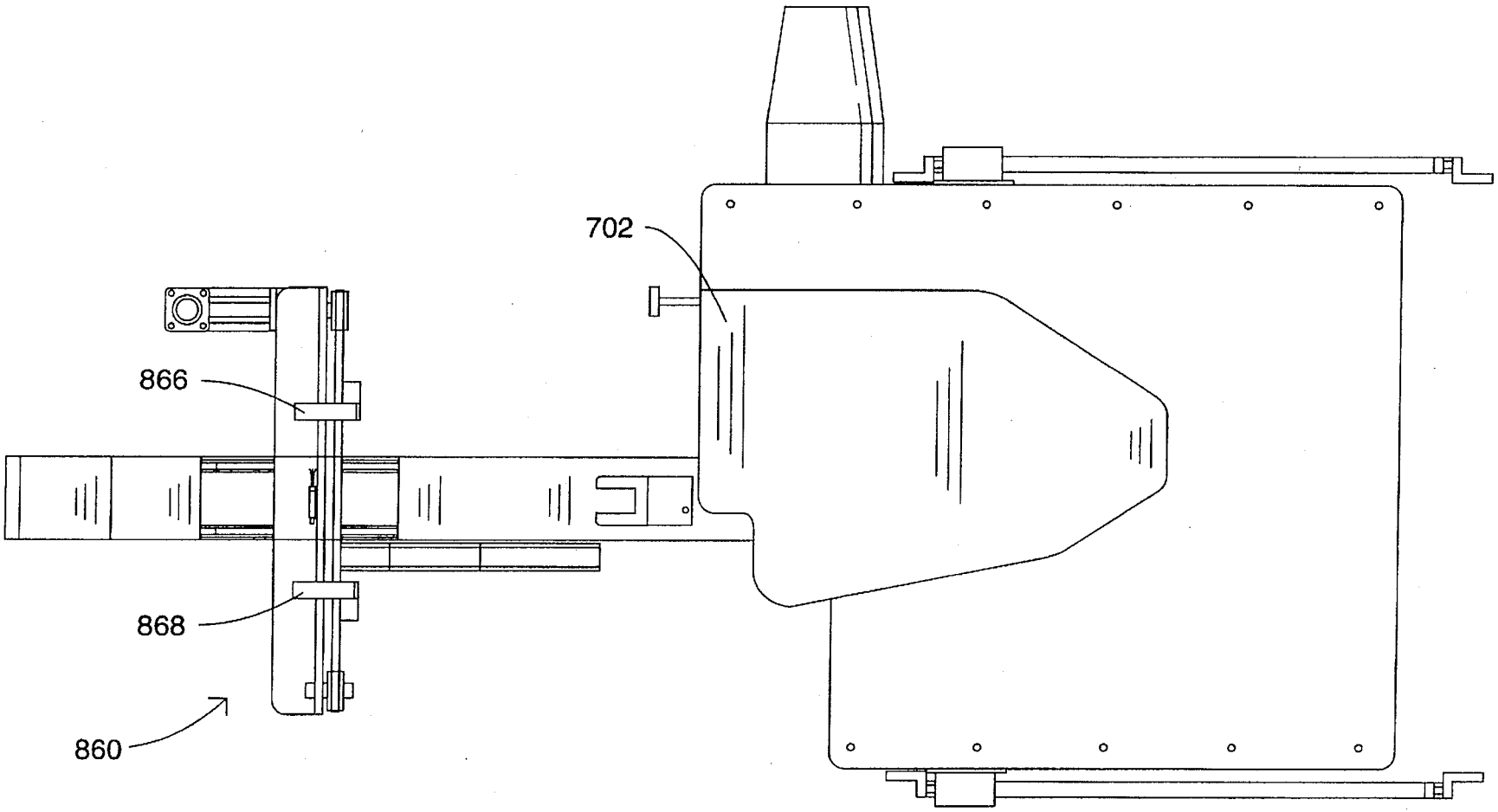
FIG. 36 is an enlarged top plan view of the cuff setter.
Figure 37:
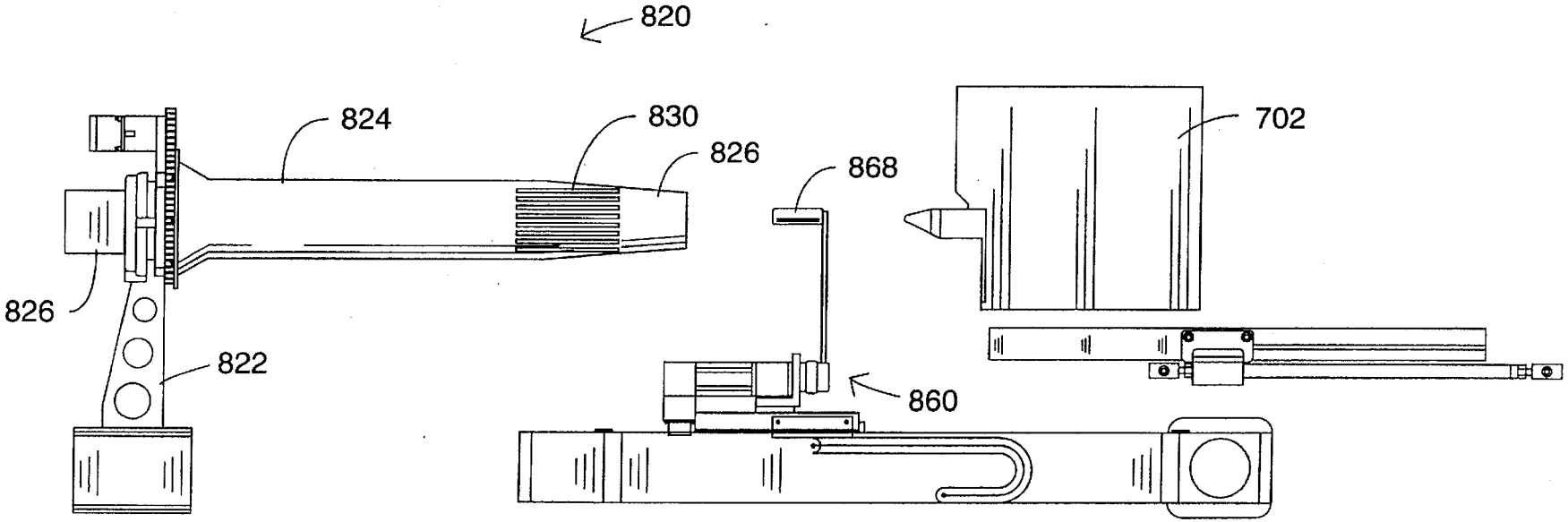
FIG. 37 is an enlarged side elevation view of the cuff setter.
Figure 38:
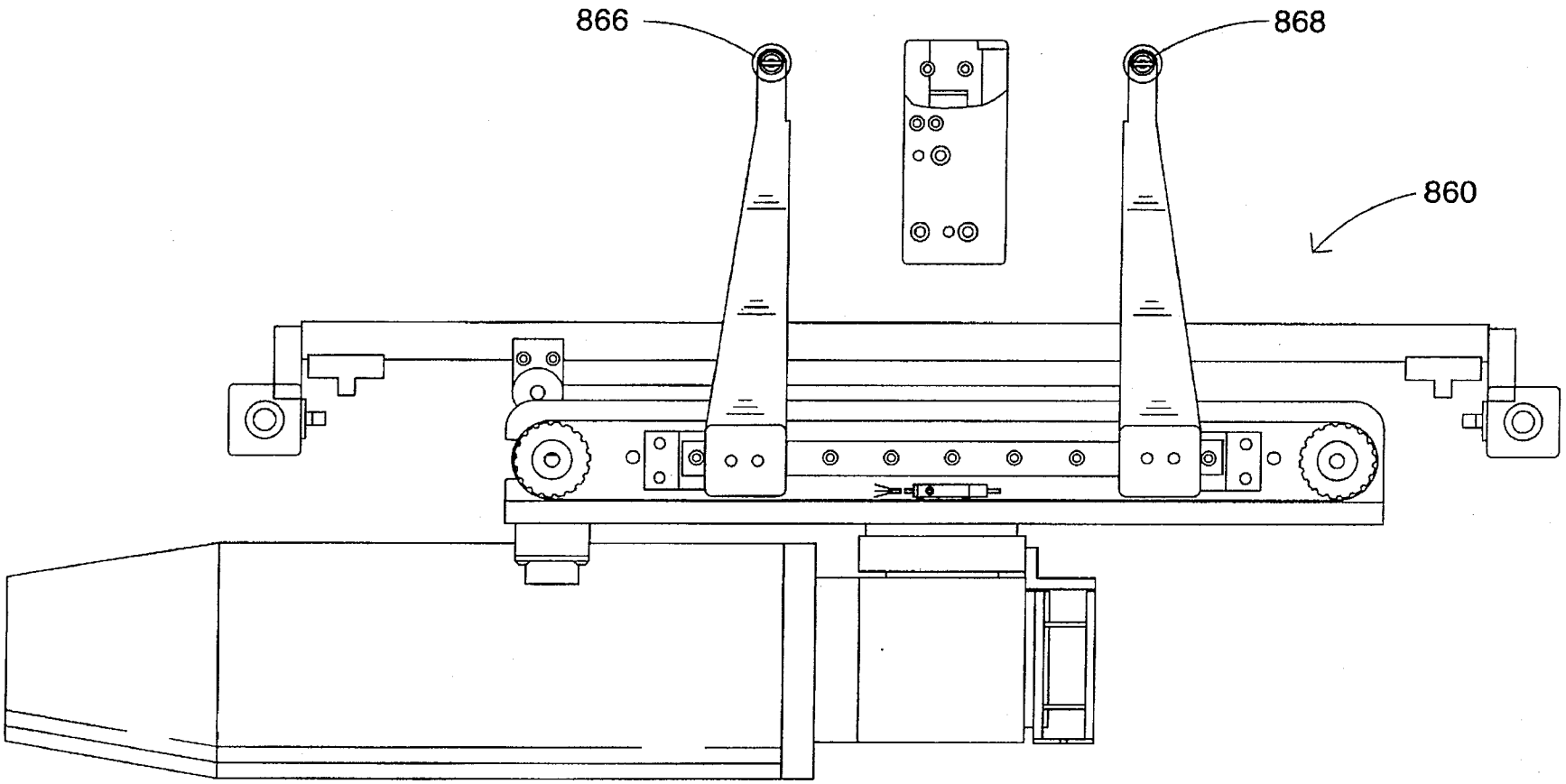
FIG. 38 is an enlarged front elevation view of the cuff setter.

The cuff setter 700, shown in FIGS. 36–38, sews the garment piece and circular cuffs together at a sewing machine station. The cuff setter 700 includes a sewing machine and an elongated tube and spreaders 800 to remove the cuff and garment piece from the transfer system 600. At the same time, elongated tube assembly 820 moves into the opposite, open end of the garment sleeve.

Elongated tube assembly 820 includes a frame 822 and an elongated plastic tube 824. A vacuum source 826 is attached to one end of the tube and a plurality of slots are arranged along the axial length of the other end of the tube 830. One type of vacuum source which is particularly suitable for the tube is a transvector Model 914, manufactured by VORTEC, Inc. of Cincinnati, Ohio. In the preferred embodiment, the end of the tube opposite the vacuum supply 832 is slightly tapered to improve the operation of the tube. Also in the preferred embodiment, the tube is made of a low friction plastic such as cellulose acetate butyrate. However, it would be expected that other materials such as polished aluminum would also work suitably well.

As best seen in FIG. 37, spreader assembly 860 includes a frame 862 having a pair of opposed arms 864. Opposed arms perpendicular rollers 866,868 enter the cuff of the sleeve and move apart to help the gripper arm 840 locate and grab the cuff of the sleeve prior to inversion. A pair of rotary actuators 870 move the rollers 866,868 from a first position close together where they can be inserted into the cuff to a second position in which the cuff is transferred, as will best be seen in FIG. 38. The frame 862 of the spreader assembly 860 is attached to a slide 872 and actuator 874 removing it between an first position away from the open-ended sleeve to a second position in which it engages the sleeve.

After the transfer is completed, the spreader and tube are moved together to the sewing machine 702. The sewing machine is actuated and, at the same time, the tube holding the garment piece and sleeve is rotated in the direction of sewing. The cuff and sleeve are thus sewn together.

SLEEVE INVERTOR

Figure 39:
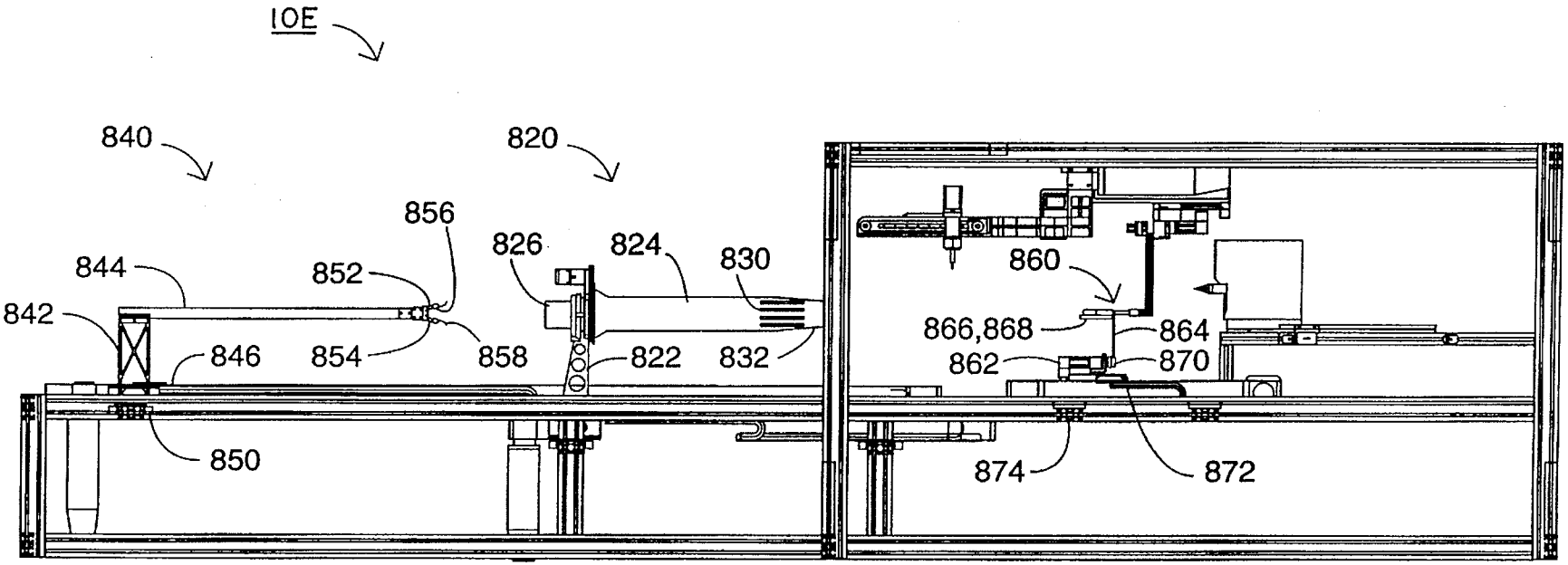
FIG. 39 is a side elevational view of a sleeve invertor constructed according to the present invention.

As best seen in FIG. 39, sleeve invertor, generally designated 10E, is shown constructed according to the present invention.

The sleeve invertor 10E includes three major subassemblies: an elongated tube assembly 820; a gripper arm assembly 840; and a spreader assembly 860.

Figure 40:
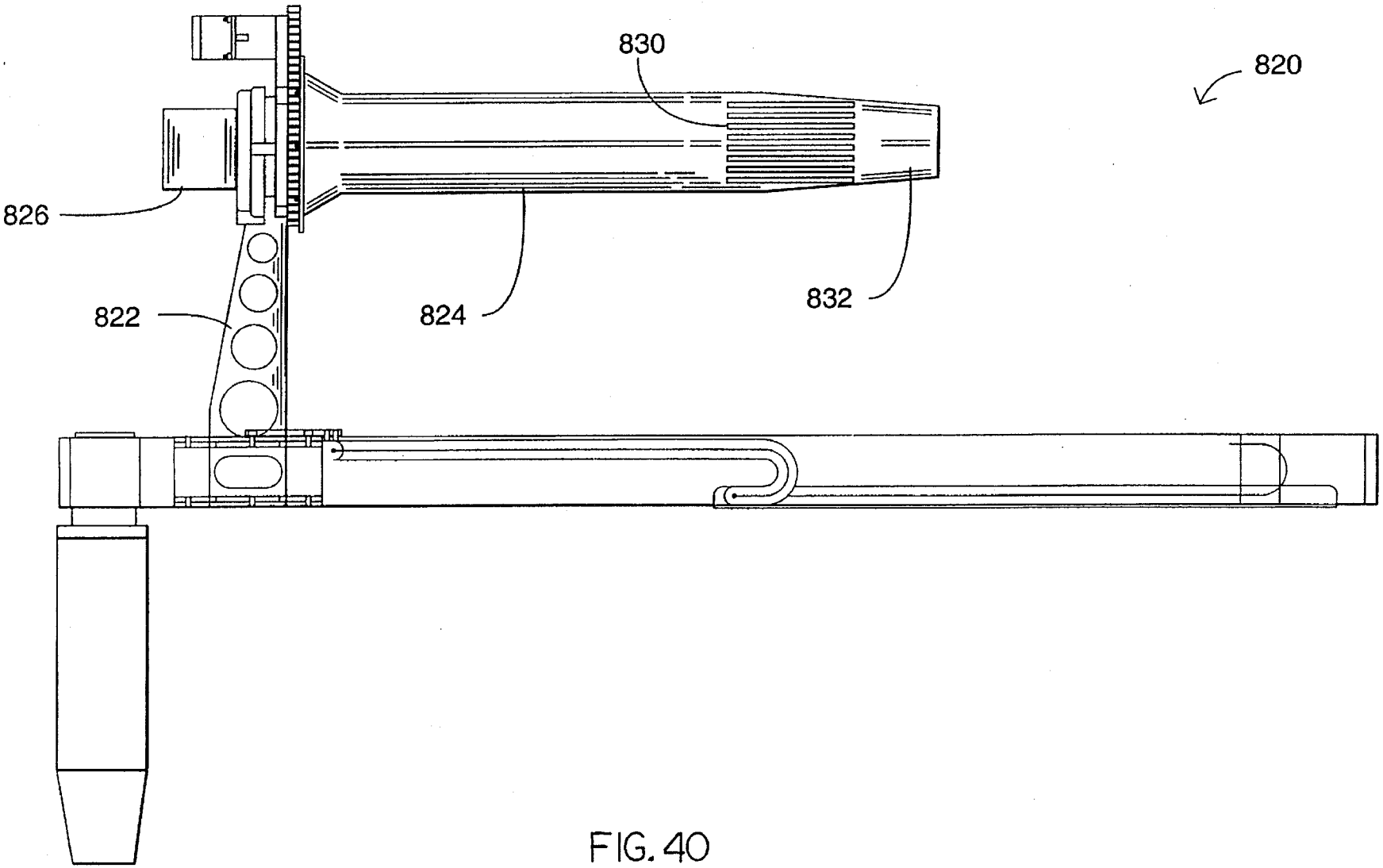
FIG. 40 is an enlarged side elevational view of the sleeve invertor shown in FIG. 39 illustrating the elongated tube.

As best seen in FIG. 40, elongated tube assembly 820 includes a frame 822 and an elongated plastic tube 824. A vacuum source 826 is attached to one end of the tube and a plurality of slots are arranged along the axial length of the other end of the tube 830. One type of vacuum source which is particularly suitable for the tube is a transvector Model 914, manufactured by VORTEC, Inc. of Cincinnati, Ohio. In the preferred embodiment, the end of the tube opposite the vacuum supply 832 is slightly tapered to improve the operation of the tube. Also in the preferred embodiment, the tube is made of a low friction plastic such as cellulose acetate butyrate. However, it would be expected that other materials such as polished aluminum would also work suitably well.

Figure 41:
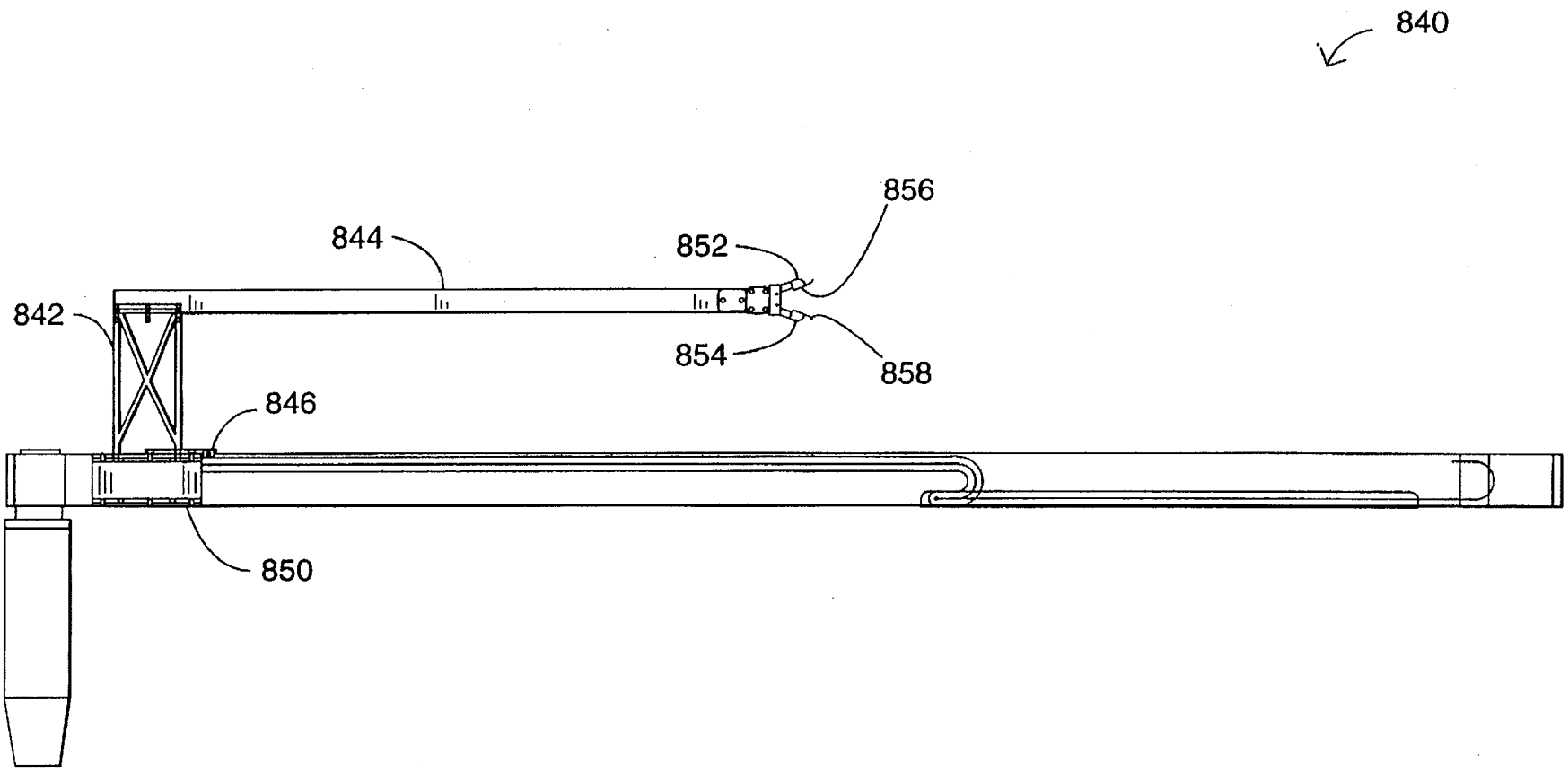
FIG. 41 is an enlarged side elevational view of the sleeve invertor shown in FIG. 39 illustrating the gripper arm.

As best seen in FIG. 41, the gripper arm assembly 840 includes a frame 842 and an elongated arm with gripper jaws 844. The frame 842 is attached to a slide 846 and a actuator 850 for moving the elongated arm with the grippers 844 from a first position inside the elongated tube assembly 820 to a second retracted position in which the garment sleeve has been pulled completely through the interior of elongated tube assembly 820. Elongated arm with gripper jaws 844 includes a pair of opposed jaws 852,854 having roughened gripping surfaces 856. Also in the preferred embodiment, wire guides 858 improve the ability of the jaws 852,854 to contact the surface of the sleeve loaded onto the elongated tube assembly 820.

Figure 42:
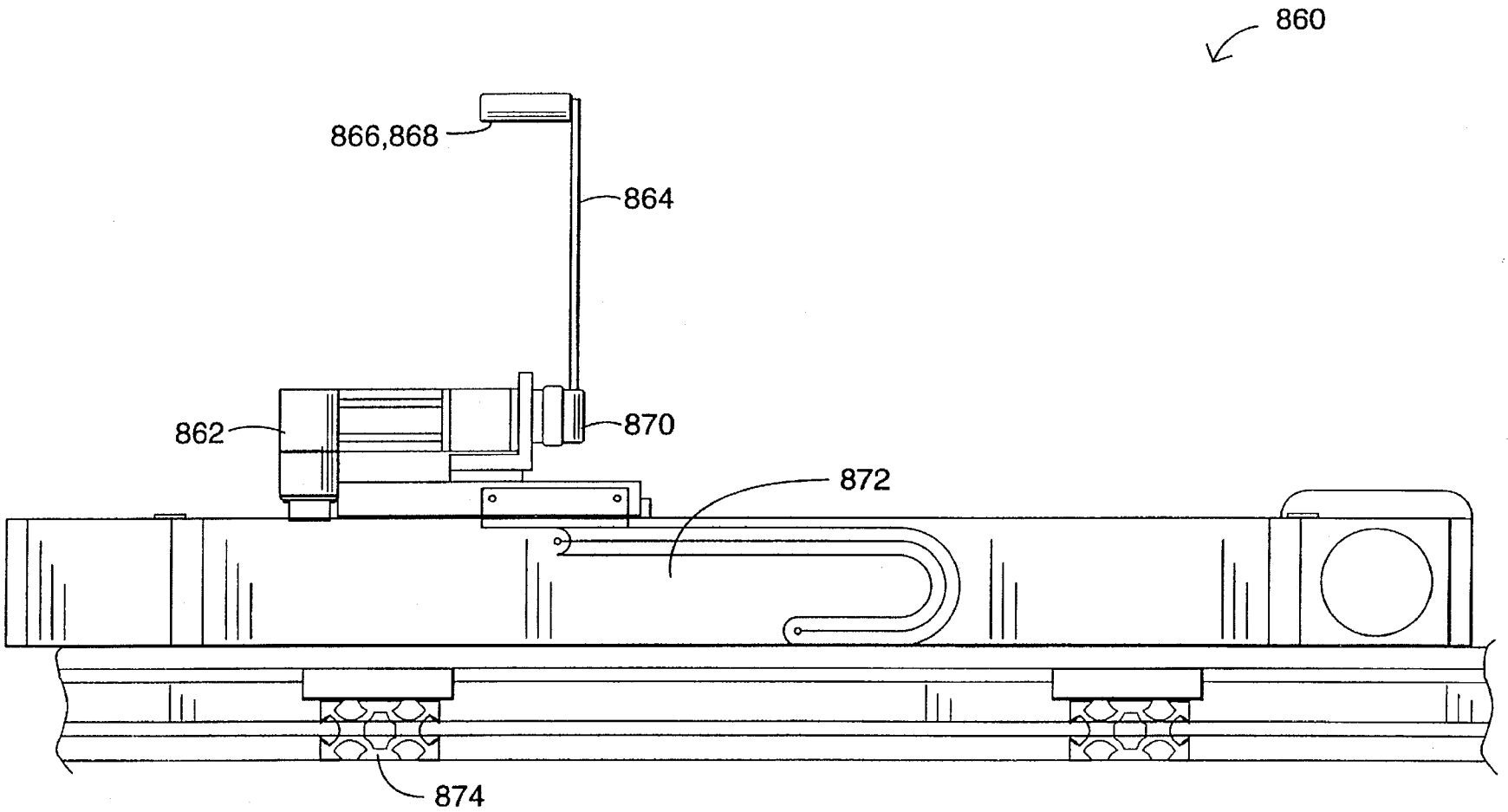
FIG. 42 is an enlarged side elevational view of the sleeve invertor shown in FIG. 39 illustrating the spreaders.
Figure 43:
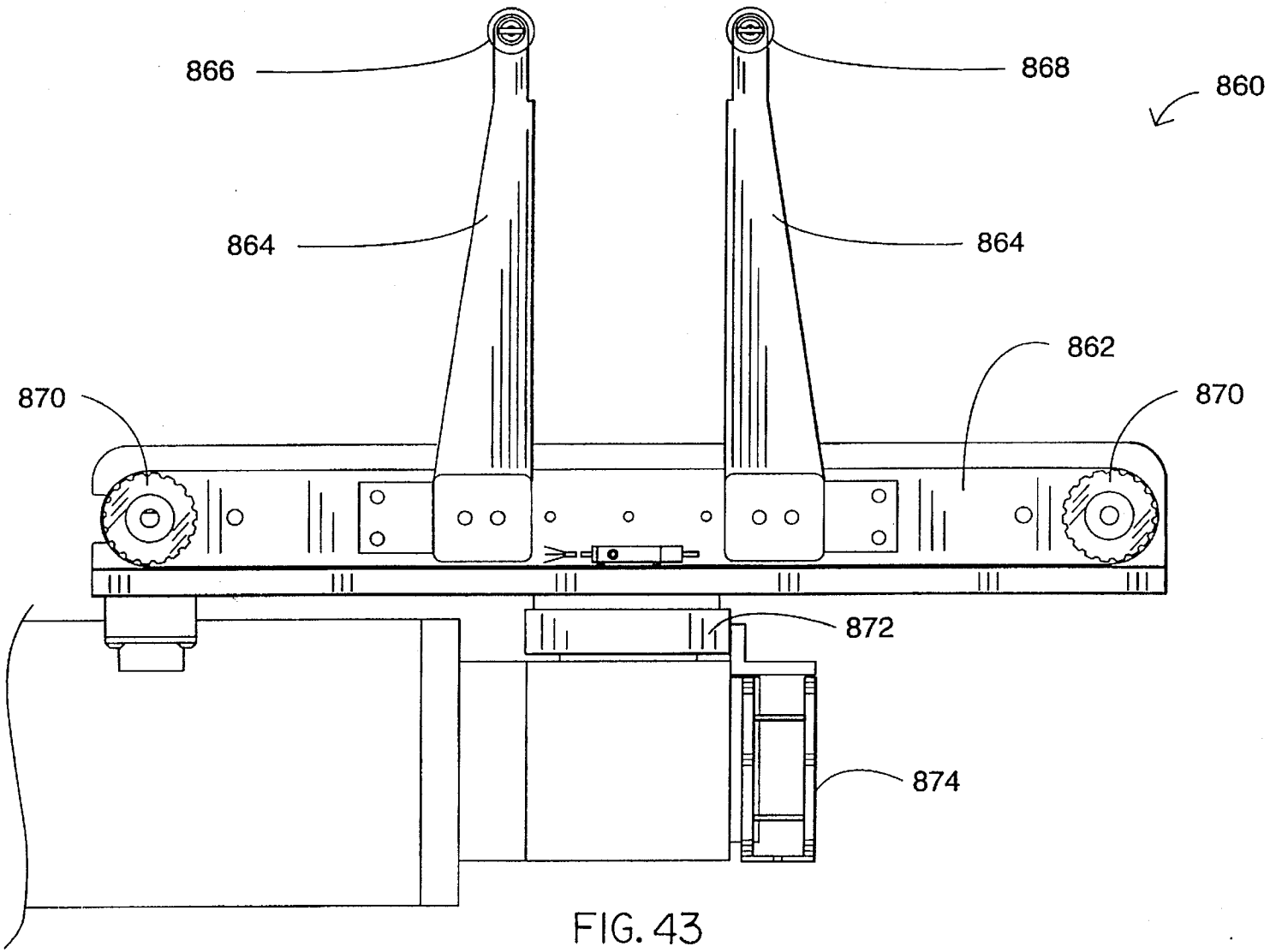
FIG. 43 is an enlarged front view of the spreaders shown in FIG. 42.

As best seen in FIGS. 42 and 43, spreader assembly 860 includes a frame 862 having a pair of opposed arms 864. Opposed arms perpendicular fingers 866,868 enter the cuff of the sleeve and spread it apart to help the gripper arm 840 locate and grab the cuff of the sleeve prior to inversion. A servo motor 870 moves the fingers 866,868 from a first position close together where they can be inserted into the cuff to a second position in which the cuff is spread, as will best be seen in FIG. 44. The frame 862 of the spreader assembly 860 is attached to a slide 872 and actuator 874 for moving it between an first position away from the open-ended sleeve to a second position in which it engages the sleeve.

Figure 44A:
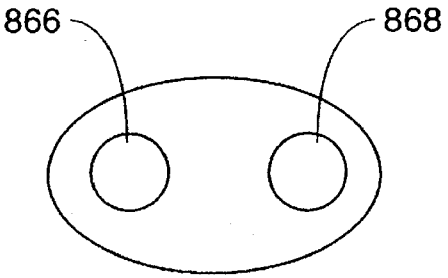
FIGS. 44A–44C are sequential diagrams of the clamping of a cuff by the opposed jaws of the gripper arm.
Figure 44B:
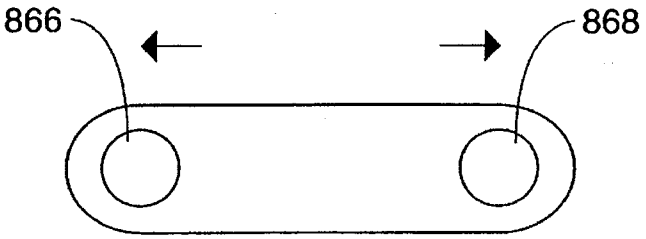
Figure 44C:
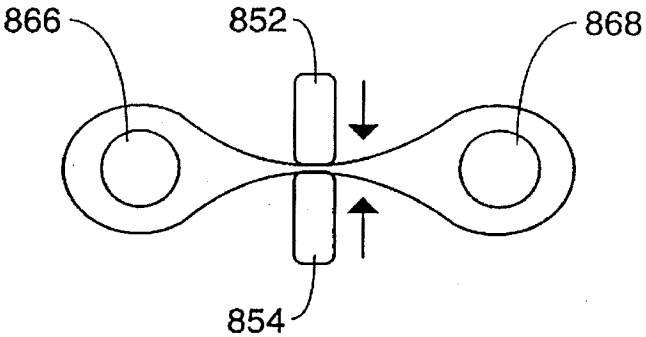

The operation of the sleeve invertor 10E can best be understood by looking at FIG. 44. After the sleeve is loaded onto the elongated tube 824, either manually or automatically, fingers 866,868 are inserted into the open end of the sleeve. The servo motor 870 is then activated and fingers 866,868 move outward causing the fabric of the cuff to be stretched tightly therebetween. This defines the position of the cuff which can be more easily grasped by jaws 852,854.

GARMENT STACKER

Figure 45:
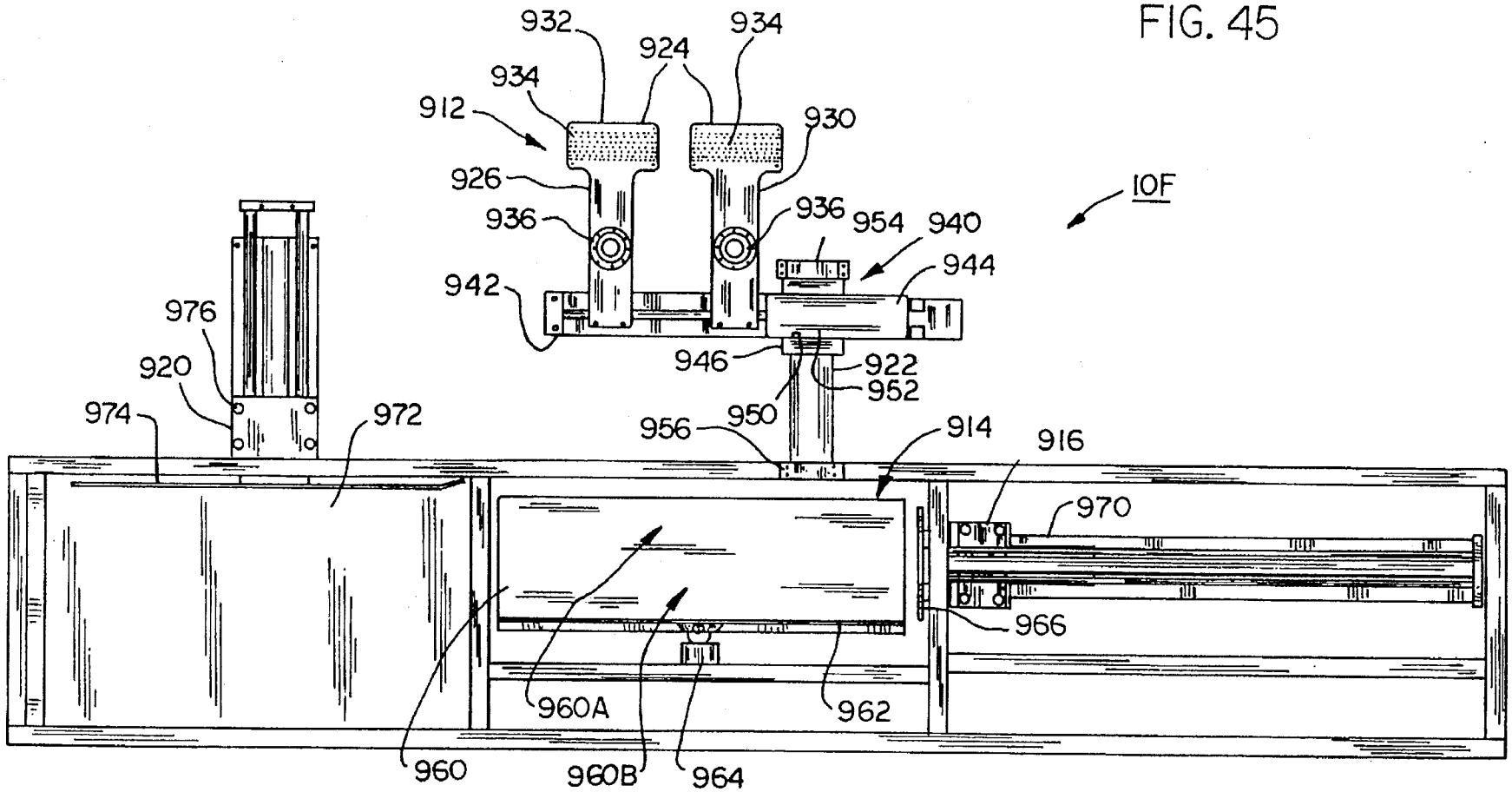
FIG. 45 is a plan view of a garment stacker constructed according to the present invention.
Figure 46:
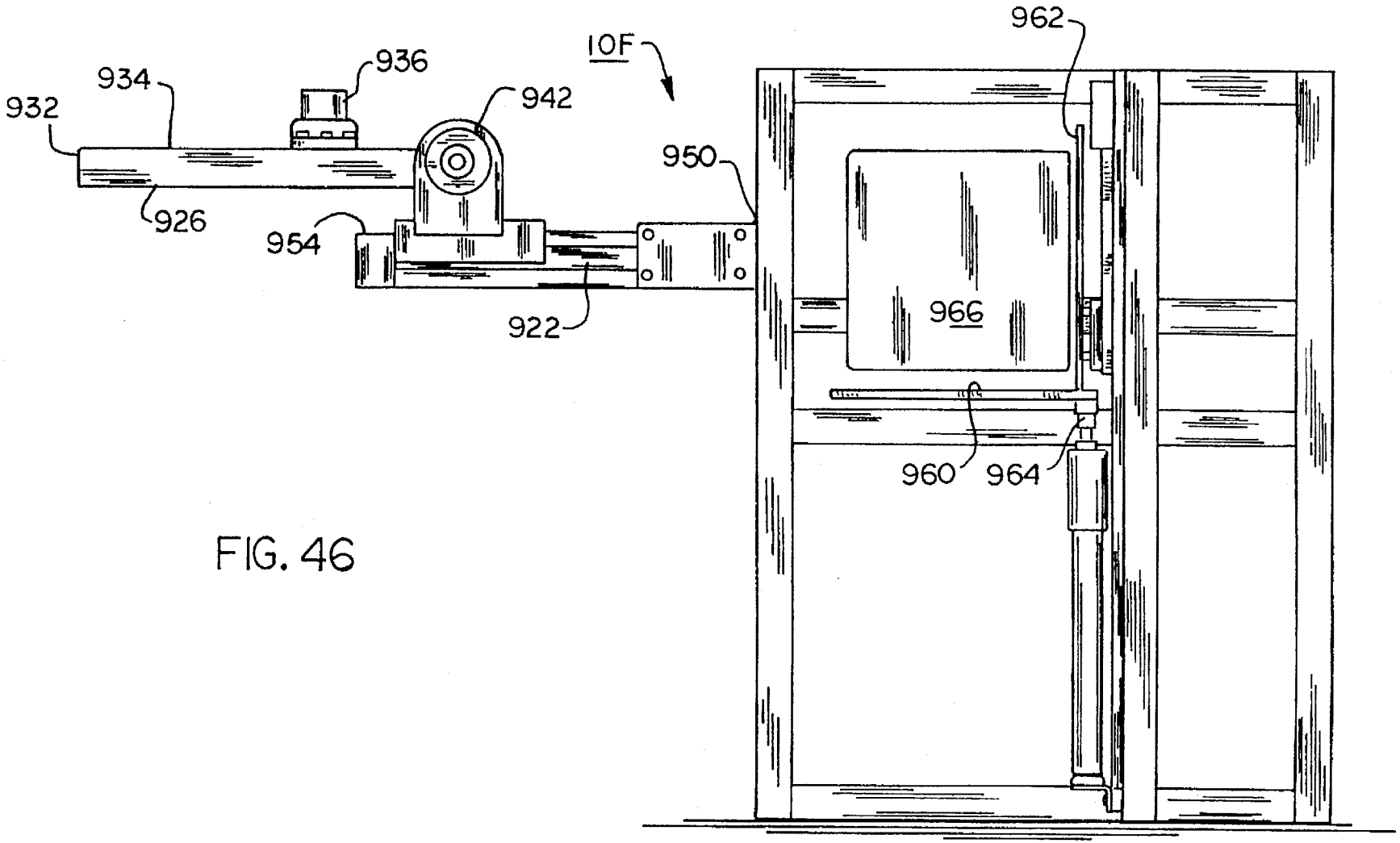
FIG. 46 is a side elevation view of the rotary stacker and first unloader shown in FIG. 45.

As best seen in FIGS. 45 and 46, a garment stacker, generally designated 10F, is shown constructed according to the present invention.

Garment stacker 10F is used to stack a plurality of garments and includes a rotary stacker 912, a stacking tray 914 and first and second unloaders 916 and 920.

Rotary stacker 912 supports a garment placed thereon and rotates to place the supported garment onto stacking tray 914. Rotary stacker 912 successively places garments on stacking tray 914 until a pre-determined number of garments have been stacked. First and second unloaders 916 and 920 function to remove garment stacks from stacking tray 914 and to remove the stacks from the garment stacker 10F.

Figure 47:
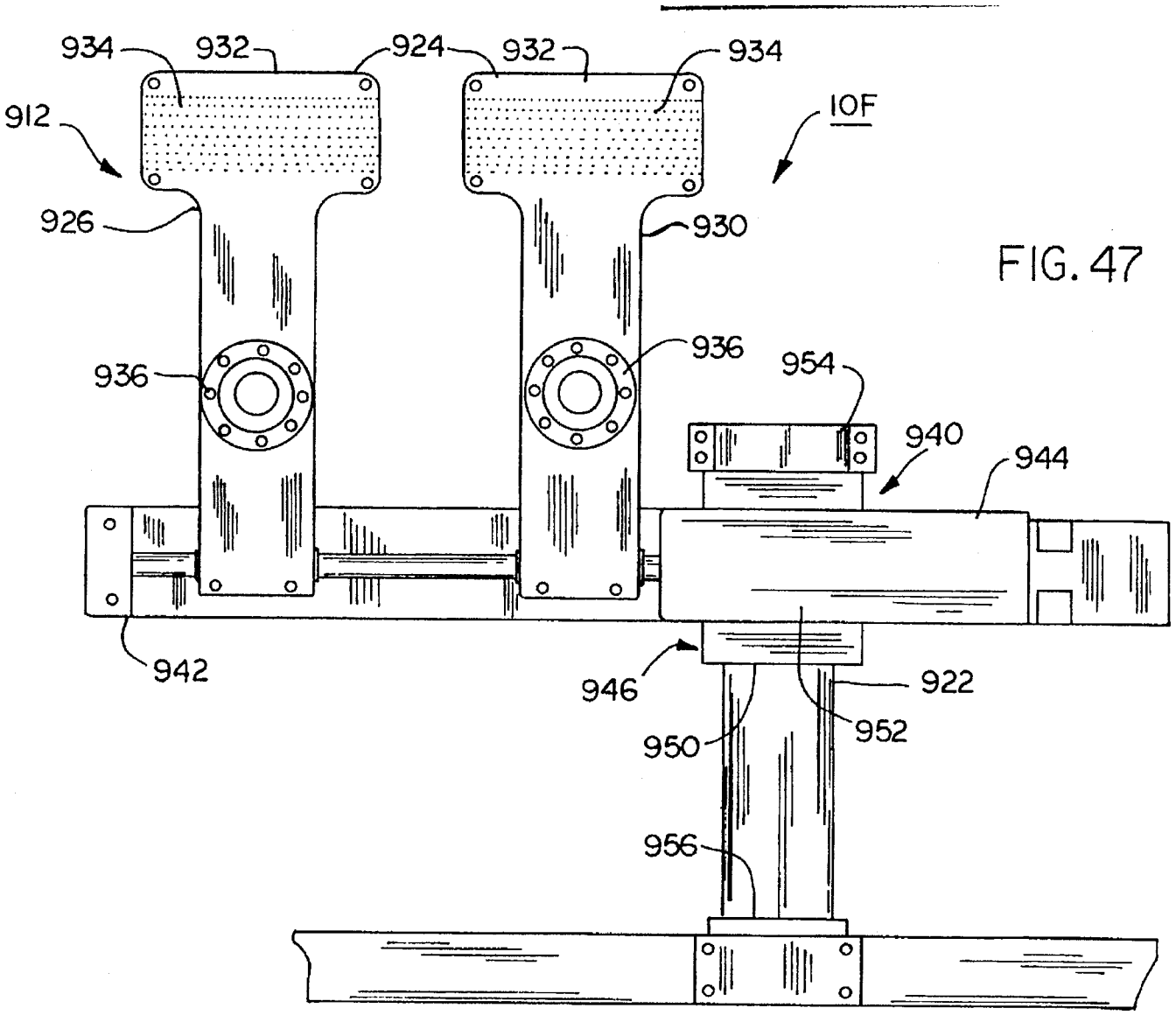
FIG. 47 is an enlarged plan view of the rotary stacker shown in FIGS. 45 and 46.

As best shown by FIG. 47, rotary stacker 912 includes a garment support 924 supported by frame 922. Garment support 924 includes a pair of garment support arms 926 and 930 that each have a garment support surface 932. Garment support surfaces 932 provide surfaces over which a garment can be placed and supported. Vacuum openings 934 are formed in the support surfaces 932 and are connected to vacuum actuators 936. Vacuum actuators 936 selectively create a vacuum at vacuum openings 934. The vacuum created on the support surface 932 of garment support 924 is used to selectively grip garments that are to be transferred to stacking tray 914 by the rotary stacker 912.

A rotary actuator assembly 940 is connected to garment support 924 to rotate garment support 924 in order to position a gripped garment onto the stacking tray 914. Rotary actuator assembly 940 includes a rotary arm 942 connected to garment support arms 926 and 930, and a rotary motor 944 for rotating rotary arm 942 and attached garment support arms 926 and 930. In the preferred embodiment, rotary motor 944 is a servo-motor. Rotary actuator 940 rotates garment support arms 926 and 930 to position garment support arms 926 and 930 between a loading position and an unloading position that are 180° apart. When in the loading position, the support surfaces 932 of garment support arms 926 and 930 are generally in an upright, horizontal position where garments can be laid thereon. Rotary actuator 940 rotates the garment support arms 926 and 930 such that support surfaces 932 are rotated from an upright, horizontal position to a generally downright, horizontal position.

Rotary stacker 912 also includes a slide assembly 946 for positioning rotary arm 942 of rotary stacker 912. The placement of garments on stacking tray 914 can be controlled by adjusting the position of rotary arm 942, which is the pivot axis for garment support arms 926 and 930. As best shown in FIG. 47, slide assembly 946 includes a carriage 950 onto which rotary arm 942 is mounted and a slide actuator 952 which is integrally a part of slide assembly 946. Slide actuator 952 positions carriage 950 along frame 922 and between stops 954 and 956. In the preferred embodiment, slide actuator 952 is a pneumatic rodless actuator.

Slide assembly 946 selectively varies the distance of the pivot axis of garment support arms 926 and 930 by moving rotary arm 942 and garment support arms 926 and 930 between retracted, partially-extended and fully-extended positions. When rotary arm 942 is in the retracted position, carriage 950 of slide assembly 946 is positioned adjacent first stop 954 and garment support arms 926 and 930 are positioned farthest from stacking tray 914. Slide actuator 952 positions carriage 950 approximately mid-way between first and second stops 954, 956 to place rotary arm 942 in the partially-extended position. When the rotary arm 942 is in the partially-extended position, garment support arms 926 and 930 are positioned such that the support surfaces 932 of support arms 926 and 930 are rotatable to a position adjacent a forward portion of the stacking tray 914. Slide actuator 952 positions carriage 950 adjacent second stop 956 to place garment support arms 926 and 930 in the fully-extended position. When the rotary arm 942 is in the fully-extended position, garment support arms 926 and 930 are positioned such that the support surfaces 932 of support arms 926 and 930 are rotatable to a position overlying a rear portion of the stacking tray. As will be described in more detail below, adjusting the position of rotary arm 942 allows a plurality of stacks to be formed on stacking tray 914.

Stacking tray 914 includes a bottom 960 on which garments are placed by rotary stacker 912. Bottom tray 960 has a forward section 960A for supporting a front garment stack and a rear section 960B for supporting a rear garment stack. A back surface 962 extends upwardly from bottom tray 960 and provides lateral support for the garments placed on bottom tray 960.

Stacking tray 914 further includes a tray actuator 964 for vertically adjusting bottom tray 960. Bottom tray 960 of stacking tray 914 is selectively raised and lowered by tray actuator 964 during the garment stacking process, as will be discussed below.

Turning back to FIG. 45, first unloader 916 is positioned adjacent stacking tray 914 and removes garment stacks from stacking tray 914. First unloader 916 includes an upright plate 966 disposed perpendicularly to bottom tray 960 and a plate actuator 970. Plate actuator 970 of first unloader 916 moves upright plate 966 between a retracted position and an extended position. When in the retracted position, upright plate 966 of first unloader 916 is positioned adjacent bottom tray 960. Plate actuator 970 moves the upright plate 966 from the retracted position to the extended position such that upright plate 966 travels over bottom tray 960 to push stacked garments from bottom tray 960.

A bin 972 is positioned adjacent bottom tray 960 of stacking tray 914 and receives stacked garments unloaded from stacking tray 914. Positioned adjacent bin 972 is a second unloader 920. Second unloader 920 includes an upright plate 974 that is connected to a plate actuator 976. Plate actuator 976 moves upright plate 974 from a retracted position to an extended position such that upright plate 974 travels over bin 972 to push garment stacks on bin 972 onto a waiting conveyor (not shown) or other transport device (not shown).

Figure 48:
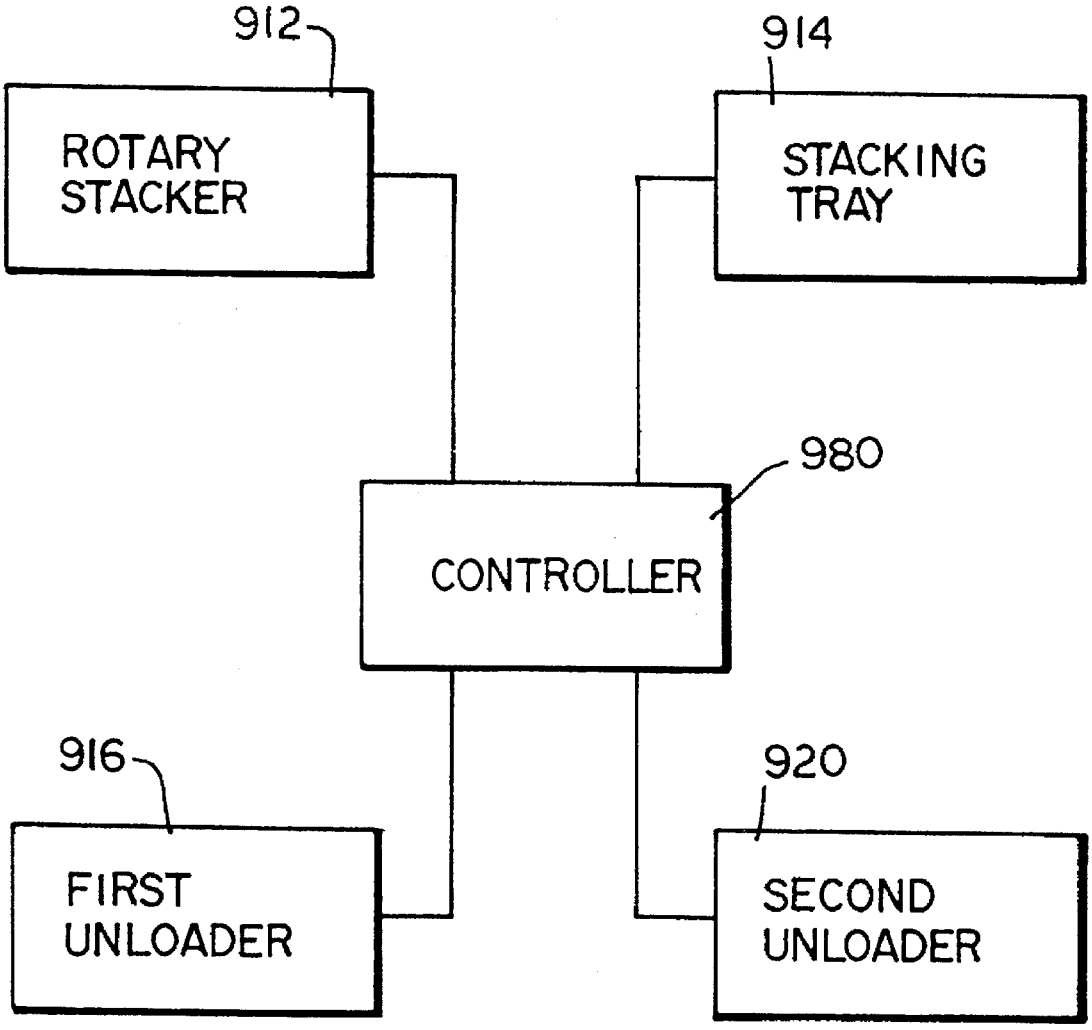
FIG. 48 is a schematic drawing showing the control system.

As best seen in FIG. 48, a controller 980 is connected to rotary stacker 912, stacking tray 914, and first and second unloaders 916 and 920. The controller 980 controls the operation of garment stacker 10F as described below.

In operation, garment stacker 10F stacks garments onto stacking tray 914 to form interlocking front and rear garment stacks F and R as schematically shown in FIGS. 49 and 50. The garment transfer cycle shown in FIGS. 49A–49H transfers a garment G onto front garment stack F which is offset from a rear garment stack R located on stacking tray 914. The garment transfer cycle shown in FIGS. 50A–50H transfers a garment G onto rear garment stack R.

Figure 49A:
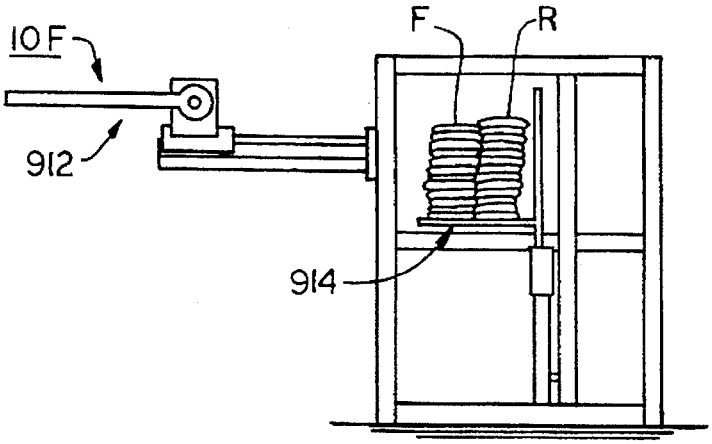
FIGS. 49A–49H are a sequence of schematic views showing the garment stacker loading a garment on a front garment stack.
Figure 49B:
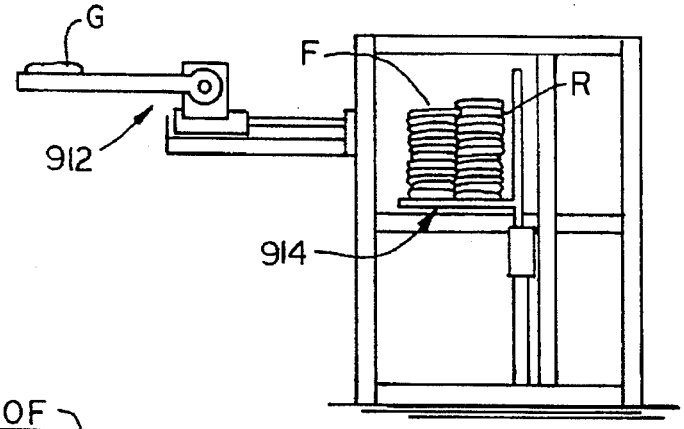

Referring to FIGS. 49A–49H, a garment transfer cycle for transferring a garment G to front garment stack F operates as follows. Rotary stacker 912 initially assumes a load position as shown in FIG. 49A. A garment is placed upon garment support arms 926 and 930 as shown in FIG. 49B, such that the garment extends across support surface 932 of support arms 926 and 930 and over vacuum openings 934. The vacuum actuator 936 creates a vacuum across vacuum openings 934 that causes the supported garment G to be gripped onto garment support arms 926 and 930.

Figure 49C:
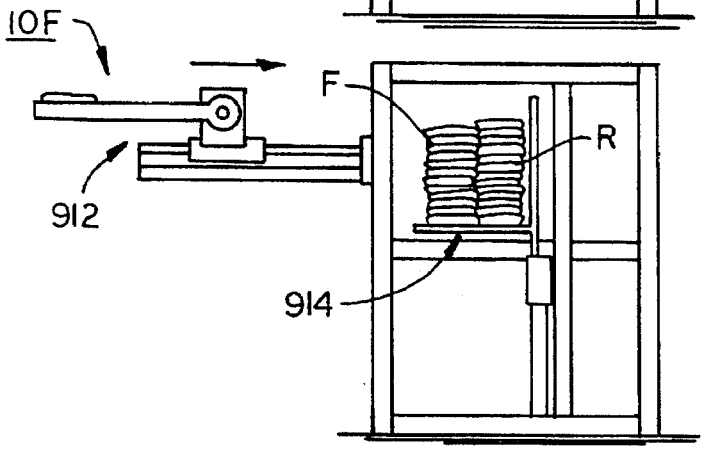
Figure 49D:
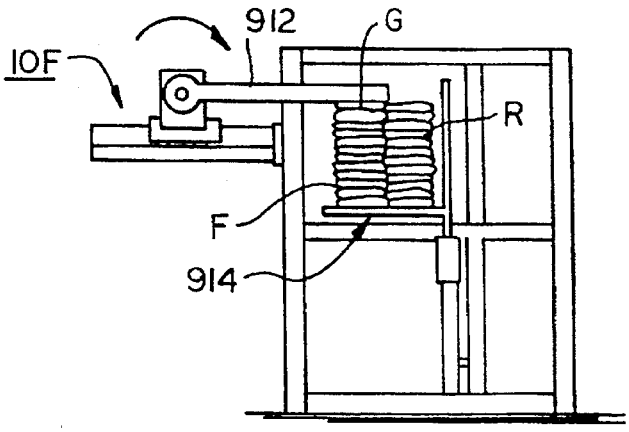

After garment G is gripped by garment support arms 926 and 930, slide assembly 946 positions carriage 950 and mounted rotary arm 942 from a retracted position to a partially-extended position located midway between stops 954 and 956 on frame 922, as shown in FIG. 49C. Positioning rotary arm 942 in the partially-extended position results in garment support arms 926 and 930 being positioned to transfer garment G to front garment stack F. As shown in FIG. 49D, rotary arm 942 and attached garment support arms 926 and 930 are then rotated 180° to an unloading position. The 180° rotation results in the support surface 932 of support arms 926 and 930 being positioned from an upright, horizontal position to a downright, horizontal position where the garment G is positioned on top of front garment stack F located on stacking tray 914.

Garment G is positioned on front garment stack F such that an end portion of garment G overlaps an end portion of the top garment on rear garment stack R. Loading garments in this overlapping manner results in the garments in the front and rear stacks F and R being interlocked with one another to form a stable bundle as shown in FIGS. 49A–49H.

Figure 49E:
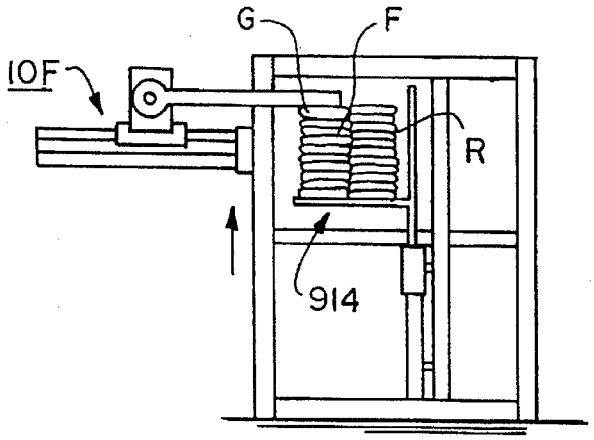
Figure 49F:
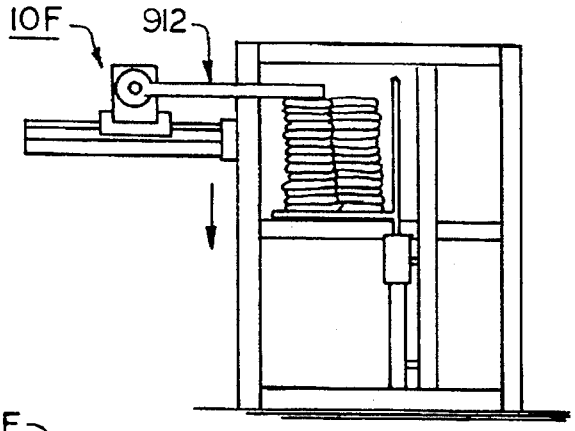

As shown in FIG. 49E, after garment G is placed on garment stack F, tray actuator 964 raises bottom tray 960 of stacking tray 914. As bottom tray 960 rises, garment stack F is pressed between bottom tray 960 and support surfaces 932 of support arms 926 and 930. A torque is placed on support arms 926 and 930 by the upward force created by tray actuator 964. Rotary motor 944 of rotary stacker 912 maintains support arms 926 and 930 in its unloading position where support surfaces 932 are in a generally horizontal position. In order to maintain the garment support arms in the unloading position, the rotary motor 944 must produce sufficient counter-torque to resist the upward force created by tray actuator 964. To create this additional counter-torque, an increased amount of current is supplied to rotary motor 944. Once a threshold torque has been reached, tray actuator 964 moves bottom tray 960 downward, as shown in FIG. 49F, for a selected period of time. The threshold torque at which tray actuator begins to lower bottom tray 960 is designed so that garment stack F is placed under sufficient pressure to insure effective stacking of the garments. In the preferred embodiment, the pounds of pressure placed on the stacked garments is between about 10 to 20 pounds.

The stacked garments are placed under the selected stacking pressure by controlling the torque placed on garment support arms 926 by stacking tray 914. In particular, increasing amounts of current are supplied to rotary motor 944 of rotary stacker 912 to maintain garment support arms 926 and 930 in their horizontal, downright position as bottom tray 960 moves upward. Controller 980 monitors the amount of current supplied to rotary motor 944 and signals tray actuator 964 to move bottom tray 960 downward when a predetermined amount of current being supplied to rotary motor 944 is detected. Tray 914 moves down for a preset time or distance and then the brake locks the tray in its vertical position.

At a time after garment G is placed on front garment stack F and prior to bottom tray 960 being lowered, vacuum actuator 936 releases the vacuum produced at vacuum openings 934 on garment support arms 926 and 930. The garment G is thus released from the garment support arms 926 and 930 and moved downwardly with bottom tray 960.

Figure 49G:
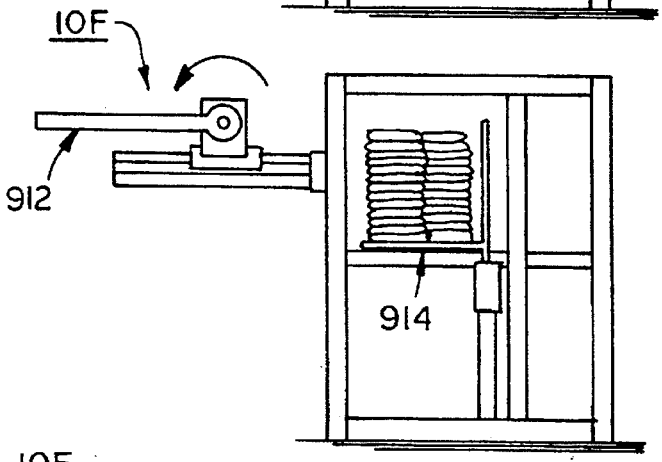
Figure 49H:
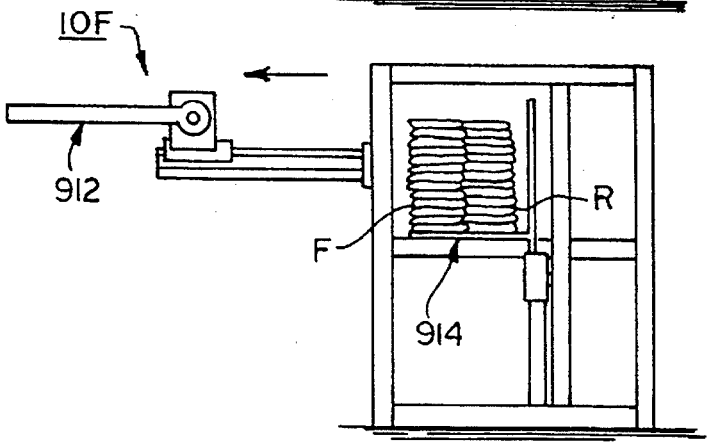

As shown in FIG. 49G, once bottom tray 960 has been lowered, garment support arms 926 and 930 are then rotated 180° to their loading position. Slide assembly 946 then retracts rotary arm 42 to its retracted position, as shown in FIG. 49H, such that support arms 926 are 930 are ready to receive another garment and perform the next garment transfer cycle.

Figure 50A:
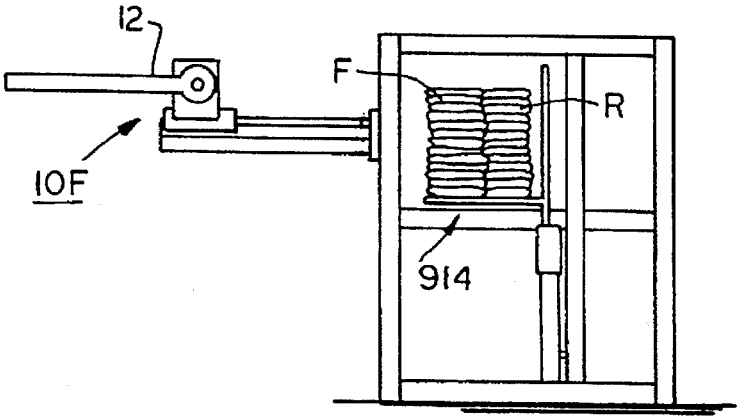
FIGS. 50A–50H are a sequence of schematic views showing the garment stacker loading a garment on a rear garment stack.
Figure 50B:
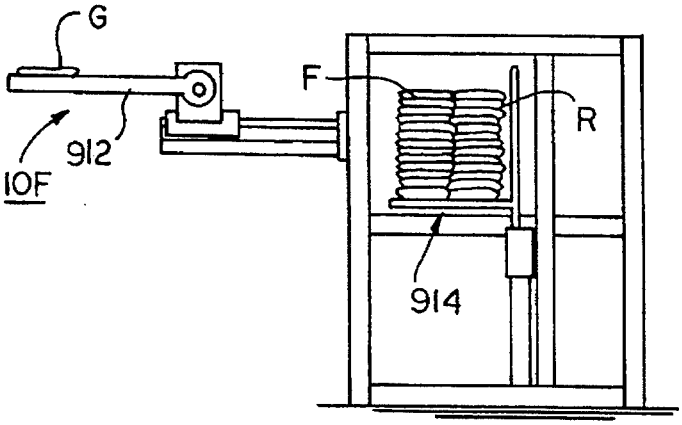
Figure 50C:
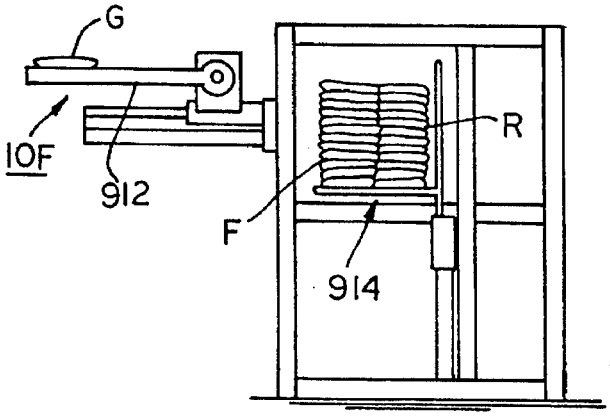
Figure 50D:
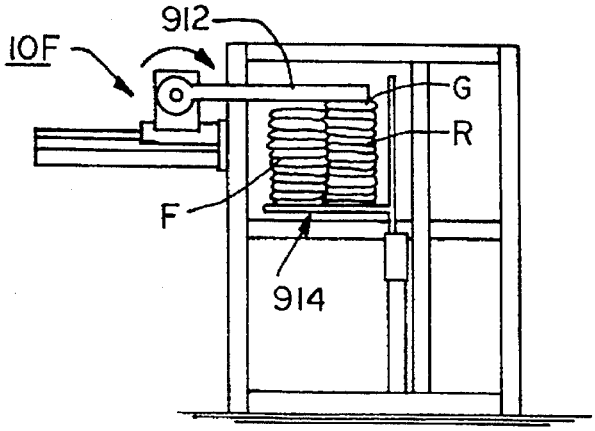
Figure 50E:
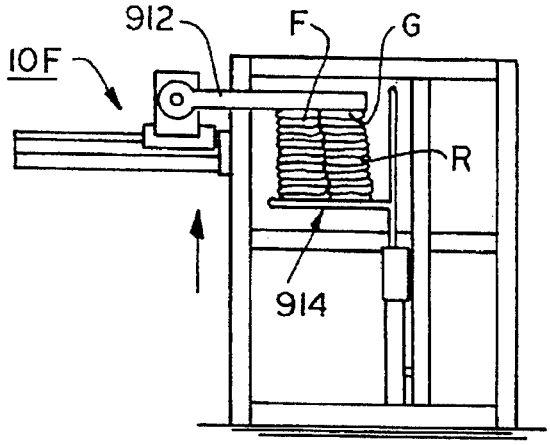
Figure 50F:
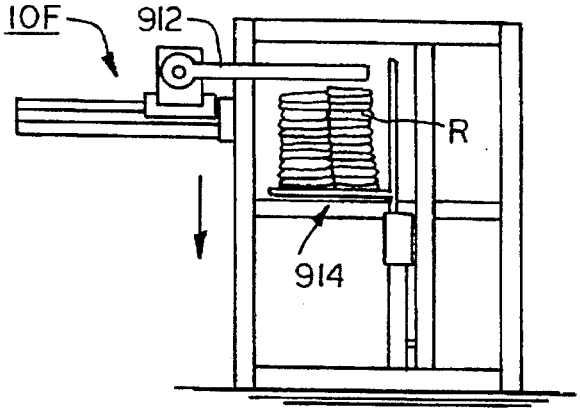
Figure 50G:
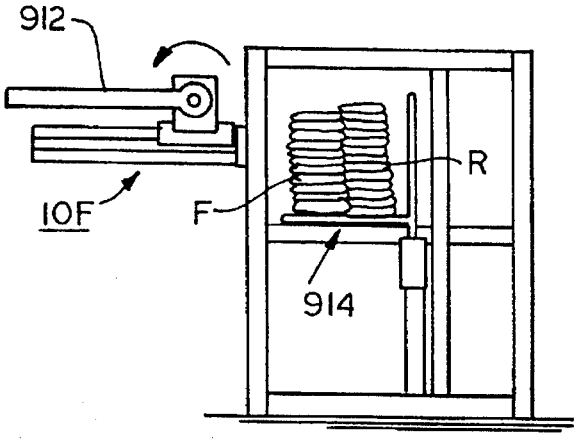
Figure 50H:
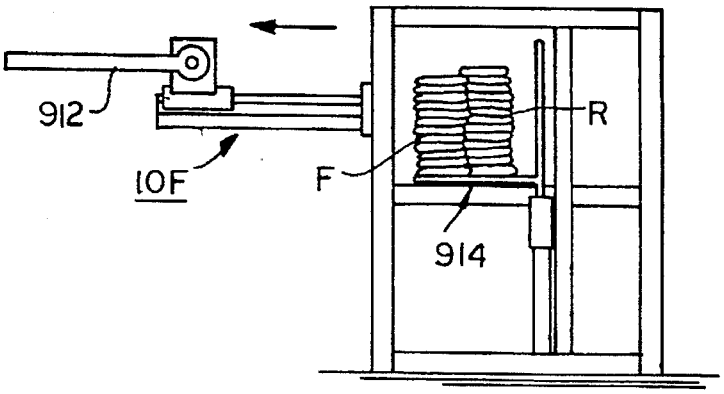

Referring to FIGS. 50A–50H, after loading a garment onto front garment stack F, a second garment transfer is performed to position a garment G onto rear garment stack R. The second garment transfer cycle is similar to the first garment transfer cycle described above with the exception that garment G is positioned on rear garment stack R. As shown in FIG. 50C, after loading, garment support arms 926 and 930 are transversely positioned by slide actuator 952 to a fully extended position. Rotating arm 942 and attached garment stacking arms 26 and 30 are positioned closer to stacking tray 914 when placed in the fully extended position such that the garment support arms 926 and 930 are rotatable to position garment 962 on rear garment stack R located on bottom tray 960.

Garment G is positioned on rear garment stack R such that an end portion of garment G overlaps an end portion of the top garment on front garment stack F. As discussed, loading garments in this overlapping manner results in the front and rear garment stacks being interlocked with one another to form a stable bundle.

As shown in FIGS. 50E–50H, after positioning garment G over rear garment stack R, the garment transfer cycle is completed in the same manner as described in FIGS. 49A–49H.

The successive first and second garment transfer cycles are repeated so that garments are alternately placed on garment stacks F and R. This results in two adjacent stacks of garments being formed on the bottom tray 960 of stacking tray 914. The garments are alternately placed on the adjacent stacks such that two interlocked stacks of garments are formed. The controller 980 maintains a count on the number of garments placed on the stack and discontinues the garment transfer cycles after a selected number of garments have been stacked on stacking tray 914.

After the selected number of garments have been stacked on stacking tray 914, the controller 980 signals first unloader 916 to remove the stacked garments from stacking tray 914. First, tray 914 moves to its full down position. Then, plate actuator 970 moves upright plate 966 from its retracted position to its extended position. As upright plate 66 moves to the extended position, upright plate 966 moves across bottom tray 960 and pushes the stacked garments onto bin 972.

Second unloader 920 then moves the stacked garments to an awaiting conveyor (not shown) or other transport device (not shown). Specifically, the upright plate 974 of second unloader 920 moves from its retracted position to its extended position to move the stacked garments on bin 972 to the awaiting conveyor or other transport mechanism. After removal of the stacked garments, garment stacker 10F repeats its cycle.

The garment stacker 10F of the present invention provides for the effective stacking and transfer of garment stacks. Each garment loaded onto stacking tray 14 is pressed onto the garment stack to insure a better stacking of the garments. In addition, garment stacker 10F provides for the stacking of a plurality of interlocked garment stacks and for the effective transferring of the garment stacks.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An apparatus for automatically forming a finished sleeve or pant leg for a sweat suit or the like, said apparatus comprising:

(a) means for receiving a garment piece at a first workstation and moving said garment piece to a second workstation, said means including: (i) a garment piece transfer system located adjacent to said first workstation for engaging said garment piece at said first workstation and for moving said garment piece to said second workstation; and (ii) a vision and control system located adjacent to said first workstation for determining the position of said garment piece at said first workstation and sending a control signal to said garment piece transfer system to engage said garment piece at said first workstation and move said garment piece to said second workstation;

(b) means for making a cuff from a continuous supply of tubular material, said means including: (i) a material feed for advancing the tubular material; (ii) a cutter disposed adjacent the material feed for severing the tubular material to form a circular band; and (c) a holding fixture for holding the circular band severed from the tubular cuff material;

(c) means for inserting said cuff into the sleeve of said garment piece, said means including: (i) a holding fixture for holding the cuff in a generally open configuration; (ii) a sleeve opener for opening the sleeve of said garment sufficient to allow insertion of said cuff into the sleeve, said sleeve opener including a support surface for supporting said sleeve and a pick-up head for engaging an upper layer of said sleeve, wherein said pick-up head is mounted for vertical movement relative to said support surface to lift the upper layer of said sleeve; and (iii) means for effecting relative movement between said holding fixture and said sleeve opener to insert the cuff into the sleeve;

(d) means for automatically setting said cuff to said garment piece by a sewing machine, said means including: (i) a transfer system for moving said cuff and garment piece to said sewing machine; and (ii) a cuff setter including an elongated tube having a front end and a rear end for receiving said garment piece over said front end of said tube and a spreader assembly for moving said cuff and garment piece together in the direction of sewing to attach said cuff to said garment;

(e) means for automatically inverting said garment piece, said means including: (i) a frame; (ii) an elongated tube attached to said frame having a front end and a rear end for receiving said garment piece over said front end of said tube; (iii) an elongated arm located adjacent to the rear end of said tube and axially aligned with said tube and movable from a first position extending from the rear to the front portion of said tube to a second position rearward of said tube; and (iv) gripper means attached to one end of said arm, whereby said gripper means and arm are operable to grasp and withdraw said garment piece through the front end of said tube to the rear end of said tube to automatically invert said garment piece; and (f) means for stacking said finished garments in a garment stack, said means including: (i) a stacking tray having a support tray for supporting garments placed thereon in a garment stack and a tray actuator for adjusting the position of said support tray; (ii) a rotary stacker positioned adjacent said stacking tray, wherein said rotary stacker repeatedly moves between a loading and an unloading position to successively stack garments on said stacking tray in a garment stack; and (iii) a controller for directing said tray actuator to position said support tray upwards when said rotary stacker is in the unloading position so as to press said garment stack between said stacking tray and rotary stacker.

2. The apparatus according to claim 1, wherein said first workstation is a loading station.

3. The apparatus according to claim 1, wherein said second workstation includes a sewing machine for performing a sewing operation on said garment piece.

4. The apparatus according to claim 1, further including a third workstation downstream of said second workstation.

5. The apparatus according to claim 4, wherein said third workstation is an unloading station.

6. The apparatus according to claim 1, wherein said garment piece transfer system includes: (i) a support table located between said first workstation and said second workstation having a smooth, generally horizontal planar top surface for supporting said garment piece thereon; and (ii) a robot positioned adjacent said table and having an arm and presser foot attached thereto, said robot arm including means for selectively moving said presser foot between a non-engagement position and an engagement position with said planar surface whereby said presser foot engages said garment piece on the surface of said support table, said robot arm including means for moving said presser foot between said first workstation and said second workstation when in said engagement position to slidably move said garment piece along the surface of said table from said first workstation to said second workstation.

7. The apparatus according to claim 1, further including a folding mechanism for folding the circular band on said holding fixture upon itself to form a double-layer cuff.

8. The apparatus according to claim 1, wherein said holding fixture includes: (i) a holding fixture for receiving and holding the circular band in an open position; and (b) gripping means formed in said holding fixture for gripping the circular band between the ends thereof.

9. The apparatus according to claim 1, wherein said pick-up head for picking up a layer of fabric includes: (i) a frame mounted for vertical movement between a raised position and a lowered position; (ii) at least one pair of opposed fabric pinchers extending downwardly from said frame, each fabric pincher including a contact surface for engaging the fabric layer when said frame is moved to a lowered position and a gripping surface opposed by the gripping surface of said opposing pincher; and (iii) actuating means for moving said fabric pinchers between an open position in which an unobstructed open space is formed between the opposed gripping surfaces of said fabric pinchers and a closed position in which the fabric layer is clamped between the opposed gripping surfaces, wherein said contact surface of said fabric pinchers is textured to provide a non-penetrating engagement with the fabric layer so that a fold is produced in the fabric layer when said fabric pinchers are moved to the closed position which extends into the open space between said pinchers and wherein the fold in the fabric layer is gripped between said opposed gripping surfaces.

10. The apparatus according to claim 1, further including a holding fixture for holding said cuff in the garment piece prior to sewing.

11. The apparatus according to claim 10, wherein the holding fixture includes a pair of generally cylindrical fingers insertable into the end of said cuff, said fingers being movable between a closed position to facilitate insertion of the fingers into said cuff and an expanded position in which the fingers are spread apart from one another to stretch said cuff.

12. The apparatus according to claim 1, wherein said transfer system includes: (i) a frame; (ii) a first pickup means attached to said frame for engaging said cuff and said garment piece adjacent to said cuff; and (iii) a second pickup means attached to said frame for engaging said garment piece opposite said cuff, whereby said first and second pickup means cooperate to move said cuff and garment piece together to said sewing machine.

13. The apparatus according to claim 1, further including spreader means for engaging said garment piece adjacent to the front end of said tube to position said garment piece for said gripper means.

14. The apparatus according to claim 13, wherein said spreader means includes a frame, a pair of opposed arms attached at one end to said frame and oriented perpendicular to the axis of said tube, and means for moving said pair of opposed arms between a first position adjacent to one another and a second position apart from one another.

15. The apparatus according to claim 1, wherein said elongated gripper arm includes: (i) a frame; (ii) an elongated arm attached to said frame at one end; (iii) gripping means attached to the other end of said elongated arm; and (iv) means for moving said arm and said gripping means from a first position away from said garment piece to a second position adjacent to said garment piece.

16. The apparatus according to claim 1, further including a first unloader for moving said garment stack from said stacking tray after a garment stack has been formed thereon, said first unloader including a first unloader plate positioned adjacent said support tray and a first unloader actuator for moving said first unloader plate from a retracted position to an extended position so as to move said first unloader plate over said support tray and push a garment stack therefrom.

17. The apparatus according to claim 16, further including a second unloader having a bin positioned to receive said garment stack moved from said support tray by said first unloader, said second unloader having a second unloading plate disposed in a generally transverse position with respect to said first plate and a second unloader actuator for moving said second unloading plate from a retracted position to an extended position so as to push said garment stack off said bin.

18. The apparatus according to claim 1, wherein said rotary stacker includes: (i) a garment support for supporting a garment thereon; and (ii) a rotary actuator for rotating said garment support between a loading position where said garment is placeable on and supportable by said garment support and an unloading position where said garment support and supported garment are positioned over said stacking tray, wherein said rotary stacker repeatedly moves between said loading and unloading positions to successively stack garments on said stacking tray in a garment stack.

19. A method for automatically forming a finished sleeve or pant leg for a sweat suit or the like, said method comprising the steps of:

(a) receiving a garment piece at a first workstation and moving said garment piece to a second workstation by means of: (i) a garment piece transfer system located adjacent to said first workstation for engaging said garment piece at said first workstation and for moving said garment piece to said second workstation; and (ii) a vision and control system located adjacent to said first workstation for determining the position of said garment piece at said first workstation and sending a control signal to said garment piece transfer system to engage said garment piece at said first workstation and move said garment piece to said second workstation;

(b) making a cuff from a continuous supply of tubular material by means of: (i) a material feed for advancing the tubular material; (ii) a cutter disposed adjacent the material feed for severing the tubular material to form a circular band; and (c) a holding fixture for holding the circular band severed from the tubular cuff material;

(c) inserting said cuff into the sleeve of said garment piece by means of: (i) a holding fixture for holding the cuff in a generally open configuration; (ii) a sleeve opener for opening the sleeve of said garment sufficient to allow insertion of said cuff into the sleeve, said sleeve opener including a support surface for supporting said sleeve and a pick-up head for engaging an upper layer of said sleeve, wherein said pick-up head is mounted for vertical movement relative to said support surface to lift the upper layer of said sleeve; and (iii) means for effecting relative movement between said holding fixture and said sleeve opener to insert the cuff into the sleeve;

(d) automatically setting said cuff to said garment piece by a sewing machine by means of: (i) a transfer system for moving said cuff and garment piece to said sewing machine; and (ii) a cuff setter including an elongated tube having a front end and a rear end for receiving said garment piece over said front end of said tube and a spreader assembly for moving said cuff and garment piece together in the direction of sewing to attach said cuff to said garment;

(e) automatically inverting said garment piece by means of: (i) a frame; (ii) an elongated tube attached to said frame having a front end and a rear end for receiving said garment piece over said front end of said tube; (iii) an elongated arm located adjacent to the rear end of said tube and axially aligned with said tube and movable from a first position extending from the rear to the front portion of said tube to a second position rearward of said tube; and (iv) gripper means attached to one end of said arm, whereby said gripper means and arm are operable to grasp and withdraw said garment piece through the front end of said tube to the rear end of said tube to automatically invert said garment piece; and (f) stacking said finished garments in a garment stack by means of: (i) a stacking tray having a support tray for supporting garments placed thereon in a garment stack and a tray actuator for adjusting the position of said support tray; (ii) a rotary stacker positioned adjacent said stacking tray, wherein said rotary stacker repeatedly moves between a loading and an unloading position to successively stack garments on said stacking tray in a garment stack; and (iii) a controller for directing said tray actuator to position said support tray upwards when said rotary stacker is in the unloading position so as to press said garment stack between said stacking tray and rotary stacker.

* * * * *